US010941771B2

(12) United States Patent
Hu et al.

(10) Patent No.: US 10,941,771 B2
(45) **Date of Patent: *Mar. 9, 2021**

(54) FLUID MACHINERY, HEAT EXCHANGE EQUIPMENT, AND OPERATING METHOD FOR FLUID MACHINERY

(71) Applicant: GREE GREEN REFRIGERATION TECHNOLOGY CENTER CO., LTD. OF ZHUHAI, Guangdong (CN)

(72) Inventors: Yusheng Hu, Guangdong (CN); Jia Xu, Guangdong (CN); Zhongcheng Du, Guangdong (CN); Liping Ren, Guangdong (CN); Sen Yang, Guangdong (CN); Lingchao Kong, Guangdong (CN); Liying Deng, Guangdong (CN); Rongting Zhang, Guangdong (CN); Jinquan Zhang, Guangdong (CN)

(73) Assignee: GREE GREEN REFRIGERATION TECHNOLOGY CENTER CO., LTD. OF ZHUHAI, Guangdong (CN)

( * ) Notice: Subject to any disclaimer, the term of this patent is extended or adjusted under 35 U.S.C. 154(b) by 349 days.

This patent is subject to a terminal disclaimer.

(21) Appl. No.: 15/751,038

(22) PCT Filed: Jun. 1, 2016

(86) PCT No.: PCT/CN2016/084318
§ 371 (c)(1),
(2) Date: Feb. 7, 2018

(87) PCT Pub. No.: WO2017/024862
PCT Pub. Date: Feb. 16, 2017

(65) Prior Publication Data

US 2018/0245591 A1 Aug. 30, 2018

(30) Foreign Application Priority Data

Aug. 7, 2015 (CN) ..... 201510482080.3

(51) Int. Cl.
*F03C 2/00* (2006.01)
*F03C 4/00* (2006.01)
(Continued)

(52) U.S. Cl.
CPC ..... *F04C 18/34* (2013.01); *F01B 13/02* (2013.01); *F01C 1/34* (2013.01); *F01C 1/344* (2013.01);
(Continued)

(58) Field of Classification Search
CPC .. F04B 29/00; F04B 29/0071; F04B 27/0663; F04B 19/025; F04B 39/12;
(Continued)

(56) References Cited

U.S. PATENT DOCUMENTS 2,411,929 A * 12/1946 Malke ..... F04B 27/0465 417/462
3,279,445 A * 10/1966 Karol ..... F01B 13/02 123/44 D
(Continued)

FOREIGN PATENT DOCUMENTS

CN 2198419 Y 5/1995
CN 201162677 Y 12/2008
(Continued)

OTHER PUBLICATIONS

WIPO, International Search Report dated Sep. 7, 2016.
(Continued)

*Primary Examiner* — Theresa Trieu
(74) *Attorney, Agent, or Firm* — Li & Cai Intellectual Property (USA) Office

(57) ABSTRACT

A fluid machine, heat exchanger, and operating method of fluid machine. The fluid machine includes: a rotation shaft (10), a cylinder (20), and a piston assembly (30). The rotation shaft (10) and the cylinder (20) are eccentrically
(Continued)

disposed relative to each other and an eccentric distance is fixed. The piston assembly (30) has a variable volume chamber (31). Because the eccentric distance between the rotation shaft (10) and the cylinder (20) is fixed, the rotation shaft (10) and the cylinder (20) rotate about their respective axes thereof during motion and the position of center of mass remains unchanged, so that the piston assembly (30) is allowed to rotate stably and continuously when moving in the cylinder (20); and vibration of the fluid machine is mitigated, a regular pattern for changes in the volume of the variable volume cavity is ensured.

26 Claims, 49 Drawing Sheets

(51) Int. Cl.

| | |
|---|---|
| ***F04C 2/00*** | (2006.01) |
| ***F04C 18/34*** | (2006.01) |
| ***F01B 13/02*** | (2006.01) |
| ***F04C 29/00*** | (2006.01) |
| ***F01C 1/344*** | (2006.01) |
| ***F04C 18/344*** | (2006.01) |
| ***F01C 1/34*** | (2006.01) |
| ***F01C 20/22*** | (2006.01) |
| ***F01C 21/08*** | (2006.01) |
| ***F01C 21/10*** | (2006.01) |
| ***F04C 28/22*** | (2006.01) |
| ***F04C 29/02*** | (2006.01) |
| ***F04C 29/12*** | (2006.01) |

(52) U.S. Cl.
CPC ..... *F01C 20/22* (2013.01); *F01C 21/08* (2013.01); *F01C 21/10* (2013.01); *F04C 18/344* (2013.01); *F04C 28/22* (2013.01); *F04C 29/0057* (2013.01); *F04C 29/02* (2013.01); *F04C 29/12* (2013.01); *F04C 2240/20* (2013.01); *F04C 2240/60* (2013.01)

(58) Field of Classification Search
CPC ..... F04B 39/0005; F01B 13/02; F04C 18/34; F04C 18/344; F04C 28/22; F04C 29/0057; F04C 29/0071; F04C 29/02; F04C 29/028; F04C 29/12; F04C 29/128; F04C 29/22; F04C 2240/20; F04C 2240/60; F01C 1/34; F01C 1/344; F01C 20/22; F01C 21/10; F01C 21/108; F01C 21/08
USPC ..... 418/1, 131, 133–134, 255, 259
See application file for complete search history.

(56) References Cited

U.S. PATENT DOCUMENTS

| | | | | |
|---|---|---|---|---|
| 4,137,019 | A * | 1/1979 | Hofmann | F01C 1/103 417/462 |
| 10,626,858 | B2 * | 4/2020 | Du | F01C 21/108 417/53 |

FOREIGN PATENT DOCUMENTS

| | | | | | |
|---|---|---|---|---|---|
| CN | 201288669 | Y | | 8/2009 | |
| CN | 201696298 | U | | 1/2011 | |
| CN | 104454021 | A | | 3/2015 | |
| CN | 104819155 | A | | 8/2015 | |
| CN | 204877938 | U | | 12/2015 | |
| CN | 204877940 | U | | 12/2015 | |
| CN | 205064265 | U | | 3/2016 | |
| CN | 106704181 | A | | 5/2017 | |
| CN | 106704182 | A | | 5/2017 | |
| CN | 106704183 | A | | 5/2017 | |
| FR | 1363724 | | | 12/1964 | |
| JP | 58220977 | A | * | 12/1983 | F04B 19/025 |
| JP | 4365729 | B2 | | 12/2005 | |
| JP | 2011085128 | A | | 4/2011 | |
| JP | 2011085128 | A | * | 4/2011 | F04B 19/025 |
| KR | 970001962 | A | | 1/1997 | |
| WO | WO 00/11321 | A1 | | 3/2000 | |
| WO | WO 2013/077388 | A1 | | 5/2013 | |

OTHER PUBLICATIONS

Japan Patent Office, Examination report dated Jan. 22, 2020.
Japan Patent Office, Examination report dated Sep. 17, 2019.
Korean Patent Office, Examination report dated Jan. 22, 2020.
China Patent Office, Patent search report.

* cited by examiner

FLUID MACHINERY, HEAT EXCHANGE EQUIPMENT, AND OPERATING METHOD FOR FLUID MACHINERY

TECHNICAL FIELD

The present disclosure relates to the technical field of heat exchange systems, and more particularly to fluid machinery, heat exchange equipment, and an operating method for fluid machinery.

BACKGROUND

Fluid machinery in the related art includes a compressor, an expander and the like. The compressor is taken for example.

During motion, the positions of the center of mass of a rotating shaft and cylinder of a piston-type compressor in the related art are changed. A crankshaft is driven by a motor to output power, and the crankshaft drives a piston to make a reciprocating motion in the cylinder to compress gas or liquid to apply work, so as to achieve the aim of compressing gas or liquid.

A traditional piston-type compressor has several defects as follows. In the presence of a suction valve and an exhaust valve, the suction resistance and the exhaust resistance are increased, and the suction and exhaust noises are increased. A large lateral force is exerted on a cylinder of the compressor, and the lateral force applies an idle work, thereby reducing the efficiency of the compressor. A crankshaft drives a piston to make a reciprocating motion, and the eccentric mass is large, thereby causing large vibration of the compressor. The compressor drives one or more pistons to work via a crank-connecting rod mechanism, thereby being complex in structure. The lateral force exerted on the crankshaft and the piston is large, and the piston is easy to abrade, thereby reducing the sealing property of the piston. Moreover, the volume efficiency of the conventional compressor is low due to the reasons such as clearance volume and large leakage, and is difficult to increase.

In addition, the center of mass of an eccentric portion in a piston-type compressor makes a circular motion to generate a size-invariable and direction-variable centrifugal force, this centrifugal force increasing vibration of the compressor.

SUMMARY

The present disclosure is mainly directed to fluid machinery, heat exchange equipment, and an operating method for fluid machinery, intended to solve the problem in the related art in which a compressor is unstable in operation due to an unfixed eccentric distance between a cylinder and a rotating shaft.

To this end, according to an aspect of the present disclosure, fluid machinery is provided. The fluid machinery includes: a rotating shaft; a cylinder, the axis of the rotating shaft and the axis of the cylinder being eccentric to each other and at a fixed eccentric distance; and a piston component, the piston component being provided with a variable volume cavity, the piston component being pivotally provided in the cylinder, and the rotating shaft being drivingly connected with the piston component to change the volume of the variable volume cavity.

Further, the fluid machinery further includes an upper flange and a lower flange, the cylinder being sandwiched between the upper flange and the lower flange. The piston component includes: a piston sleeve, the piston sleeve being pivotally provided in the cylinder; and a piston, the piston being slidably provided in the piston sleeve to form the variable volume cavity, and the variable volume cavity being located in a sliding direction of the piston.

Further, the piston is provided with a sliding groove in which the rotating shaft moves, and the piston rotates along with the rotating shaft under the driving of the rotating shaft and slides in the piston sleeve along a direction vertical to an axial direction of the rotating shaft in a reciprocating manner.

Further, the piston is provided with a sliding hole running through the axial direction of the rotating shaft, the rotating shaft penetrates through the sliding hole, and the piston rotates along with the rotating shaft under the driving of the rotating shaft and slides in the piston sleeve along a direction vertical to the axial direction of the rotating shaft in a reciprocating manner.

Further, the fluid machinery further includes a piston sleeve shaft, the piston sleeve shaft penetrates through the upper flange and is fixedly connected to the piston sleeve, the rotating shaft sequentially penetrates through the lower flange and the cylinder and is in sliding fit with the piston, the piston sleeve synchronously rotates along with the piston sleeve shaft under the driving action of the piston sleeve shaft to drive the piston to slide in the piston sleeve so as to change the volume of the variable volume cavity, and meanwhile, the rotating shaft rotates under the driving action of the piston.

Further, the sliding hole is an slotted hole or a waist-shaped hole.

Further, the piston is provided with a sliding hole running through the axial direction of the rotating shaft, the rotating shaft penetrates through the sliding hole, the rotating shaft rotates along with the piston sleeve and the piston under the driving of the piston, and meanwhile, the piston slides in the piston sleeve along a direction vertical to the axial direction of the rotating shaft in a reciprocating manner.

Further, a guide hole running through a radial direction of the piston sleeve is provided in the piston sleeve, and the piston is slidably provided in the guide hole to make a straight reciprocating motion.

Further, the piston is provided with a pair of arc-shaped surfaces arranged symmetrically about a middle vertical plane of the piston, the arc-shaped surfaces adaptively fit an inner surface of the cylinder, and the double arc curvature radius of the arc-shaped surfaces is equal to the inner diameter of the cylinder.

Further, the piston is columnar.

Further, an orthographic projection of the guide hole at the lower flange is provided with a pair of parallel straight line segments, the pair of parallel straight line segments is formed by projecting a pair of parallel inner wall surfaces of the piston sleeve, and the piston is provided with outer profiles which are in shape adaptation to and in sliding fit with a pair of parallel inner wall surfaces of the guide hole.

Further, the piston sleeve is provided with a connecting shaft protruding towards one side of the lower flange, the connecting shaft being embedded into a connecting hole of the lower flange.

Further, the upper flange is coaxial with the rotating shaft, the axis of the upper flange is eccentric to the axis of the cylinder, and the lower flange is coaxial with the cylinder.

Further, the fluid machinery further includes a supporting plate, the supporting plate is provided on an end face, away from one side of the cylinder, of the lower flange, the supporting plate is coaxial with the lower flange, the rotating shaft penetrates through a through hole in the lower flange and is supported on the supporting plate, and the supporting plate is provided with a second thrust surface for supporting the rotating shaft.

Further, the fluid machinery further includes a limiting plate, the limiting plate being provided with an avoidance hole for avoiding the rotating shaft, and the limiting plate being sandwiched between the lower flange and the piston sleeve and coaxial with the piston sleeve.

Further, the piston sleeve is provided with a connecting convex ring protruding towards one side of the lower flange, the connecting convex ring being embedded into the avoidance hole.

Further, the fluid machinery is characterized in that the upper flange and the lower flange are coaxial with the rotating shaft, and the axis of the upper flange and the axis of the lower flange are eccentric to the axis of the cylinder.

Further, a first thrust surface of a side, facing the lower flange, of the piston sleeve is in contact with the surface of the lower flange.

Further, the piston is provided with a fourth thrust surface for supporting the rotating shaft, an end face, facing one side of the lower flange, of the rotating shaft being supported at the fourth thrust surface.

Further, the piston sleeve is provided with a third thrust surface for supporting the rotating shaft, an end face, facing one side of the lower flange, of the rotating shaft being supported at the third thrust surface.

Further, the rotating shaft includes: a shaft body; and a connecting head, the connecting head being arranged at a first end of the shaft body and connected to the piston component.

Further, the connecting head is quadrangular in a plane vertical to the axis of the shaft body.

Further, the connecting head is provided with two sliding fit surfaces symmetrically arranged.

Further, the sliding fit surfaces are parallel with an axial plane of the rotating shaft, and the sliding fit surfaces are in sliding fit with an inner wall surface of the sliding groove of the piston in a direction vertical to the axial direction of the rotating shaft.

Further, the rotating shaft includes: a shaft body; and a connecting head, the connecting head being arranged at a first end of the shaft body and connected to the piston component.

Further, the connecting head is quadrangular in a plane vertical to the axis of the shaft body.

Further, the connecting head is provided with two sliding fit surfaces symmetrically arranged.

Further, the sliding fit surfaces are parallel with an axial plane of the rotating shaft, and the sliding fit surfaces are in sliding fit with an inner wall surface of the sliding hole of the piston in a direction vertical to the axial direction of the rotating shaft.

Further, the rotating shaft is provided with a sliding segment in sliding fit with the piston component, the sliding segment is located between two ends of the rotating shaft, and the sliding segment is provided with sliding fit surfaces.

Further, the sliding fit surfaces are symmetrically provided on two sides of the sliding segment.

Further, the sliding fit surfaces are parallel with an axial plane of the rotating shaft, and the sliding fit surfaces are in sliding fit with an inner wall surface of the sliding hole of the piston in a direction vertical to the axial direction of the rotating shaft.

Further, the rotating shaft is provided with a sliding segment in sliding fit with the piston component, the sliding segment is located between two ends of the rotating shaft, and the sliding segment is provided with sliding fit surfaces.

Further, the rotating shaft is provided with a oil passage, the oil passage including an internal oil channel provided inside the rotating shaft, an external oil channel arranged outside the rotating shaft and an oil-through hole communicating the internal oil channel and the external oil channel.

Further, the external oil channel extending along the axial direction of the rotating shaft is provided at the sliding fit surfaces.

Further, the piston sleeve shaft is provided with a first oil passage running through an axial direction of the piston sleeve shaft, the rotating shaft is provided with a second oil passage communicated with the first oil passage, at least part of the second oil passage is an internal oil channel of the rotating shaft, the second oil passage at the sliding fit surface is an external oil channel, the rotating shaft is provided with an oil-through hole, and the internal oil channel is communicated with the external oil channel through the oil-through hole.

Further, a cylinder wall of the cylinder is provided with a compression intake port and a first compression exhaust port, when the piston component is located at an intake position, the compression intake port is communicated with the variable volume cavity, and when the piston component is located at an exhaust position, the variable volume cavity is communicated with the first compression exhaust port.

Further, an inner wall surface of the cylinder wall is provided with a compression intake buffer tank, the compression intake buffer tank being communicated with the compression intake port.

Further, the compression intake buffer tank is provided with an arc-shaped segment in a radial plane of the cylinder, and the compression intake buffer tank extends from the compression intake port to one side where the first compression exhaust port is located.

Further, the cylinder wall of the cylinder is provided with a second compression exhaust port, the second compression exhaust port is located between the compression intake port and the first compression exhaust port, and during rotation of the piston component, a part of gas in the piston component is depressurized by the second compression exhaust port and then completely exhausted from the first compression exhaust port.

Further, the fluid machinery further includes an exhaust valve component, the exhaust valve component being arranged at the second compression exhaust port.

Further, a receiving groove is provided on an outer wall of the cylinder wall, the second compression exhaust port runs through the groove bottom of the receiving groove, and the exhaust valve component is provided in the receiving groove.

Further, the exhaust valve component includes: an exhaust valve, the exhaust valve being provided in the receiving groove and shielding the second compression exhaust port; and a valve baffle, the valve baffle being overlaid on the exhaust valve.

Further, the fluid machinery is a compressor.

Further, the cylinder wall of the cylinder is provided with an expansion exhaust port and a first expansion intake port, when the piston component is located at an intake position, the expansion exhaust port is communicated with the variable volume cavity, and when the piston component is located at an exhaust position, the variable volume cavity is communicated with the first expansion intake port.

Further, the inner wall surface of the cylinder wall is provided with an expansion exhaust buffer tank, the expansion exhaust buffer tank being communicated with the expansion exhaust port.

Further, the expansion exhaust buffer tank is provided with an arc-shaped segment in a radial plane of the cylinder, the expansion exhaust buffer tank extends from the expansion exhaust port to one side where the first expansion intake port is located, and an extending direction of the expansion exhaust buffer tank is consistent with a rotating direction of the piston component.

Further, the fluid machinery is an expander.

Further, there are at least two guide holes spaced in the axial direction of the rotating shaft, there are at least two pistons, and each guide hole is provided with the corresponding piston.

According to another aspect of the present disclosure, heat exchange equipment is provided. The heat exchange equipment includes fluid machinery, the fluid machinery being the above fluid machinery.

According to another aspect of the present disclosure, an operating method for fluid machinery is provided. The operating method for fluid machinery includes: a rotating shaft rotates around the axis $O_1$ of the rotating shaft; a cylinder rotates around the axis $O_2$ of the cylinder, wherein the axis of the rotating shaft and the axis of the cylinder are eccentric to each other and at a fixed eccentric distance; and a piston in a piston component rotates along with the rotating shaft under the driving of the rotating shaft and slides in a piston sleeve of the piston component along a direction vertical to an axial direction of the rotating shaft in a reciprocating manner.

Further, the operating method adopts a principle of cross slider mechanism, wherein the piston serves as a slider, a sliding fit surface of the rotating shaft serves as a first connecting rod $I_1$, and a guide hole of the piston sleeve serves as a second connecting rod $I_2$.

By means of the technical solutions of the present disclosure, the axis of a rotating shaft and the axis of a cylinder are eccentric to each other and at a fixed eccentric distance, a piston component is provided with a variable volume cavity, the piston component is pivotally provided in the cylinder, and the rotating shaft is drivingly connected with the piston component to change the volume of the variable volume cavity. Because the eccentric distance between the rotating shaft and the cylinder is fixed, the rotating shaft and the cylinder rotate around the respective axes thereof during motion, and the position of the center of mass remains unchanged, so that the piston component is allowed to rotate stably and continuously when moving in the cylinder; and vibration of the fluid machinery is effectively mitigated, a regular pattern for changes in the volume of the variable volume cavity is ensured, and clearance volume is reduced, thereby increasing the operational stability of the fluid machinery, and increasing the working reliability of heat exchange equipment.

BRIEF DESCRIPTION OF THE DRAWINGS

The drawings of the description, forming a part of the present application, are used to provide a further understanding for the present disclosure. The schematic embodiments and descriptions of the present disclosure are used to explain the present disclosure, and do not form improper limits to the present disclosure. In the drawings.

Figure 1:
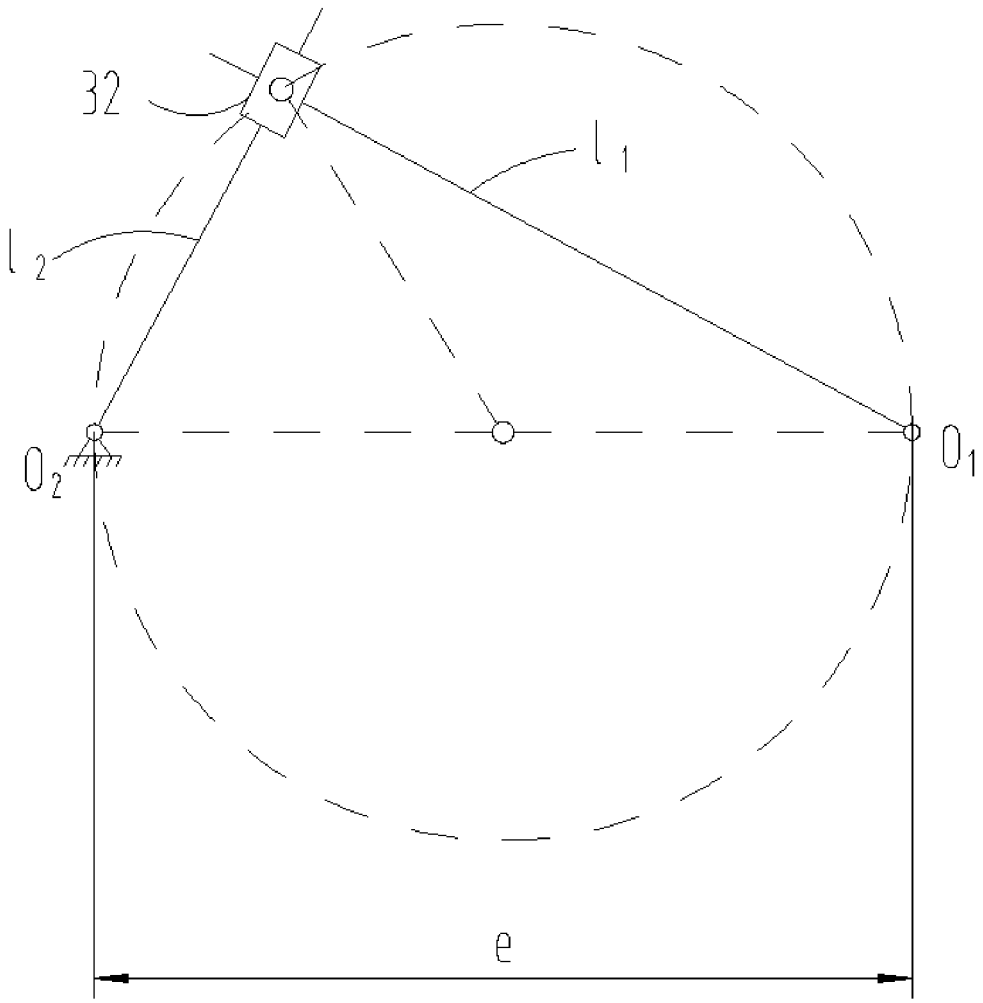
FIG. 1 shows a working principle diagram of a compressor in the present disclosure.
Figure 2:
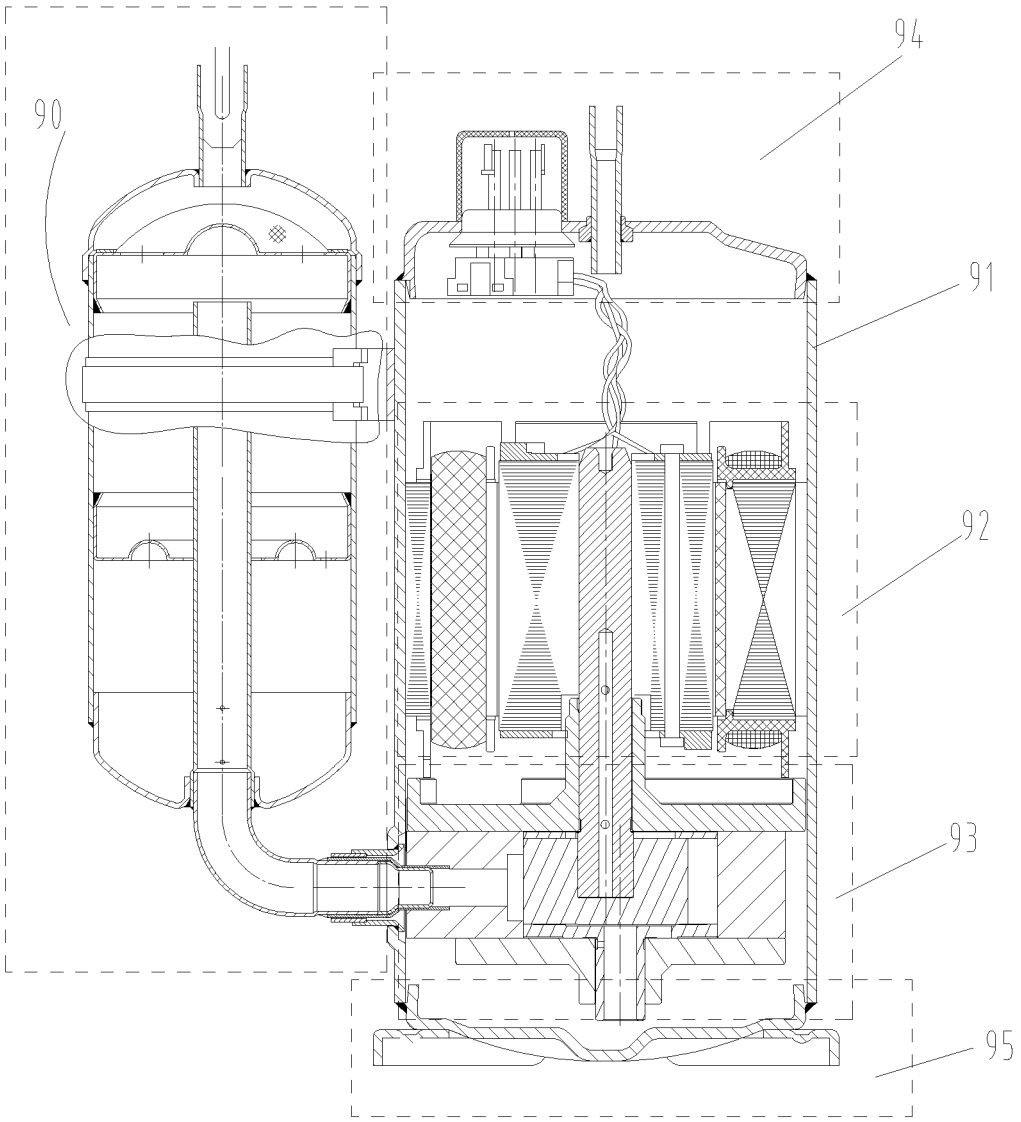
FIG. 2 shows a structure diagram of a compressor in a first preferable implementation manner.

Herein, the drawings include the following drawing marks:

10, rotating shaft; 16, shaft body; 17, connecting head; 11, sliding segment; 111, sliding fit surface; 13, oil passage; 131, second oil passage; 14, oil-through hole; 15, rotating shaft axis; 20, cylinder; 21, compression intake port; 22, first compression exhaust port; 23, compression intake buffer tank; 24, second compression exhaust port; 25, receiving groove; 26, limiting plate; 30, piston component; 31, variable volume cavity; 311, guide hole; 32, piston; 321, sliding hole; 322, piston center-of-mass trajectory; 323, sliding groove; 33, piston sleeve; 331, connecting shaft; 332, first thrust surface; 333, piston sleeve axis; 334, connecting convex ring; 335, third thrust surface; 336, fourth thrust surface; 34, piston sleeve shaft; 341, first oil passage; 40, exhaust valve component; 41, exhaust valve; 42, valve baffle; 43, first fastener; 50, upper flange; 60, lower flange; 61, supporting plate; 611, second thrust surface; 70, second fastener; 80, third fastener; 81, fourth fastener; 82, fifth fastener; 90, dispenser part; 91, housing component; 92, motor component; 93, pump body component; 94, upper cover component; 100, fluid machinery; 200, heat exchange equipment; and 95, lower cover and mounting plate.

DETAILED DESCRIPTION OF THE EMBODIMENTS

It is important to note that embodiments in the present application and characteristics in the embodiments may be combined mutually under the condition of no conflicts. The present disclosure will be illustrated hereinbelow with reference to the drawings and in conjunction with the embodiments in detail.

It should be pointed out that the following detailed descriptions are exemplary and intended to provide a further description for the present application. Unless specified otherwise, all technical and scientific terms used herein have the same meanings as those usually understood by a person of ordinary skill in the art of the present application.

In the present disclosure, on the contrary, used nouns of locality such as "left and right" are usually left and right as shown in the drawings, "interior and exterior" refer to interior and exterior of an own profile of each part, but the above nouns of locality are not used to limit the present disclosure.

In order to solve the problem in the related art in which fluid machinery 100 is unstable in motion and large in vibration and has clearance volume, the present disclosure provides fluid machinery 100, heat exchange equipment 200 and an operating method for fluid machinery 100, wherein the heat exchange equipment 200 includes the following fluid machinery 100, and the fluid machinery 100 operates by adopting the following operating method.

The fluid machinery 100 in the present disclosure includes a rotating shaft 10, a cylinder 20 and a piston component 30, wherein the axis of the rotating shaft 10 and the axis of the cylinder 20 are eccentric to each other and at a fixed eccentric distance; the piston component 30 is provided with a variable volume cavity 31, the piston component 30 is pivotally provided in the cylinder 20, and the rotating shaft 10 is drivingly connected with the piston component 30 to change the volume of the variable volume cavity 31.

Because the eccentric distance between the rotating shaft 10 and the cylinder 20 is fixed, the rotating shaft 10 and the cylinder 20 rotate around the respective axes thereof during motion, and the position of the center of mass remains unchanged, so that the piston component 30 is allowed to rotate stably and continuously when moving in the cylinder 20; and vibration of the fluid machinery 100 is effectively mitigated, a regular pattern for changes in the volume of the variable volume cavity is ensured, and clearance volume is reduced, thereby increasing the operational stability of the fluid machinery 100, and increasing the working reliability of heat exchange equipment 200.

As shown in FIG. 1, when the fluid machinery 100 adopting the above structure operates, the rotating shaft 10 rotates around the axis $O_1$ of the rotating shaft 10; the cylinder 20 rotates around the axis $O_2$ of the cylinder 20, wherein the axis of the rotating shaft 10 and the axis of the cylinder 20 are eccentric to each other and at a fixed eccentric distance; and the piston 32 in the piston component 30 rotates along with the rotating shaft 10 under the driving of the rotating shaft 10 and slides in the piston sleeve 33 of the piston component 30 along a direction vertical to an axial direction of the rotating shaft 10 in a reciprocating manner.

The fluid machinery 100 operating by using the above method forms a cross slider mechanism. The operating method adopts a principle of cross slider mechanism, wherein the piston 32 serves as a slider, a sliding fit surface 111 of the rotating shaft 10 serves as a first connecting rod l*i*, and a guide hole 311 of the piston sleeve 33 serves as a second connecting rod $I_2$ (see FIG. 1).

Specifically speaking, the axis $O_1$ of the rotating shaft 10 is equivalent to the center of rotation of the first connecting rod l*i*, and the axis $O_2$ of the cylinder 20 is equivalent to the center of rotation of the second connecting rod $I_2$. The sliding fit surface 111 of the rotating shaft 10 is equivalent to the first connecting rod l*i*, and the guide hole 311 of the piston sleeve 33 is equivalent to the second connecting rod $I_2$. The piston 32 is equivalent to the slider. The guide hole 311 is vertical to the sliding fit surface 111, the piston 32 only makes a reciprocating motion relative to the guide hole 311, and the piston 32 only makes a reciprocating motion relative to the sliding fit surface 111. After the piston 32 is simplified as the center of mass, it can be found that the operating trajectory is a circular motion, and the circle adopts a connecting line of the axis $O_2$ of the cylinder 20 and the axis $O_1$ of the rotating shaft 10 as a diameter.

When the second connecting rod $I_2$ makes a circular motion, the slider may make a reciprocating motion along the second connecting rod $I_2$. Meanwhile, the slider may make a reciprocating motion along the first connecting rod $I_1$. The first connecting rod and the second connecting rod $I_2$ always remain vertical, such that the direction of the slider making the reciprocating motion along the first connecting rod $I_1$ is vertical to the direction of the slider making the reciprocating motion along the second connecting rod $I_2$. A relative motion relationship between the first connecting rod $I_1$ and the second connecting rod $I_2$ as well as the piston 32 forms a principle of cross slider mechanism.

Under this motion method, the slider makes a circular motion, an angular speed thereof being equal to rotating speeds of the first connecting rod $I_1$ and the second connecting rod $I_2$. The operating trajectory of the slider is a circle. The circle adopts a center distance between the center of rotation of the first connecting rod $I_1$ and the center of rotation of the second connecting rod $I_2$ as a diameter.

Four alternative implementation manners will be given below. The structure of fluid machinery 100 is introduced in detail, in order to better elaborate an operating method for fluid machinery 100 through structure features.

The first implementation manner is as follows.

As shown in FIG. 2 to FIG. 19, the fluid machinery 100 includes an upper flange 50, a lower flange 60, a rotating shaft 10, a cylinder 20 and a piston component 30, wherein the cylinder 20 is sandwiched between the upper flange 50 and the lower flange 60; the axis of the rotating shaft 10 and the axis of the cylinder 20 are eccentric to each other and at a fixed eccentric distance, and the rotating shaft 10 sequentially penetrates through the upper flange 50 and the cylinder 20; the rotating shaft 10 is a one-piece structure that is penetrating through the upper flange 50 and the lower flange 60; and the piston component 30 is provided with a variable volume cavity 31, the piston component 30 being pivotally provided in the cylinder 20, and the rotating shaft 10 being drivingly connected with the piston component 30 to change the volume of the variable volume cavity 31.

Figure 3:
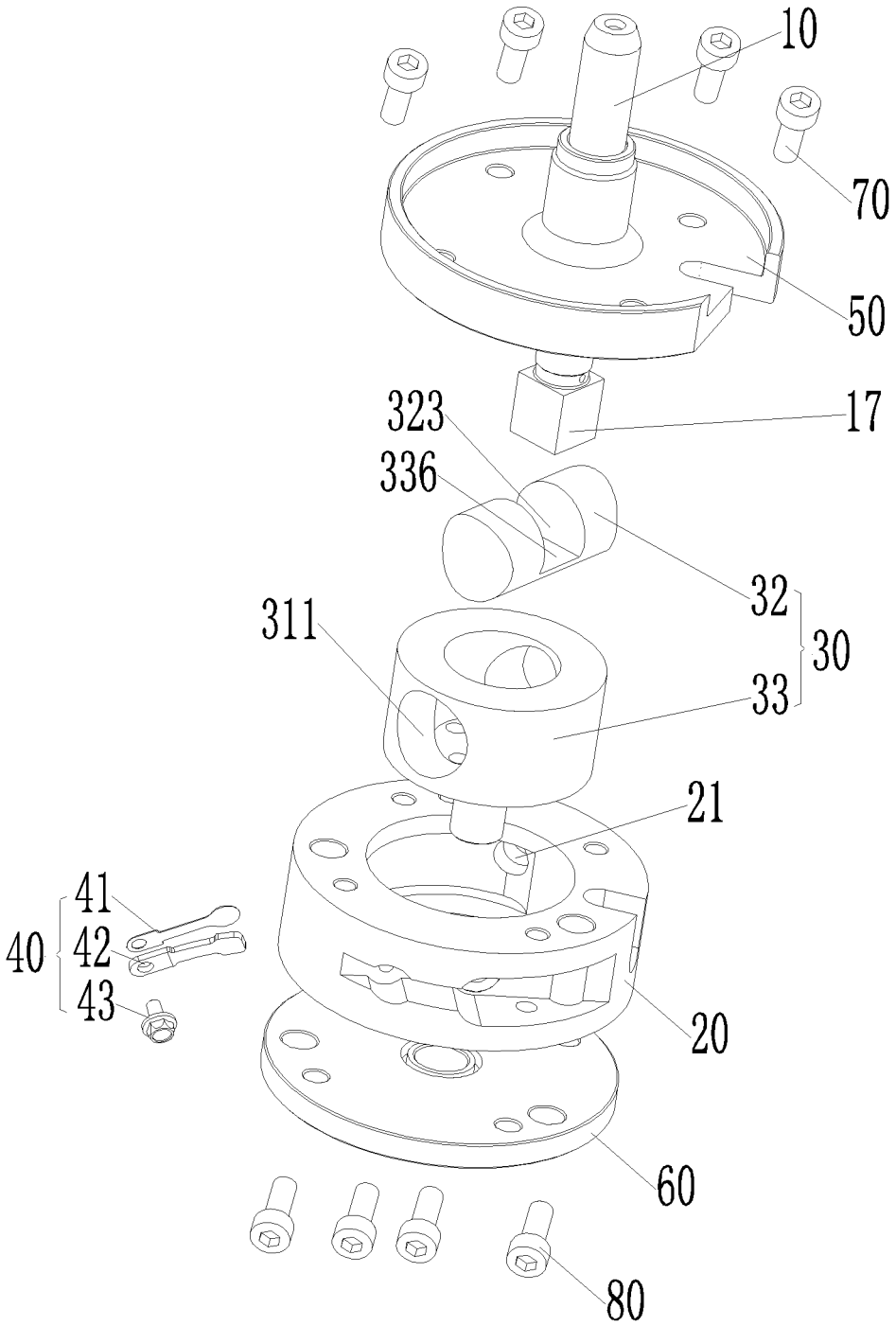
FIG. 3 shows an exploded view of a pump body component in FIG. 1.
Figure 4:
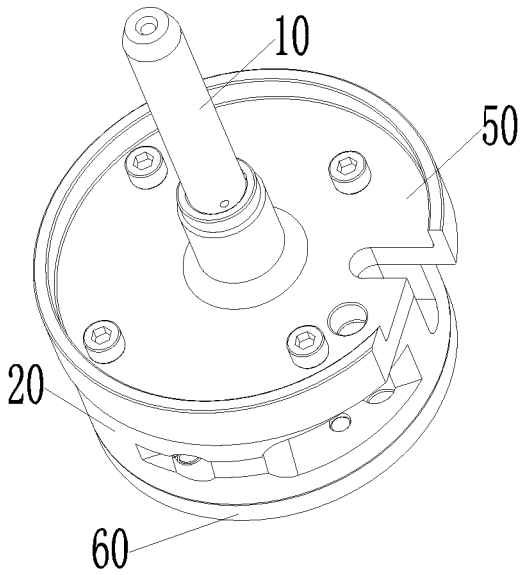
FIG. 4 shows a schematic diagram of a mounting relationship among a rotating shaft, an upper flange, a cylinder and a lower flange in FIG. 2.

Herein, the upper flange 50 is fixed to the cylinder 20 via a second fastener 70, and the lower flange 60 is fixed to the cylinder 20 via a third fastener 80 (see FIG. 3).

Alternatively, the second fastener 70 and/or the third fastener 80 are/is screws or bolts. It is important to note that the upper flange 50 is coaxial with the rotating shaft 10 and the axis of the upper flange 50 is eccentric to the axis of the cylinder 20.

Alternatively, the lower flange 60 is coaxial with the cylinder 20. A fixed eccentric distance between the cylinder 20 mounted in the above manner and the rotating shaft 10 or the upper flange 50 can be ensured, so that the piston component 30 has the characteristic of good motion stability.

In this implementation manner, the rotating shaft 10 and the piston component 30 are slidably connected, and the volume of the variable volume cavity 31 is changed along with the rotation of the rotating shaft 10. Because the rotating shaft 10 and the piston component 30 in the present disclosure are slidably connected, the motion reliability of the piston component 30 is ensured, and the problem of motion stop of the piston component 30 is effectively avoided, thereby providing a regular characteristic for changes in the volume of the variable volume cavity 31.

As shown in FIG. 3, FIG. 9 to FIG. 16, the piston component 30 includes a piston sleeve 33 and a piston 32, wherein the piston sleeve 33 is pivotally provided in the cylinder 20, the piston 32 is slidably provided in the piston sleeve 33 to form the variable volume cavity 31, and the variable volume cavity 31 is located in a sliding direction of the piston 32.

In the specific embodiment, the piston component 30 is in sliding fit with the rotating shaft 10, and along with the rotation of the rotating shaft 10, the piston component 30 has a tendency of straight motion relative to the rotating shaft 10, thereby converting rotation into local straight motion. Because the piston 32 and the piston sleeve 33 are slidably connected, under the driving of the rotating shaft 10, motion stop of the piston 32 is effectively avoided, so as to ensure the motion reliability of the piston 32, the rotating shaft 10 and the piston sleeve 33, thereby increasing the operational stability of the fluid machinery 100.

It is important to note that the rotating shaft 10 in the present disclosure does not have an eccentric structure, thereby facilitating vibration of the fluid machinery 100.

Figure 19:
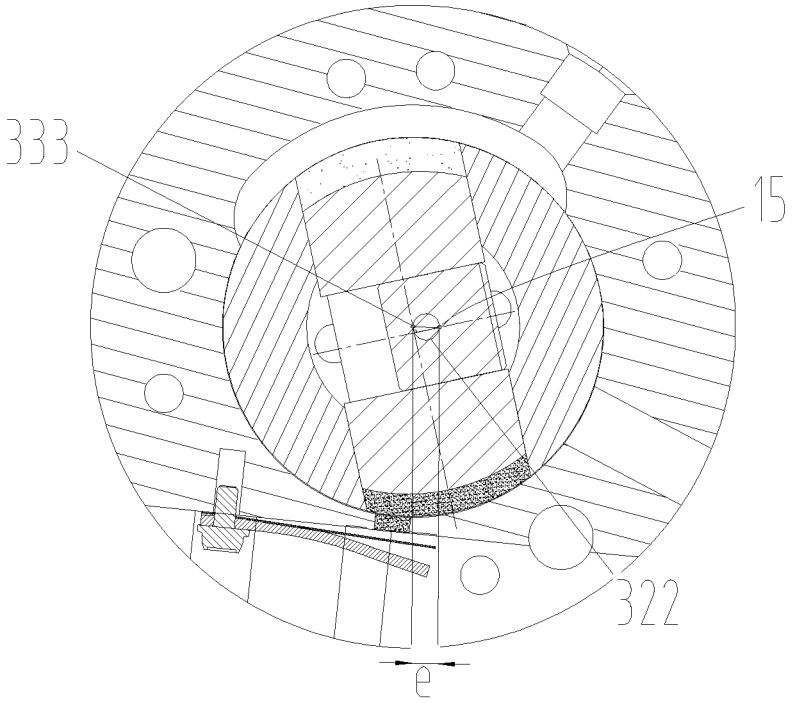
FIG. 19 shows a schematic diagram of a relationship between the axis of a rotating shaft and the axis of a piston sleeve in FIG. 2.
Figure 20:
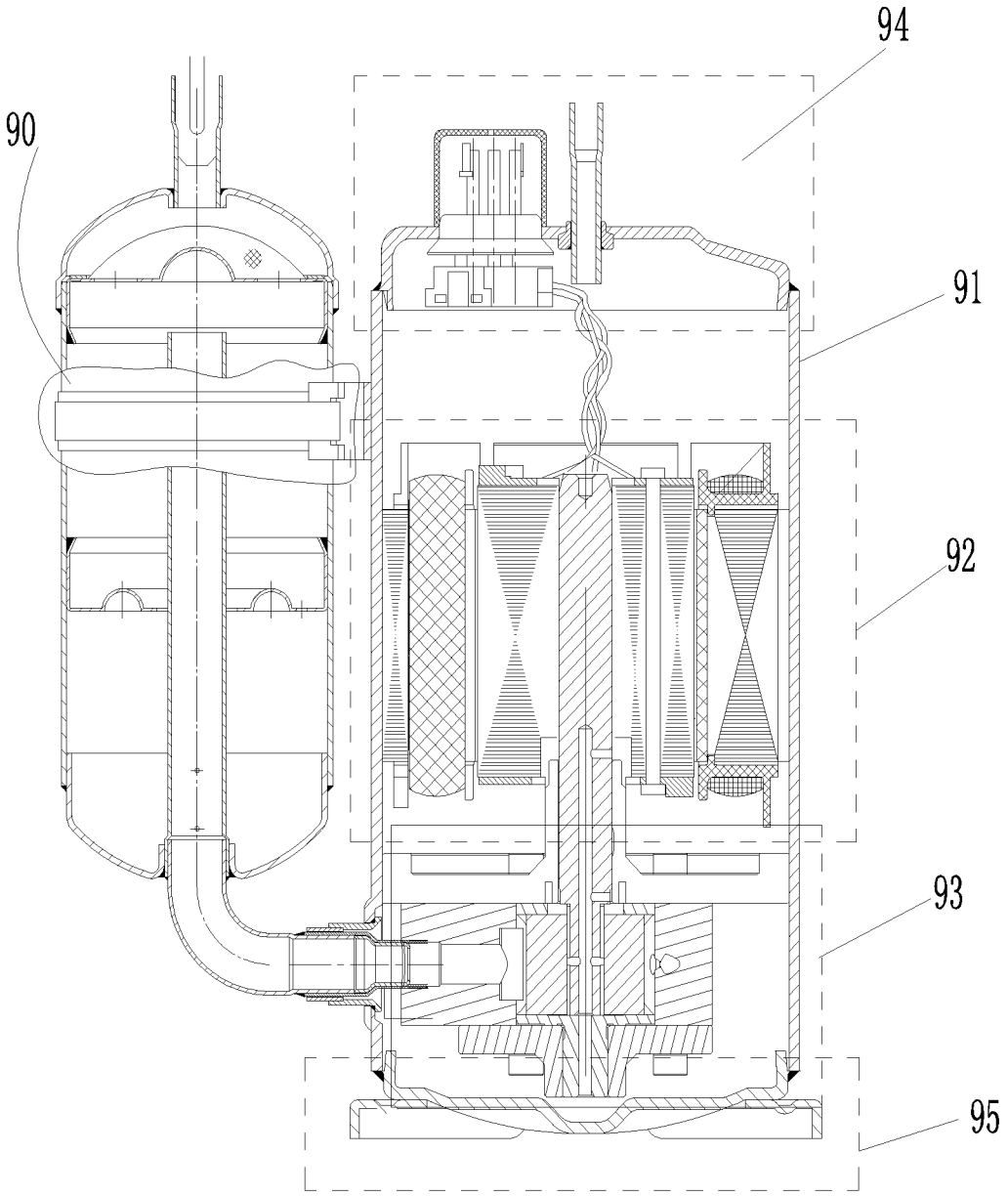
FIG. 20 shows a structure diagram of a compressor in a second preferable implementation manner.

Specifically speaking, the piston 32 slides in the piston sleeve 33 along a direction vertical to the axial direction of the rotating shaft 10 (see FIG. 19). Because a cross slider mechanism is formed among the piston component 30, the cylinder 20 and the rotating shaft 10, the motion of the piston component 30 and the cylinder 20 is stable and continuous, and a regular pattern for changes in the volume of the variable volume cavity 31 is ensured, thereby ensuring the operational stability of the fluid machinery 100, and increasing the working reliability of heat exchange equipment 200.

As shown in FIG. 3, FIG. 9 to FIG. 16, the piston 32 is provided with a sliding groove 323, the rotating shaft 10 slides in the sliding groove 323, and the piston 32 rotates along with the rotating shaft 10 under the driving of the rotating shaft 10 and slides in the piston sleeve 33 along a direction vertical to the axial direction of the rotating shaft 10 in a reciprocating manner. Because the piston 32 is allowed to make a straight motion instead of a rotational reciprocating motion relative to the rotating shaft 10, the eccentric quality is effectively reduced, and lateral forces exerted on the rotating shaft 10 and the piston 32 are reduced, thereby reducing the abrasion of the piston 32, and increasing the sealing property of the piston 32. Meanwhile, the operational stability and reliability of a pump body component 93 are ensured, the vibration risk of the fluid machinery 100 is reduced, and the structure of the fluid machinery 100 is simplified.

The sliding groove 323 is a straight sliding groove, and an extending direction of the sliding groove is vertical to the axis of the rotating shaft 10.

Alternatively, the piston 32 is columnar. Alternatively, the piston 32 is cylindrical or non-cylindrical.

Figure 9:
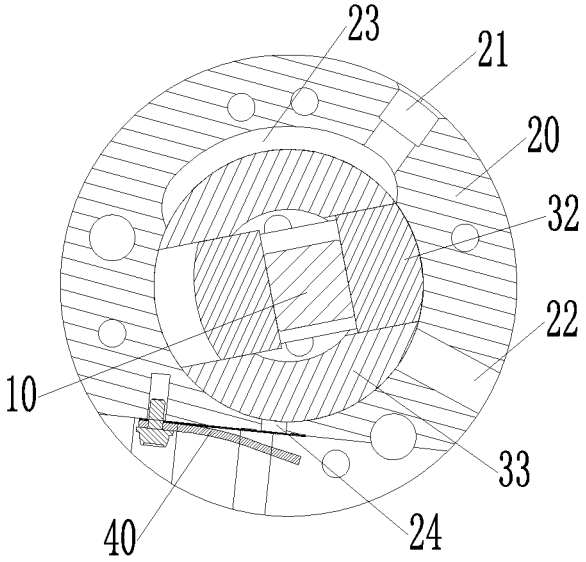
FIG. 9 shows a working state diagram of a piston prepared for suction in FIG. 2.
Figure 10:
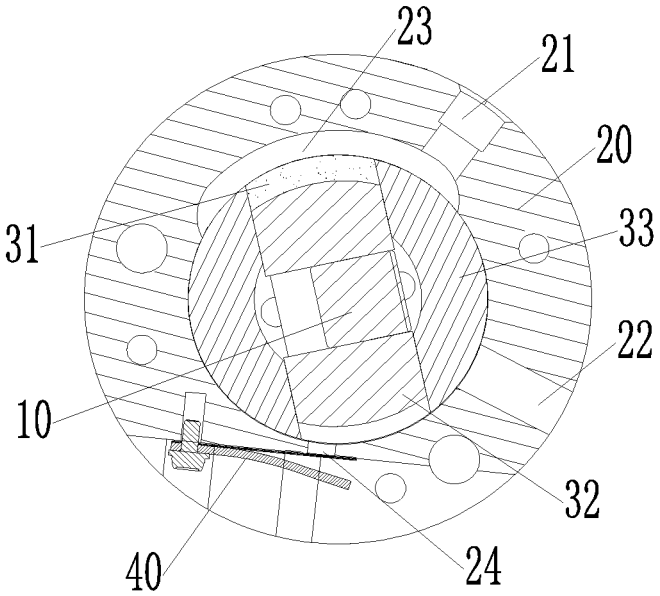
FIG. 10 shows a working state diagram of a piston during suction in FIG. 2.
Figure 11:
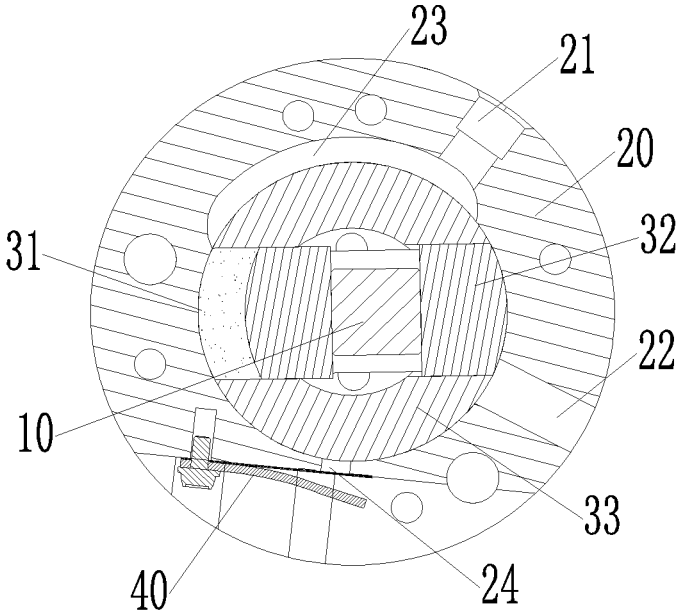
FIG. 11 shows a working state diagram of a piston completing suction in FIG. 2.
Figure 12:
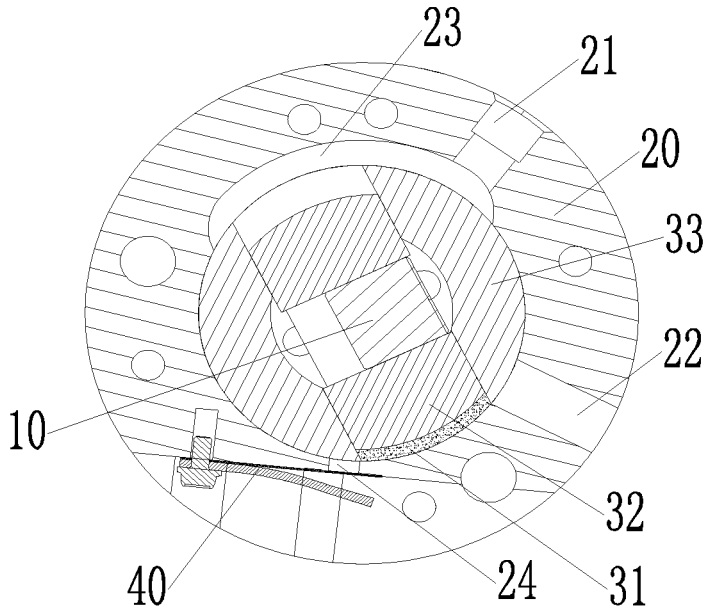
FIG. 12 shows a working state diagram of a piston during gas compression in FIG. 2.
Figure 13:
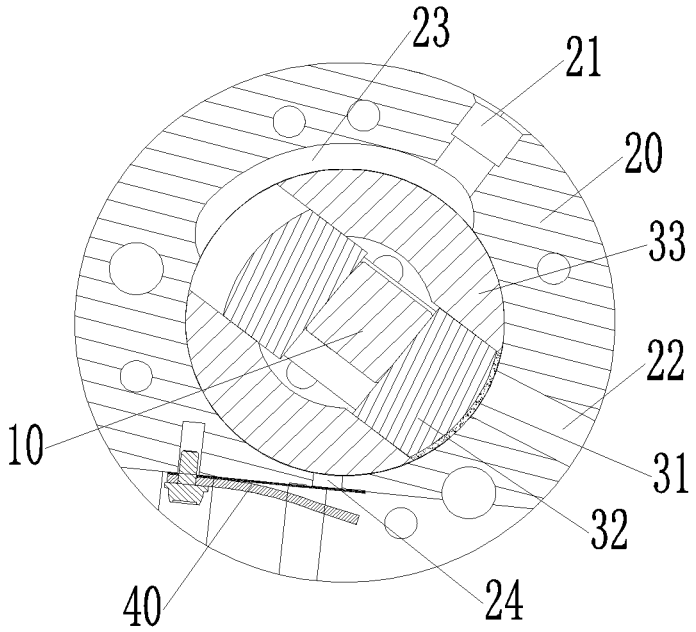
FIG. 13 shows a working state diagram of a piston during exhaust in FIG. 2.
Figure 14:
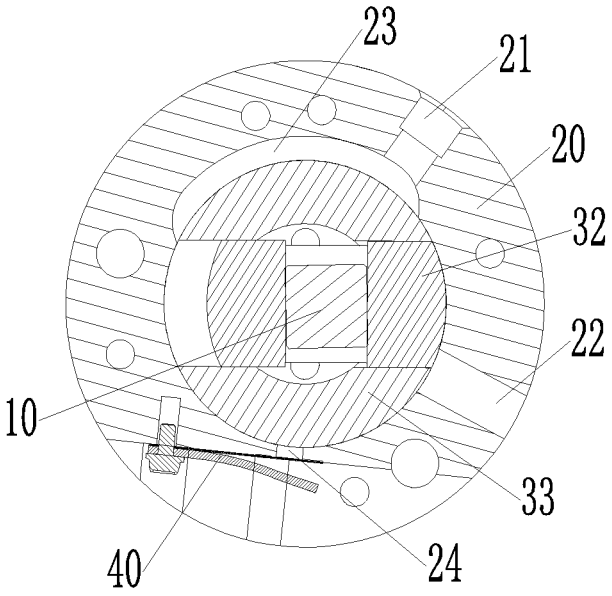
FIG. 14 shows a working state diagram of a piston which will complete exhaust in FIG. 2.

As shown in FIG. 9, the piston 32 is provided with a pair of arc-shaped surfaces arranged symmetrically about a middle vertical plane of the piston 32, the arc-shaped surfaces adaptively fit an inner surface of the cylinder 20, and the double arc curvature radius of the arc-shaped surfaces is equal to the inner diameter of the cylinder 20. Thus, zero-clearance volume can be implemented in an exhaust process. It is important to note that when the piston 32 is placed in the piston sleeve 33, the middle vertical plane of the piston 32 is an axial plane of the piston sleeve 33.

As shown in FIG. 3, a guide hole 311 running through a radial direction of the piston sleeve 33 is provided in the piston sleeve 33, and the piston 32 is slidably provided in the guide hole 311 to make a straight reciprocating motion. Because the piston 32 is slidably provided in the guide hole 311, when the piston 32 moves leftwards and rightwards in the guide hole 311, the volume of the variable volume cavity 31 can be continuously changed, thereby ensuring the suction and exhaust stability of the fluid machinery 100.

In order to prevent the piston 32 from rotating in the piston sleeve 33, an orthographic projection of the guide hole 311 at the lower flange 60 is provided with a pair of parallel straight line segments, the pair of parallel straight line segments is formed by projecting a pair of parallel inner wall surfaces of the piston sleeve 33, and the piston 32 is provided with outer profiles which are in shape adaptation to and in sliding fit with a pair of parallel inner wall surfaces of the guide hole 311. If the piston 32 and the piston sleeve 33 fit by adopting the above structure, the piston 32 can be allowed to smoothly slide in the piston sleeve 33, and a sealing effect is maintained.

Alternatively, an orthographic projection of the guide hole 311 at the lower flange 60 is provided with a pair of arc-shaped line segments, the pair of arc-shaped line segments being connected to the pair of straight line segments to form an irregular section shape.

The peripheral surface of the piston sleeve 33 is adaptive to the inner wall surface of the cylinder 20 in shape. Thus, large-area sealing is performed between the piston sleeve 33 and the cylinder 20 and between the guide hole 311 and the piston 32, and overall sealing is large-area sealing, thereby facilitating rechannelion of leakage.

Figure 17:
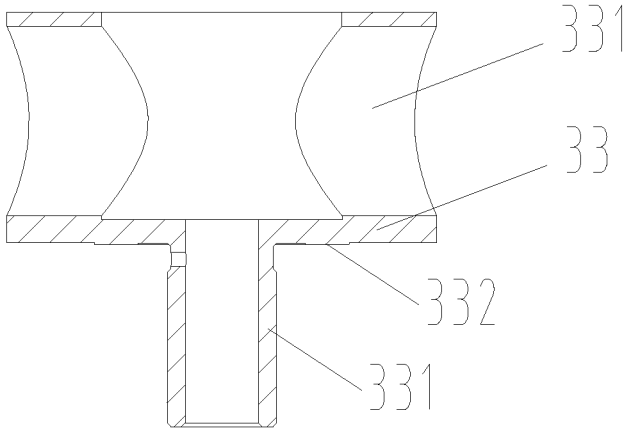
FIG. 17 shows a structure diagram of a piston sleeve in FIG. 2.

As shown in FIG. 17, the piston sleeve 33 is provided with a connecting shaft 331 protruding towards one side of the lower flange 60, the connecting shaft 331 being embedded into a connecting hole of the lower flange 60. Because the piston sleeve 33 is coaxially embedded into the lower flange 60 via the connecting shaft 331, the connecting reliability there between is ensured, thereby increasing the motion stability of the piston sleeve 33.

In a preferable implementation manner as shown in FIG. 17, a first thrust surface 332 of a side, facing the lower flange 60, of the piston sleeve 33 is in contact with the surface of the lower flange 60. Thus, the piston sleeve 33 and the lower flange 60 are reliably positioned.

Specifically speaking, the piston sleeve 33 in the present disclosure includes two coaxial cylinders with different diameters, the outer diameter of an upper half part is equal to the inner diameter of the cylinder 20, and the axis of the guide hole 311 is vertical to the axis of the cylinder 20 and fits the piston 32, wherein the shape of the guide hole 311 remains consistent with that of the piston 32. In a reciprocating motion process, gas compression is achieved. A lower end face of the upper half part is provided with concentric connecting shafts 331, is a first thrust surface, and fits the end face of the lower flange 60, thereby reducing the structure friction area. A lower half part is a hollow column, namely a short shaft, the axis of the short shaft is coaxial with that of the lower flange 60, and in a motion process, they rotate coaxially.

As shown in FIG. 3, the piston 32 is provided with a fourth thrust surface 336 for supporting the rotating shaft 10, an end face, facing one side of the lower flange 60, of the rotating shaft 10 being supported at the fourth thrust surface 336. Thus, the rotating shaft 10 is supported in the piston 32.

The rotating shaft 10 in the present disclosure includes a shaft body 16 and a connecting head 17, wherein the connecting head 17 is arranged at a first end of the shaft body 16 and connected to the piston component 30. Because the connecting head 17 is arranged, the assembly and motion reliability of the connecting head 17 and the piston 32 of the piston component 30 is ensured.

Alternatively, the shaft body 16 has a certain roughness, and increases the firmness of connection with a motor component 92.

Figure 7:
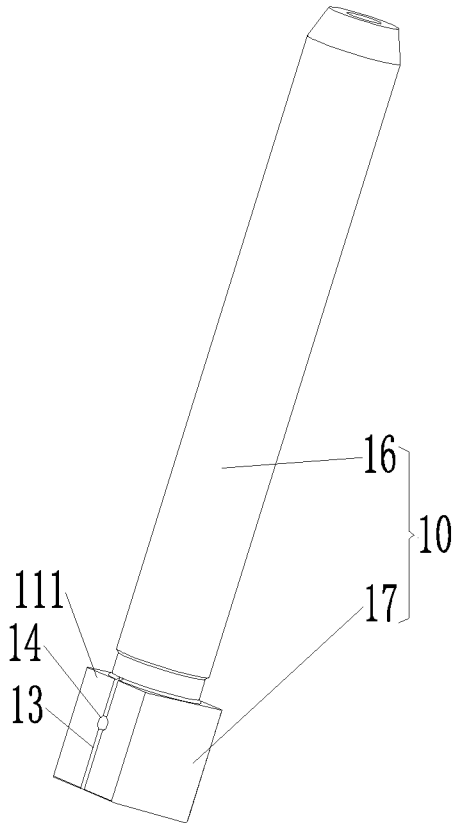
FIG. 7 shows a structure diagram of a rotating shaft in FIG. 2.

As shown in FIG. 7, the connecting head 17 is provided with two sliding fit surfaces 111 symmetrically arranged. Because the sliding fit surfaces 111 are symmetrically arranged, the two sliding fit surfaces 111 are stressed more uniformly, thereby ensuring the motion reliability of the rotating shaft 10 and the piston 32.

Figure 8:
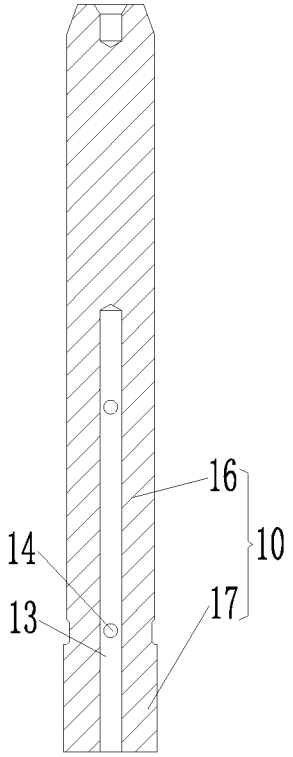
FIG. 8 shows an internal structure diagram of a rotating shaft in FIG. 7.

As shown in FIG. 7 and FIG. 8, the sliding fit surfaces 111 are parallel with an axial plane of the rotating shaft 10, and the sliding fit surfaces 111 are in sliding fit with an inner wall surface of the sliding groove 323 of the piston 32 in a direction vertical to the axial direction of the rotating shaft 10.

Alternatively, the connecting head 17 is quadrangular in a plane vertical to the axis of the shaft body 16. Because the connecting head 17 is quadrangular in a plane vertical to the axis of the shaft body 16, when fitting the sliding groove 323 of the piston 32, the effect of preventing relative rotation between the rotating shaft 10 and the piston 32 can be achieved, thereby ensuring the reliability of relative motion there between.

In order to ensure the lubricating reliability of the rotating shaft 10 and the piston component 30, the rotating shaft 10 is provided with a oil passage 13, the oil passage 13 running through the shaft body 16 and the connecting head 17.

Alternatively, at least part of the oil passage 13 is an internal oil channel of the rotating shaft 10. Because at least part of the oil passage 13 is the internal oil channel, great leakage of lubricating oil is effectively avoided, and the flowing reliability of the lubricating oil is increased.

As shown in FIG. 7 and FIG. 8, the oil passage 13 at the connecting head 17 is an external oil channel. Certainly, in order to make lubricating oil smoothly reach the piston 32, the oil passage 13 at the connecting head 17 is set as the external oil channel, so that the lubricating oil can be stuck to the surface of the sliding groove 323 of the piston 32, thereby ensuring the lubricating reliability of the rotating shaft 10 and the piston 32.

As shown in FIG. 7 and FIG. 8, the connecting head 17 is provided with an oil-through hole 14 communicated with the oil passage 13. Because the oil-through hole 14 is provided, oil can be very conveniently injected into the internal oil channel through the oil-through hole 14, thereby ensuring the lubricating and motion reliability between the rotating shaft 10 and the piston component 30. Certainly, the oil-through hole 14 may be provided at the shaft body 16.

The fluid machinery 100 as shown in this implementation manner is a compressor. The compressor includes a dispenser part 90, a housing component 91, a motor component 92, a pump body component 93, an upper cover component 94, and a lower cover and mounting plate 95, wherein the dispenser part 90 is arranged outside the housing component 91; the upper cover component 94 is assembled at the upper end of the housing component 91; the lower cover and mounting plate 95 is assembled at the lower end of the housing component 91; both the motor component 92 and the pump body component 93 are located inside the housing component 91; and the motor component 92 is arranged above the pump body component 93. The pump body component 93 of the compressor includes the above-mentioned upper flange 50, lower flange 60, cylinder 20, rotating shaft 10 and piston component 30.

Alternatively, all the parts are connected in a welding, shrinkage fit or cold pressing manner.

Figure 5:
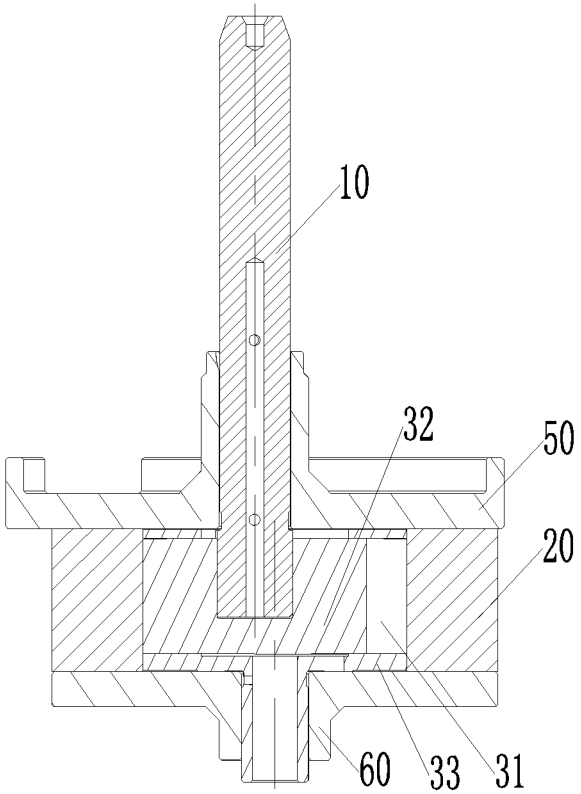
FIG. 5 shows an internal structure diagram of a part in FIG. 4.
Figure 6:
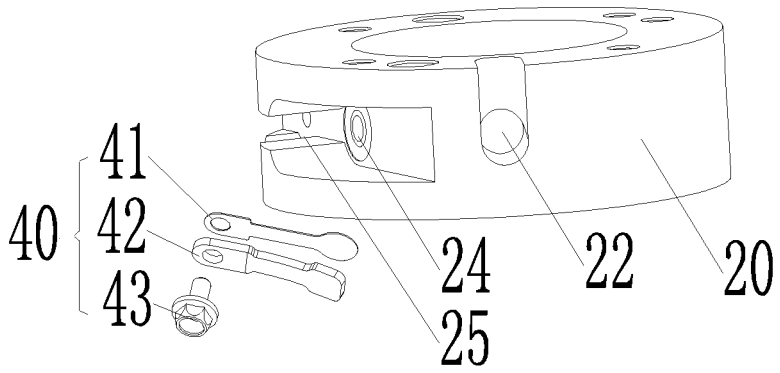
FIG. 6 shows a schematic diagram of a mounting relationship between an exhaust valve component and a cylinder in FIG. 2.

The assembly process of the whole pump body component 93 is as follows: the piston 32 is mounted in the guide hole 311, the connecting shaft 331 is mounted on the lower flange 60, the cylinder 20 and the piston sleeve 33 are coaxially mounted, the lower flange 60 is fixed to the cylinder 20, the sliding fit surfaces 111 of the rotating shaft 10 and a pair of parallel surfaces of the sliding groove 323 of the piston 32 are mounted in fit, the upper flange 50 is fixed to the upper half section of the rotating shaft 10, and the upper flange 50 is fixed to the cylinder 20 via a screw. Thus, assembly of the pump body component 93 is completed, as shown in FIG. 5.

Alternatively, there are at least two guide holes 311, the two guide holes 311 being spaced in the axial direction of the rotating shaft 10; and there are at least two pistons 32, each guide hole 311 being provided with the corresponding piston 32. At this time, the compressor is a single-cylinder multi-compression cavity compressor, and compared with a same-displacement single-cylinder roller compressor, the compressor is relatively small in torque fluctuation.

Alternatively, the compressor in the present disclosure is not provided with a suction valve, so that the suction resistance can be effectively reduced, a suction noise is reduced, and the compression efficiency of the compressor is increased.

It is important to note that in the detailed description of the embodiments, when the piston 32 completes motion for a circle, suction and exhaust will be performed twice, so that the compressor has the characteristic of high compression efficiency. Compared with the same-displacement single-cylinder roller compressor, the compressor in the present disclosure is relatively small in torque fluctuation due to division of a compression into two compressions, has small exhaust resistance during operation, and effectively eliminates an exhaust noise.

Specifically speaking, as shown in FIG. 6, FIG. 9 to FIG. 14, a cylinder wall of the cylinder 20 is provided with a compression intake port 21 and a first compression exhaust port 22, when the piston component 30 is located at an intake position, the compression intake port 21 is communicated with the variable volume cavity 31, and when the piston component 30 is located at an exhaust position, the variable volume cavity 31 is communicated with the first compression exhaust port 22.

Alternatively, an inner wall surface of the cylinder wall is provided with a compression intake buffer tank 23, the compression intake buffer tank 23 being communicated with the compression intake port 21 (see FIG. 9 to FIG. 14). In the presence of the compression intake buffer tank 23, a great amount of gas will be stored at this part, so that the variable volume cavity 31 can be full of gas to supply sufficient gas to the compressor, and in case of insufficient suction, the stored gas can be timely supplied to the variable volume cavity 31 so as to ensure the compression efficiency of the compressor.

Specifically speaking, the compression intake buffer tank 23 is provided with an arc-shaped segment in a radial plane of the cylinder 20, and the compression intake buffer tank 23 extends from the compression intake port 21 to one side where the first compression exhaust port 22 is located. An extending direction of the compression intake buffer tank 23 is opposite to a rotating direction of the piston component 30.

The operation of the compressor will be specifically introduced below.

As shown in FIG. 1, the compressor in the present disclosure adopts a principle of cross slider mechanism, wherein the piston 32 serves as a slider in the cross slider mechanism, the piston 32 and the sliding fit surface 111 of the rotating shaft 10 serve as a connecting rod $I_1$ in the cross slider mechanism, and the piston 32 and the guide hole 311 of the piston sleeve 33 serve as a connecting rod $I_2$ in the cross slider mechanism. Thus, a main structure of the principle of cross slider is formed. Moreover, the axis $O_1$ of the rotating shaft 10 and the axis $O_2$ of the cylinder 20 are eccentric to each other and at a fixed eccentric distance, and the rotating shaft and the cylinder rotate around the respective axes. When the rotating shaft 10 rotates, the piston 32 straightly slides relative to the rotating shaft 10 and the piston sleeve 33, so as to achieve gas compression. Moreover, the whole piston component 30 synchronously rotates along with the rotating shaft 10, and the piston 32 operates within a range of an eccentric distance e relative to the axis of the cylinder 20. The stroke of the piston 32 is 2e, the cross section area of the piston 32 is S, and the displacement of the compressor (namely maximum suction volume) is V=2*(2e*S).

Figure 16:
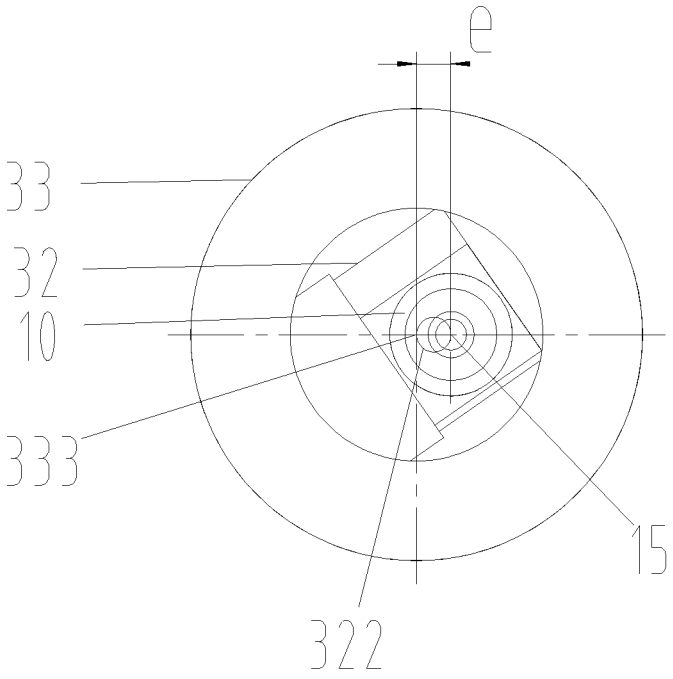
FIG. 16 shows a top view of FIG. 14.
Figure 18:
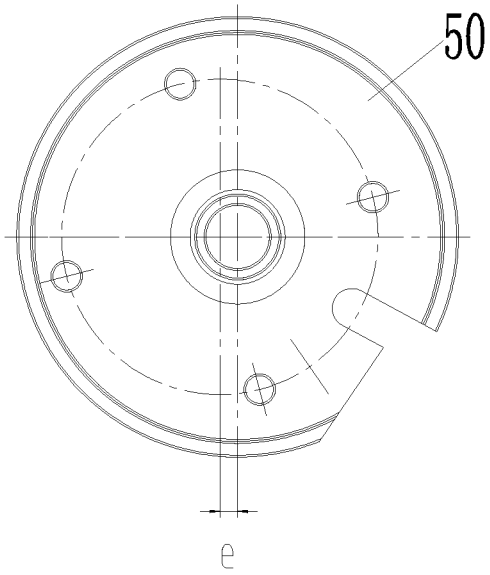
FIG. 18 shows a structure diagram of an upper flange in FIG. 2.

As shown in FIG. 16, FIG. 18 and FIG. 19, an eccentric distance e exists between a rotating shaft axis 15 and a piston sleeve axis 333, and a piston center-of-mass trajectory 322 is circular.

Specifically speaking, the motor component 92 drives the rotating shaft 10 to rotate, the sliding fit surface 111 of the rotating shaft 10 drives the piston 32 to move, and the piston 32 drives the piston sleeve 33 to rotate. In the whole motion part, the piston sleeve 33 only makes a circular motion, the piston 32 makes a reciprocating motion relative to both the rotating shaft 10 and the guide hole 311 of the piston sleeve 33, and the two reciprocating motions are vertical to each other and carried out simultaneously, so that the reciprocating motions in two directions form a motion mode of cross slider mechanism. A composite motion similar to the cross slider mechanism allows the piston 32 to make a reciprocating motion relative to the piston sleeve 33, the reciprocating motion periodically enlarging and reducing a cavity formed by the piston sleeve 33, the cylinder 20 and the piston 32. The piston 32 makes a circular motion relative to the cylinder 20, the circular motion allowing the variable volume cavity 31 formed by the piston sleeve 33, the cylinder 20 and the piston 32 to be communicated with the compression intake port 21 and the exhaust port periodically. Under the combined action of the above two relative motions, the compressor may complete the process of suction, compression and exhaust.

In addition, the compressor in the present disclosure also has the advantages of zero clearance volume and high volume efficiency.

Under other using occasions, the compressor may be used as an expander by changing the positions of a suction port and an exhaust port. That is, the exhaust port of the compressor serves as an expander suction port, high-pressure gas is charged, other pushing mechanisms rotate, and gas is exhausted from the suction port of the compressor (expander exhaust port) after expansion.

When the fluid machinery 100 is the expander, the cylinder wall of the cylinder 20 is provided with an expansion exhaust port and a first expansion intake port, when the piston component 30 is located at an intake position, the expansion exhaust port is communicated with the variable volume cavity 31, and when the piston component 30 is located at an exhaust position, the variable volume cavity 31 is communicated with the first expansion intake port. When high-pressure gas enters the variable volume cavity 31 through the first expansion intake port, the high-pressure gas pushes the piston component 30 to rotate, the piston sleeve 33 rotates to drive the piston 32 to rotate, the piston 32 is allowed to slide straightly relative to the piston sleeve 33, and the piston 32 further drives the rotating shaft 10 to rotationally move. By connecting the rotating shaft 10 to other power consumption equipment, the rotating shaft 10 may apply an output work.

Alternatively, the inner wall surface of the cylinder wall is provided with an expansion exhaust buffer tank, the expansion exhaust buffer tank being communicated with the expansion exhaust port.

Further, the expansion exhaust buffer tank is provided with an arc-shaped segment in a radial plane of the cylinder 20, and the expansion exhaust buffer tank extends from the expansion exhaust port to one side where the first expansion intake port is located. An extending direction of the expansion exhaust buffer tank is opposite to a rotating direction of the piston component 30.

The second implementation manner is as follows.

Compared with the first implementation manner, this implementation manner replaces a piston 32 having a sliding groove 323 with a piston 32 having a sliding hole 321.

The drawings of the second implementation manner are FIG. 20 to FIG. 38.

Figure 21:
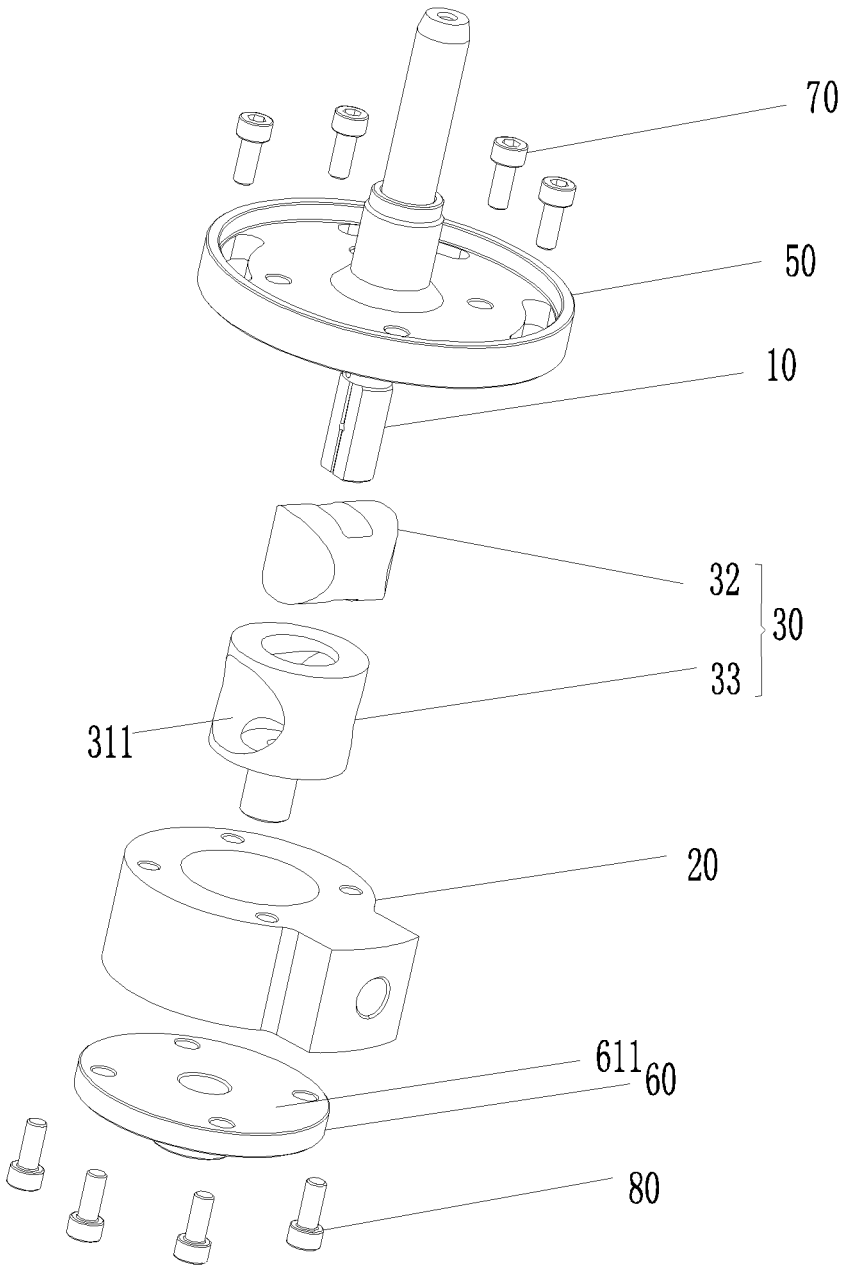
FIG. 21 shows an exploded view of a pump body component in FIG. 20.
Figure 22:
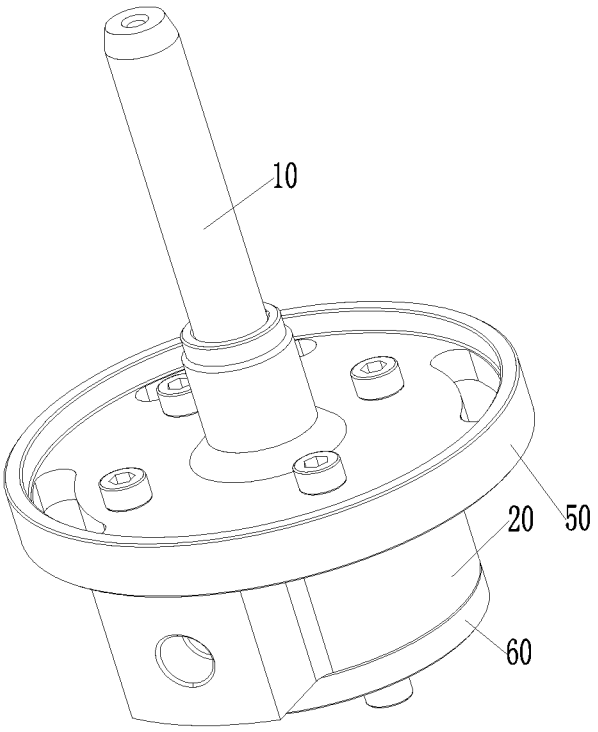
FIG. 22 shows a schematic diagram of a mounting relationship among a rotating shaft, an upper flange, a cylinder and a lower flange in FIG. 21.
Figure 37:
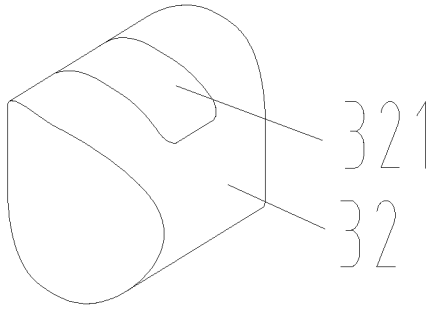
FIG. 37 shows a structure diagram of a piston in FIG. 21.
Figure 38:
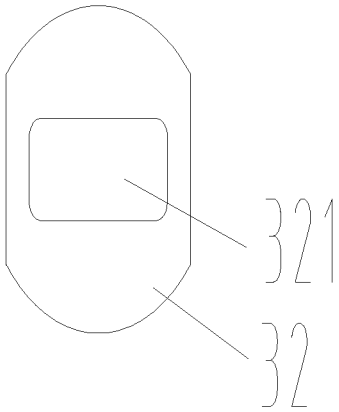
FIG. 38 shows a structure diagram of a piston in FIG. 37 from another perspective.

As shown in FIG. 21, FIG. 37 and FIG. 38, the piston 32 is provided with a sliding hole 321 running through an axial direction of the rotating shaft 10, the rotating shaft 10 penetrates through the sliding hole 321, and the piston 32 rotates along with the rotating shaft 10 under the driving of the rotating shaft 10 and slides in the piston sleeve 33 along a direction vertical to the axial direction of the rotating shaft 10 in a reciprocating manner.

Alternatively, the sliding hole 321 is an slotted hole or a waist-shaped hole.

Alternatively, the piston 32 is columnar.

Further alternatively, the piston 32 is cylindrical or non-cylindrical.

As shown in FIG. 21, FIG. 37 and FIG. 38, the piston 32 is provided with a pair of arc-shaped surfaces arranged symmetrically about a middle vertical plane of the piston 32, the arc-shaped surfaces adaptively fit an inner surface of the cylinder 20, and the double arc curvature radius of the arc-shaped surfaces is equal to the inner diameter of the cylinder 20. Thus, zero-clearance volume can be implemented in an exhaust process. It is important to note that when the piston 32 is placed in the piston sleeve 33, the middle vertical plane of the piston 32 is an axial plane of the piston sleeve 33.

Figure 33:
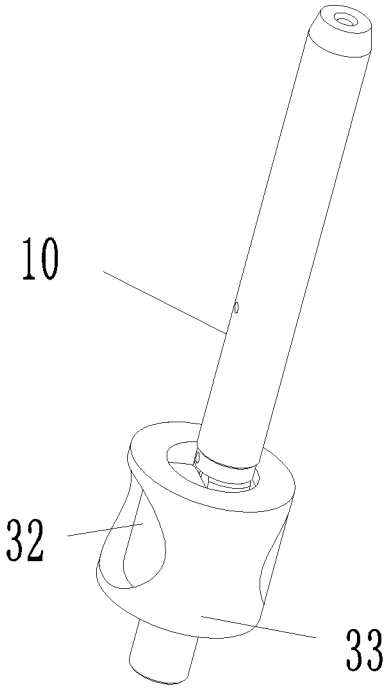
FIG. 33 shows a schematic diagram of a connecting relationship among a piston sleeve, a piston and a rotating shaft in FIG. 21.
Figure 36:
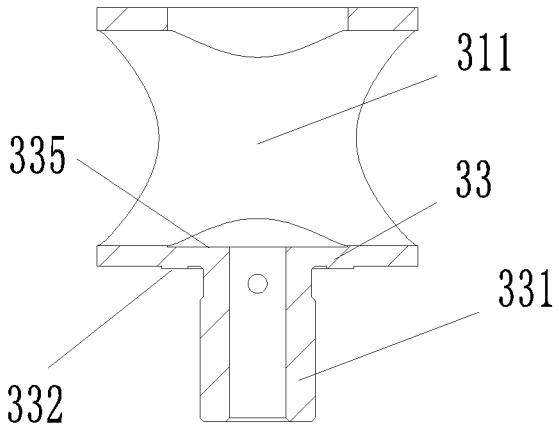
FIG. 36 shows a sectional view of a piston sleeve in FIG. 21.

In a preferable implementation manner as shown in FIG. 21, FIG. 33 and FIG. 36, a guide hole 311 running through a radial direction of the piston sleeve 33 is provided in the piston sleeve 33, and the piston 32 is slidably provided in the guide hole 311 to make a straight reciprocating motion. Because the piston 32 is slidably provided in the guide hole 311, when the piston 32 moves leftwards and rightwards in the guide hole 311, the volume of the variable volume cavity 31 can be continuously changed, thereby ensuring the suction and exhaust stability of the fluid machinery 100.

In order to prevent the piston 32 from rotating in the piston sleeve 33, an orthographic projection of the guide hole 311 at the lower flange 60 is provided with a pair of parallel straight line segments, the pair of parallel straight line segments is formed by projecting a pair of parallel inner wall surfaces of the piston sleeve 33, and the piston 32 is provided with outer profiles which are in shape adaptation to and in sliding fit with a pair of parallel inner wall surfaces of the guide hole 311. If the piston 32 and the piston sleeve 33 fit by adopting the above structure, the piston 32 can be allowed to smoothly slide in the piston sleeve 33, and a sealing effect is maintained.

Alternatively, an orthographic projection of the guide hole 311 at the lower flange 60 is provided with a pair of arc-shaped line segments, the pair of arc-shaped line segments being connected to the pair of straight line segments to form an irregular section shape.

The peripheral surface of the piston sleeve 33 is adaptive to the inner wall surface of the cylinder 20 in shape. Thus, large-area sealing is performed between the piston sleeve 33 and the cylinder 20 and between the guide hole 311 and the piston 32, and overall sealing is large-area sealing, thereby facilitating rechannelion of leakage.

As shown in FIG. 36, the piston sleeve 33 is provided with a third thrust surface 335 for supporting the rotating shaft 10, an end face, facing one side of the lower flange 60, of the rotating shaft 10 being supported at the third thrust surface 335. Thus, the rotating shaft 10 is supported in the piston sleeve 33.

Figure 25:
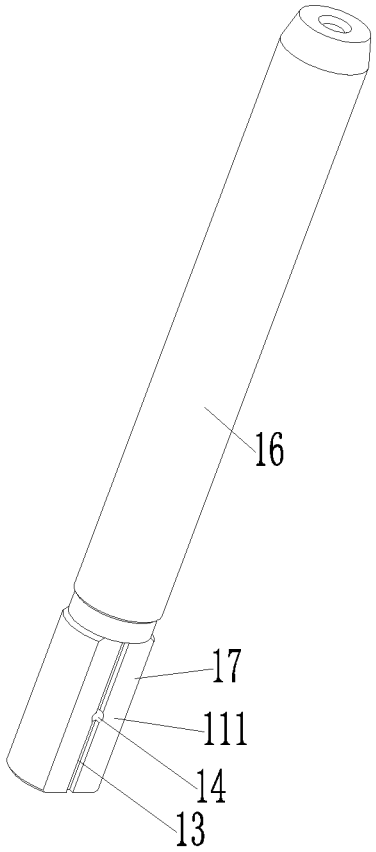
FIG. 25 shows a structure diagram of a rotating shaft in FIG. 21.

As shown in FIG. 25, the rotating shaft 10 in this implementation manner includes a shaft body 16 and a connecting head 17, wherein the connecting head 17 is arranged at a first end of the shaft body 16 and connected to the piston component 30. Because the connecting head 17 is arranged, the assembly and motion reliability of the connecting head 17 and the piston 32 of the piston component 30 is ensured.

Alternatively, the shaft body 16 has a certain roughness, and increases the firmness of connection with a motor component 92.

Figure 15:
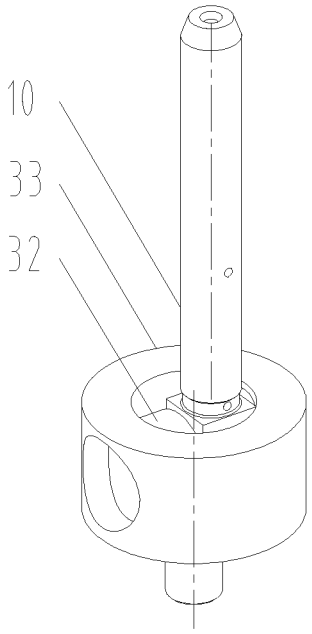
FIG. 15 shows a schematic diagram of a mounting relationship among a piston, a rotating shaft and a piston sleeve in FIG. 2.

As shown in FIG. 15, the connecting head 17 is provided with two sliding fit surfaces 111 symmetrically arranged. Because the sliding fit surfaces 111 are symmetrically arranged, the two sliding fit surfaces 111 are stressed more uniformly, thereby ensuring the motion reliability of the rotating shaft 10 and the piston 32.

As shown in FIG. 15, the sliding fit surfaces 111 are parallel with an axial plane of the rotating shaft 10, and the sliding fit surfaces 111 are in sliding fit with an inner wall surface of the sliding hole 321 of the piston 32 in a direction vertical to the axial direction of the rotating shaft 10.

Certainly, the connecting head 17 may be quadrangular in a plane vertical to the axis of the shaft body 16. Because the connecting head 17 is quadrangular in a plane vertical to the axis of the shaft body 16, when fitting the sliding hole 321 of the piston 32, the effect of preventing relative rotation between the rotating shaft 10 and the piston 32 can be achieved, thereby ensuring the reliability of relative motion there between.

In order to ensure the lubricating reliability of the rotating shaft 10 and the piston component 30, the rotating shaft 10 is provided with a oil passage 13, the oil passage 13 running through the shaft body 16 and the connecting head 17.

Figure 26:
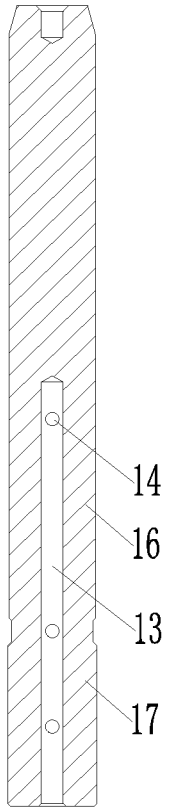
FIG. 26 shows an internal structure diagram of a rotating shaft in FIG. 25.
Figure 27:
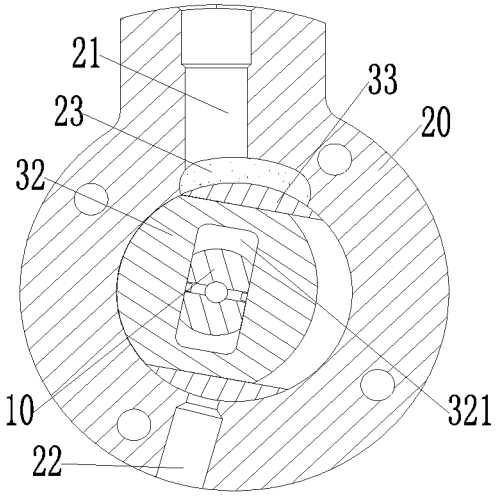
FIG. 27 shows a working state diagram of a piston prepared for suction in FIG. 21.
Figure 28:
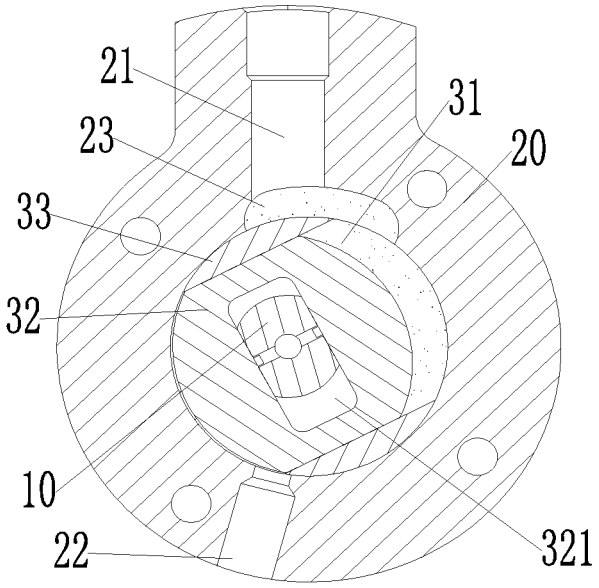
FIG. 28 shows a working state diagram of a piston during suction in FIG. 21.
Figure 29:
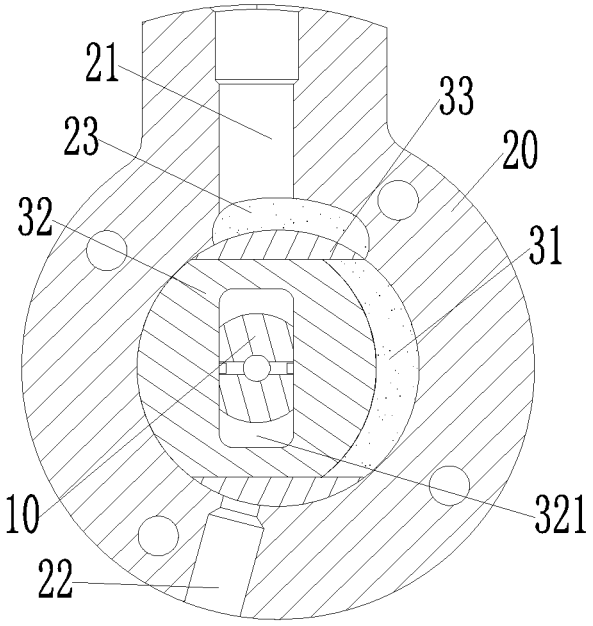
FIG. 29 shows a working state diagram of a piston completing suction in FIG. 21.
Figure 30:
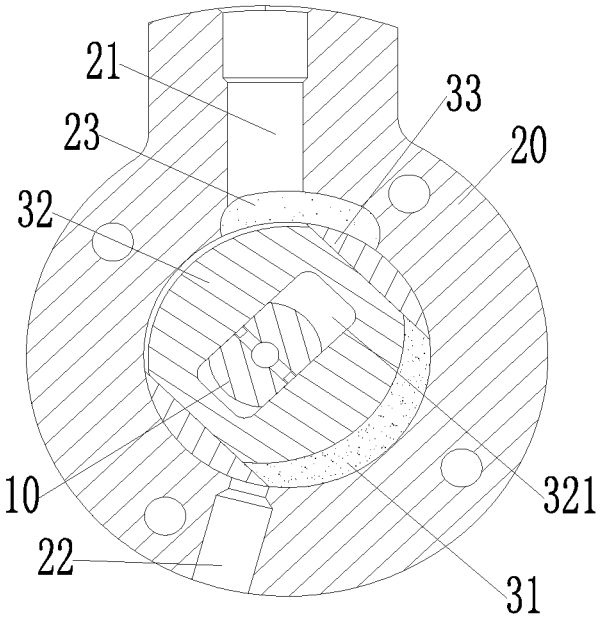
FIG. 30 shows a working state diagram of a piston during gas compression in FIG. 21.
Figure 31:
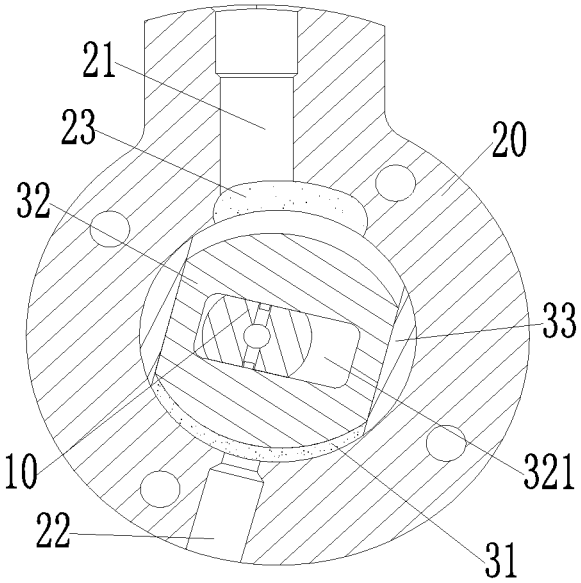
FIG. 31 shows a working state diagram of a piston during exhaust in FIG. 21.
Figure 32:
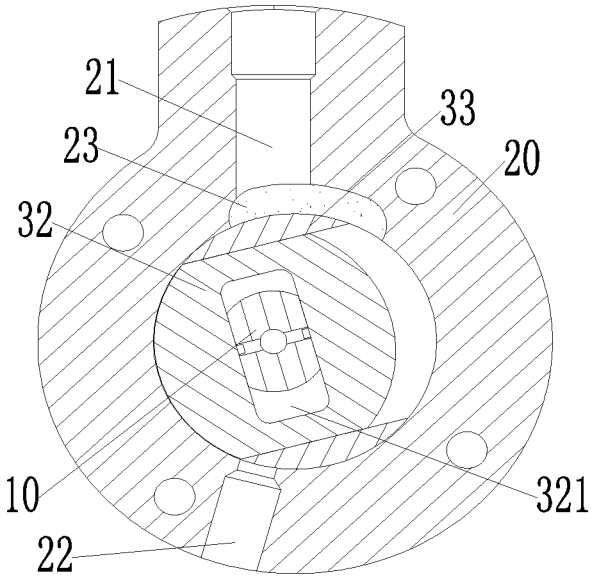
FIG. 32 shows a working state diagram of a piston which will complete exhaust in FIG. 21.

As shown in FIG. 25 and FIG. 26, at least part of the oil passage 13 is an internal oil channel of the rotating shaft 10. Because at least part of the oil passage 13 is the internal oil channel, great leakage of lubricating oil is effectively avoided, and the flowing reliability of the lubricating oil is increased. The oil passage 13 at the connecting head 17 is an external oil channel. Certainly, in order to make lubricating oil smoothly reach the piston 32, the oil passage 13 at the connecting head 17 is set as the external oil channel, so that the lubricating oil can be stuck to the surface of the sliding hole 321 of the piston 32, thereby ensuring the lubricating reliability of the rotating shaft 10 and the piston 32. Moreover, the external oil channel and the internal oil channel are communicated via an oil-through hole 14. Because the oil-through hole 14 is provided, oil can be very conveniently injected into the internal oil channel through the oil-through hole 14, thereby ensuring the lubricating and motion reliability between the rotating shaft 10 and the piston component 30.

Figure 23:
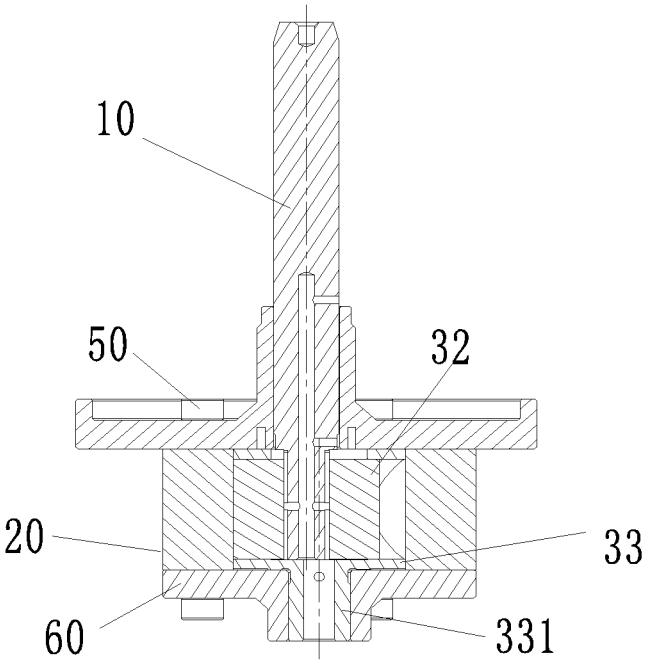
FIG. 23 shows an internal structure diagram of a part in FIG. 22.
Figure 24:
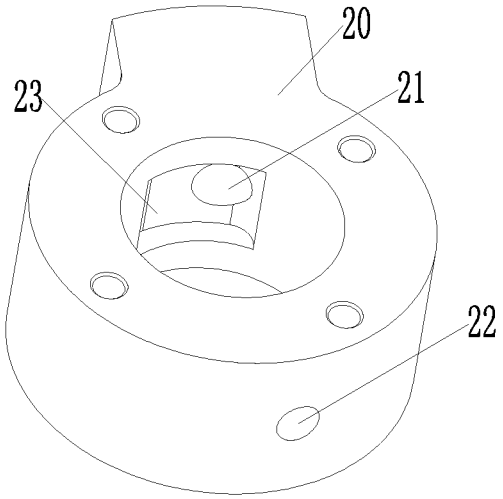
FIG. 24 shows a structure diagram of a cylinder in FIG. 21.

The assembly process of the whole pump body component 93 is as follows: the piston 32 is mounted in the guide hole 311, the connecting shaft 331 is mounted on the lower flange 60, the cylinder 20 and the piston sleeve 33 are coaxially mounted, the lower flange 60 is fixed to the cylinder 20, the sliding fit surfaces 111 of the rotating shaft 10 and a pair of parallel surfaces of the sliding hole 321 of the piston 32 are mounted in fit, the upper flange 50 is fixed to the upper half section of the rotating shaft 10, the upper flange 50 is fixed to the cylinder 20 via a screw, and the rotating shaft 10 is in contact with the third thrust surface 335. Thus, assembly of the pump body component 93 is completed, as shown in FIG. 23.

It is important to note that in the detailed description of the embodiments, when the piston 32 completes motion for a circle, suction and exhaust will be performed twice, so that the compressor has the characteristic of high compression efficiency. Compared with the same-displacement single-cylinder roller compressor, the compressor in the present disclosure is relatively small in torque fluctuation due to division of a compression into two compressions, has small exhaust resistance during operation, and effectively eliminates an exhaust noise.

Specifically speaking, as shown in FIG. 27 to FIG. 32, a cylinder wall of the cylinder 20 is provided with a compression intake port 21 and a first compression exhaust port 22, when the piston component 30 is located at an intake position, the compression intake port 21 is communicated with the variable volume cavity 31, and when the piston component 30 is located at an exhaust position, the variable volume cavity 31 is communicated with the first compression exhaust port 22.

An inner wall surface of the cylinder wall is provided with a compression intake buffer tank 23, the compression intake buffer tank 23 being communicated with the compression intake port 21 (see FIG. 27 to FIG. 32). In the presence of the compression intake buffer tank 23, a great amount of gas will be stored at this part, so that the variable volume cavity 31 can be full of gas to supply sufficient gas to the compressor, and in case of insufficient suction, the stored gas can be timely supplied to the variable volume cavity 31 so as to ensure the compression efficiency of the compressor.

Specifically speaking, the compression intake buffer tank 23 is provided with an arc-shaped segment in a radial plane of the cylinder 20, and the compression intake buffer tank 23 extends from the compression intake port 21 to one side where the first compression exhaust port 22 is located. An extending direction of the compression intake buffer tank 23 is opposite to a rotating direction of the piston component 30.

The operation of the compressor will be specifically introduced below.

As shown in FIG. 1, the compressor in the present disclosure adopts a principle of cross slider mechanism, wherein the piston 32 serves as a slider in the cross slider mechanism, the piston 32 and the sliding fit surface 111 of the rotating shaft 10 serve as a connecting rod $I_1$ in the cross slider mechanism, and the piston 32 and the guide hole 311 of the piston sleeve 33 serve as a connecting rod $I_2$ in the cross slider mechanism. Thus, a main structure of the principle of cross slider is formed. Moreover, the axis $O_1$ of the rotating shaft 10 and the axis $O_2$ of the cylinder 20 are eccentric to each other and at a fixed eccentric distance, and the rotating shaft and the cylinder rotate around the respective axes. When the rotating shaft 10 rotates, the piston 32 straightly slides relative to the rotating shaft 10 and the piston sleeve 33, so as to achieve gas compression. Moreover, the whole piston component 30 synchronously rotates along with the rotating shaft 10, and the piston 32 operates within a range of an eccentric distance e relative to the axis of the cylinder 20. The stroke of the piston 32 is 2e, the cross section area of the piston 32 is S, and the displacement of the compressor (namely maximum suction volume) is V=2*(2e*S).

It is important to note that because the rotating shaft 10 is supported by the upper flange 50 and the piston sleeve 33, a cantilever supporting structure is formed.

Figure 34:
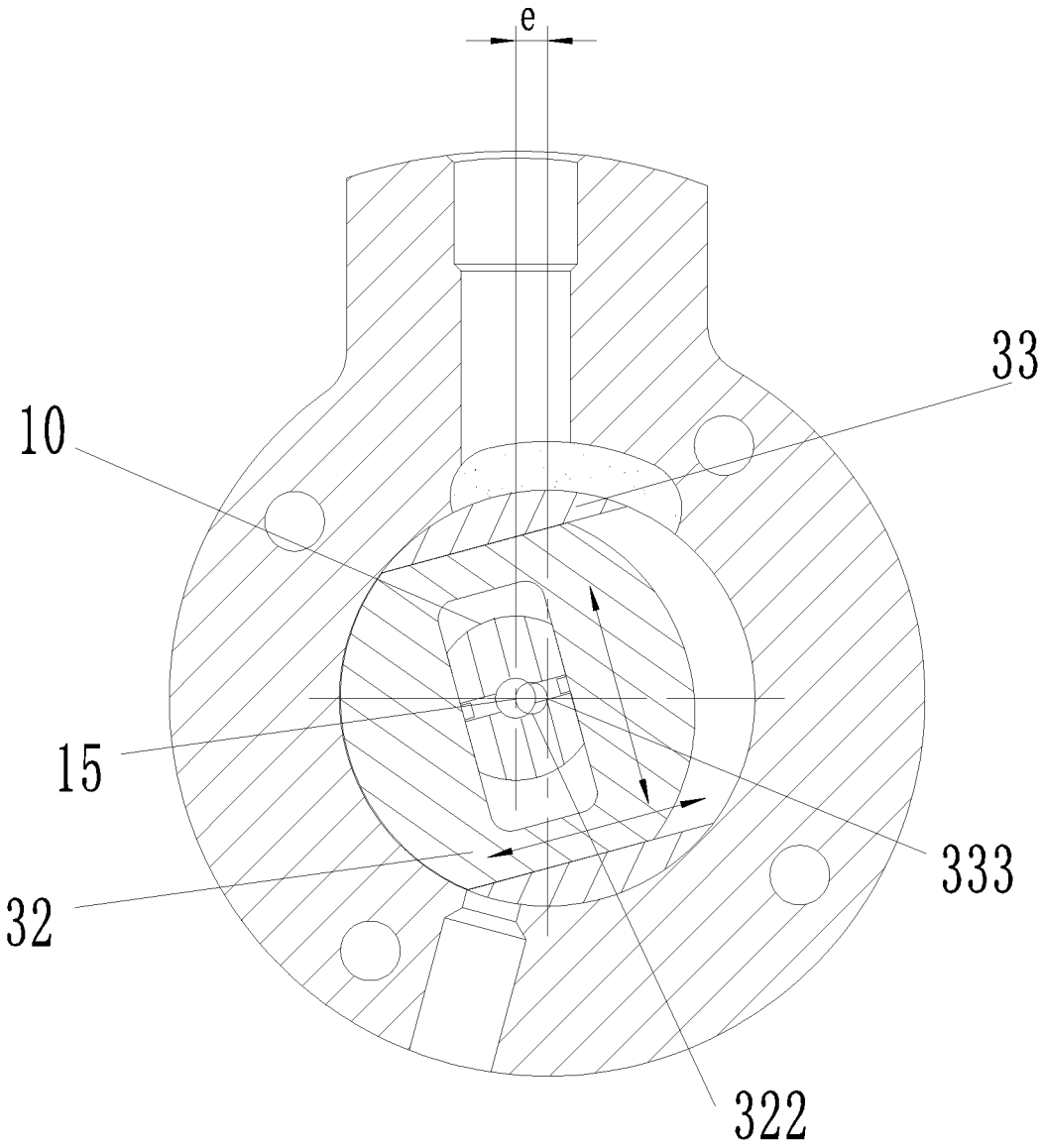
FIG. 34 shows a schematic diagram of a motion relationship between a piston and a piston sleeve in FIG. 20.
Figure 35:
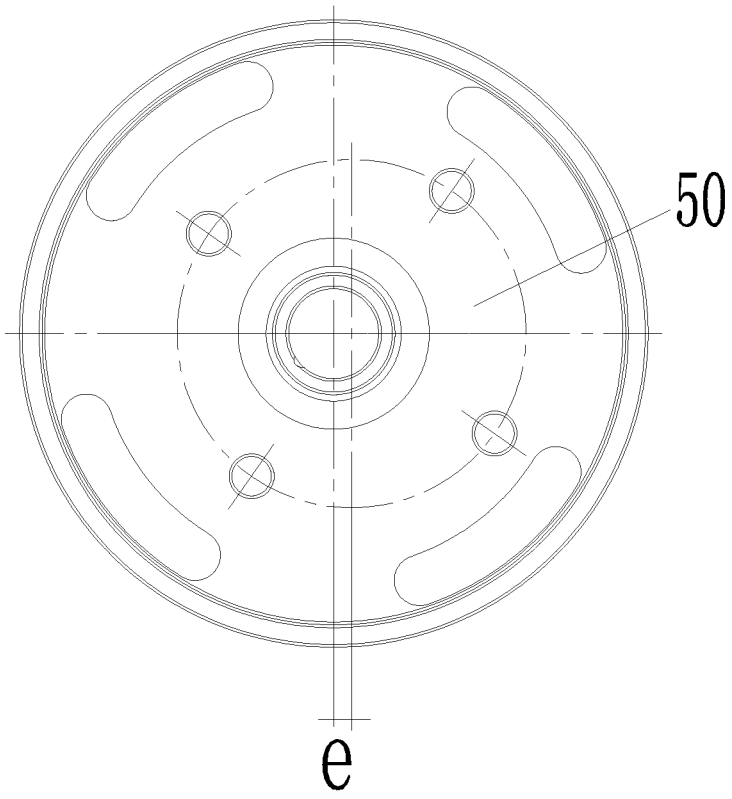
FIG. 35 shows a structure diagram of an upper flange in FIG. 21.

As shown in FIG. 34 and FIG. 35, an eccentric distance e exists between a rotating shaft axis 15 and a piston sleeve axis 333, and a piston center-of-mass trajectory 322 is circular.

Specifically speaking, the motor component 92 drives the rotating shaft 10 to rotate, the sliding fit surface 111 of the rotating shaft 10 drives the piston 32 to move, and the piston 32 drives the piston sleeve 33 to rotate. In the whole motion part, the piston sleeve 33 only makes a circular motion, the piston 32 makes a reciprocating motion relative to both the rotating shaft 10 and the guide hole 311 of the piston sleeve 33, and the two reciprocating motions are vertical to each other and carried out simultaneously, so that the reciprocating motions in two directions form a motion mode of cross slider mechanism. A composite motion similar to the cross slider mechanism allows the piston 32 to make a reciprocating motion relative to the piston sleeve 33, the reciprocating motion periodically enlarging and reducing a cavity formed by the piston sleeve 33, the cylinder 20 and the piston 32. The piston 32 makes a circular motion relative to the cylinder 20, the circular motion allowing the variable volume cavity 31 formed by the piston sleeve 33, the cylinder 20 and the piston 32 to be communicated with the compression intake port 21 and the exhaust port periodically. Under the combined action of the above two relative motions, the compressor may complete the process of suction, compression and exhaust.

In addition, the compressor in this implementation manner also has the advantages of zero clearance volume and high volume efficiency.

Under other using occasions, the compressor may be used as an expander by changing the positions of a suction port and an exhaust port. That is, the exhaust port of the compressor serves as an expander suction port, high-pressure gas is charged, other pushing mechanisms rotate, and gas is exhausted from the suction port of the compressor (expander exhaust port) after expansion.

When the fluid machinery 100 is the expander, the cylinder wall of the cylinder 20 is provided with an expansion exhaust port and a first expansion intake port, when the piston component 30 is located at an intake position, the expansion exhaust port is communicated with the variable volume cavity 31, and when the piston component 30 is located at an exhaust position, the variable volume cavity 31 is communicated with the first expansion intake port. When high-pressure gas enters the variable volume cavity 31 through the first expansion intake port, the high-pressure gas pushes the piston component 30 to rotate, the piston sleeve 33 rotates to drive the piston 32 to rotate, the piston 32 is allowed to slide straightly relative to the piston sleeve 33, and the piston 32 further drives the rotating shaft 10 to rotationally move. By connecting the rotating shaft 10 to other power consumption equipment, the rotating shaft 10 may apply an output work.

Alternatively, the inner wall surface of the cylinder wall is provided with an expansion exhaust buffer tank, the expansion exhaust buffer tank being communicated with the expansion exhaust port.

Further, the expansion exhaust buffer tank is provided with an arc-shaped segment in a radial plane of the cylinder 20, and the expansion exhaust buffer tank extends from the expansion exhaust port to one side where the first expansion intake port is located. An extending direction of the expansion exhaust buffer tank is opposite to a rotating direction of the piston component 30.

The third implementation manner is as follows.

Compared with the first implementation manner, this implementation manner replaces a piston 32 having a sliding groove 323 with a piston 32 having a sliding hole 321. In addition, parts such as an exhaust valve component 40, a second compression exhaust port 24, a supporting plate 61 and a limiting plate 26 are also added.

As shown in FIG. 39 to FIG. 59, the fluid machinery 100 includes an upper flange 50, a lower flange 60, a cylinder 20, a rotating shaft 10 and a piston component 30, wherein the cylinder 20 is sandwiched between the upper flange 50 and the lower flange 60; the axis of the rotating shaft 10 and the axis of the cylinder 20 are eccentric to each other and at a fixed eccentric distance; the rotating shaft 10 sequentially penetrates through the upper flange 50, the cylinder 20 and the lower flange 60; the piston component 30 is provided with a variable volume cavity 31; the piston component 30 is pivotally provided in the cylinder 20; and the rotating shaft 10 is drivingly connected with the piston component 30 to change the volume of the variable volume cavity 31. Herein, the upper flange 50 is fixed to the cylinder 20 via a second fastener 70, and the lower flange 60 is fixed to the cylinder 20 via a third fastener 80.

Alternatively, the second fastener 70 and/or the third fastener 80 are/is screws or bolts.

It is important to note that the axis of the upper flange 50 and the axis of the lower flange 60 are coaxial with the axis of the rotating shaft 10, and the axis of the upper flange 50 and the axis of the lower flange 60 are eccentric to the axis of the cylinder 20. A fixed eccentric distance between the cylinder 20 mounted in the above manner and the rotating shaft 10 or the upper flange 50 can be ensured, so that the piston component 30 has the characteristic of good motion stability.

The rotating shaft 10 and the piston component 30 in the present disclosure are slidably connected, and the volume of the variable volume cavity 31 is changed along with the rotation of the rotating shaft 10. Because the rotating shaft 10 and the piston component 30 in the present disclosure are slidably connected, the motion reliability of the piston component 30 is ensured, and the problem of motion stop of the piston component 30 is effectively avoided, thereby providing a regular characteristic for changes in the volume of the variable volume cavity 31.

As shown in FIG. 40, FIG. 46 to FIG. 52, the piston component 30 includes a piston sleeve 33 and a piston 32, wherein the piston sleeve 33 is pivotally provided in the cylinder 20, the piston 32 is slidably provided in the piston sleeve 33 to form the variable volume cavity 31, and the variable volume cavity 31 is located in a sliding direction of the piston 32.

In the specific embodiment, the piston component 30 is in sliding fit with the rotating shaft 10, and along with the rotation of the rotating shaft 10, the piston component 30 has a tendency of straight motion relative to the rotating shaft 10, thereby converting rotation into local straight motion. Because the piston 32 and the piston sleeve 33 are slidably connected, under the driving of the rotating shaft 10, motion stop of the piston 32 is effectively avoided, so as to ensure the motion reliability of the piston 32, the rotating shaft 10 and the piston sleeve 33, thereby increasing the operational stability of the fluid machinery 100.

It is important to note that the rotating shaft 10 in the present disclosure does not have an eccentric structure, thereby facilitating vibration of the fluid machinery 100.

Specifically speaking, the piston 32 slides in the piston sleeve 33 along a direction vertical to the axial direction of the rotating shaft 10 (see FIG. 46 to FIG. 52). Because a cross slider mechanism is formed among the piston component 30, the cylinder 20 and the rotating shaft 10, the motion of the piston component 30 and the cylinder 20 is stable and continuous, and a regular pattern for changes in the volume of the variable volume cavity 31 is ensured, thereby ensuring the operational stability of the fluid machinery 100, and increasing the working reliability of heat exchange equipment 200.

The piston 32 in the present disclosure is provided with a sliding hole 321 running through an axial direction of the rotating shaft 10, the rotating shaft 10 penetrates through the sliding hole 321, and the piston 32 rotates along with the rotating shaft 10 under the driving of the rotating shaft 10 and slides in the piston sleeve 33 along a direction vertical to the axial direction of the rotating shaft 10 in a reciprocating manner (see FIG. 46 to FIG. 52). Because the piston 32 is allowed to make a straight motion instead of a rotational reciprocating motion relative to the rotating shaft 10, the eccentric quality is effectively reduced, and lateral forces exerted on the rotating shaft 10 and the piston 32 are reduced, thereby reducing the abrasion of the piston 32, and increasing the sealing property of the piston 32. Meanwhile, the operational stability and reliability of a pump body component 93 are ensured, the vibration risk of the fluid machinery 100 is reduced, and the structure of the fluid machinery 100 is simplified.

Alternatively, the sliding hole 321 is an slotted hole or a waist-shaped hole.

The piston 32 in the present disclosure is columnar. Alternatively, the piston 32 is cylindrical or non-cylindrical.

Figure 54:
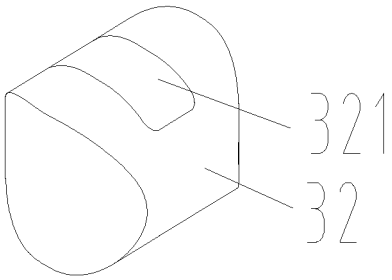
FIG. 54 shows a structure diagram of a piston in FIG. 40.
Figure 55:
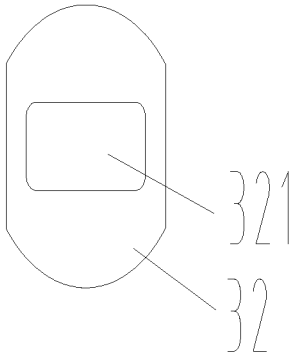
FIG. 55 shows a structure diagram of a piston in FIG. 54 from another perspective.

As shown in FIG. 54 and FIG. 55, the piston 32 is provided with a pair of arc-shaped surfaces arranged symmetrically about a middle vertical plane of the piston 32, the arc-shaped surfaces adaptively fit an inner surface of the cylinder 20, and the double arc curvature radius of the arc-shaped surfaces is equal to the inner diameter of the cylinder 20. Thus, zero-clearance volume can be implemented in an exhaust process. It is important to note that when the piston 32 is placed in the piston sleeve 33, the middle vertical plane of the piston 32 is an axial plane of the piston sleeve 33.

Figure 40:
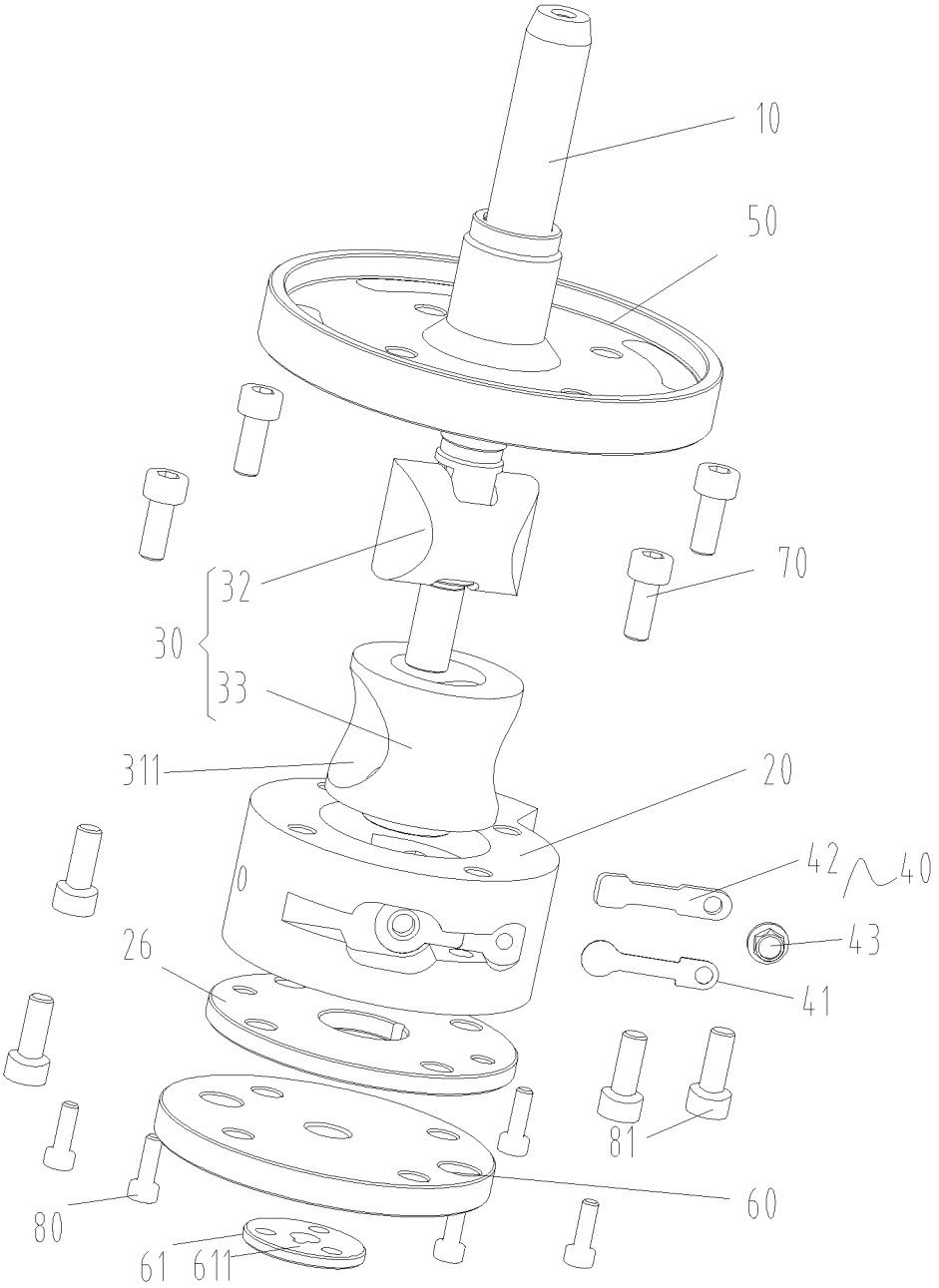
FIG. 40 shows an exploded view of a pump body component in FIG. 39.
Figure 56:
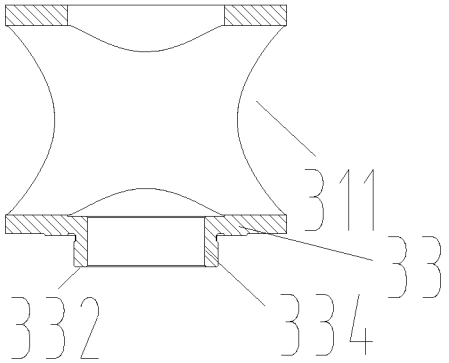
FIG. 56 shows a sectional view of a piston sleeve in FIG. 40.
Figure 57:
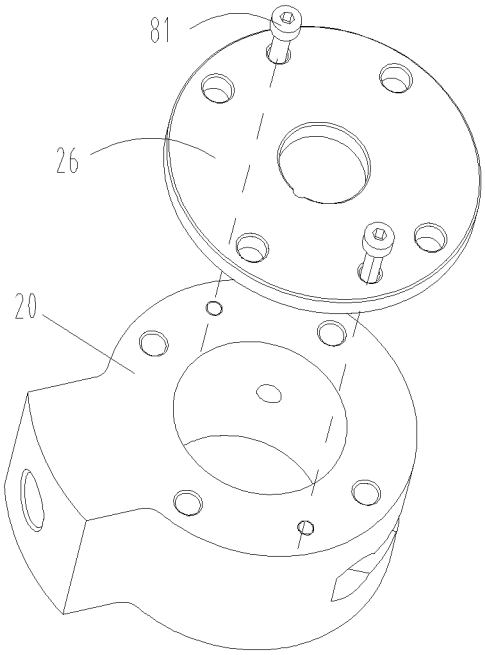
FIG. 57 shows a schematic diagram of a connecting relationship between a limiting plate and a cylinder in FIG. 40.
Figure 58:
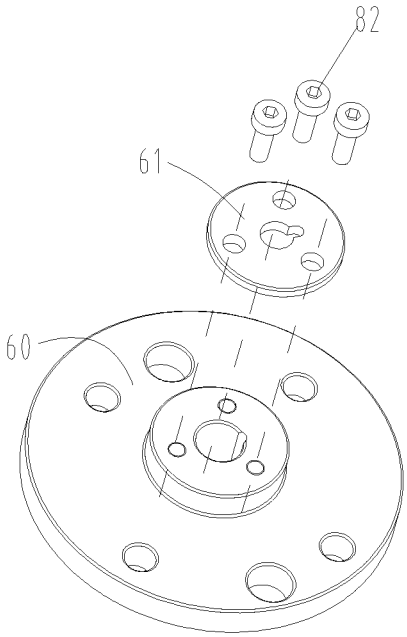
FIG. 58 shows a schematic diagram of a connecting relationship between a supporting plate and a lower flange in FIG. 40.
Figure 59:
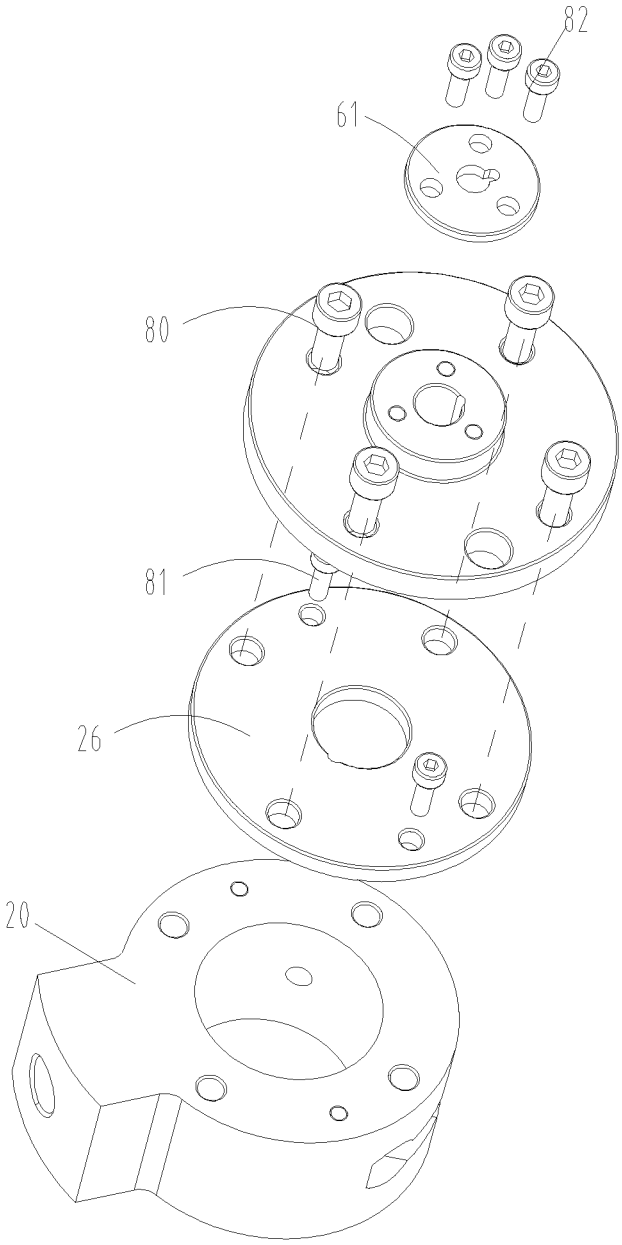
FIG. 59 shows a schematic diagram of a connecting relationship among a cylinder, a limiting plate, a lower flange and a supporting plate in FIG. 40.

In a preferable implementation manner as shown in FIG. 40 and FIG. 56, a guide hole 311 running through a radial direction of the piston sleeve 33 is provided in the piston sleeve 33, and the piston 32 is slidably provided in the guide hole 311 to make a straight reciprocating motion. Because the piston 32 is slidably provided in the guide hole 311, when the piston 32 moves leftwards and rightwards in the guide hole 311, the volume of the variable volume cavity 31 can be continuously changed, thereby ensuring the suction and exhaust stability of the fluid machinery 100.

In order to prevent the piston 32 from rotating in the piston sleeve 33, an orthographic projection of the guide hole 311 at the lower flange 60 is provided with a pair of parallel straight line segments, the pair of parallel straight line segments is formed by projecting a pair of parallel inner wall surfaces of the piston sleeve 33, and the piston 32 is provided with outer profiles which are in shape adaptation to and in sliding fit with a pair of parallel inner wall surfaces of the guide hole 311. If the piston 32 and the piston sleeve 33 fit by adopting the above structure, the piston 32 can be allowed to smoothly slide in the piston sleeve 33, and a sealing effect is maintained.

Alternatively, an orthographic projection of the guide hole 311 at the lower flange 60 is provided with a pair of arc-shaped line segments, the pair of arc-shaped line segments being connected to the pair of straight line segments to form an irregular section shape.

The peripheral surface of the piston sleeve 33 is adaptive to the inner wall surface of the cylinder 20 in shape. Thus, large-area sealing is performed between the piston sleeve 33 and the cylinder 20 and between the guide hole 311 and the piston 32, and overall sealing is large-area sealing, thereby facilitating rechannelion of leakage.

As shown in FIG. 56, a first thrust surface 332 of a side, facing the lower flange 60, of the piston sleeve 33 is in contact with the surface of the lower flange 60. Thus, the piston sleeve 33 and the lower flange 60 are reliably positioned.

Figure 44:
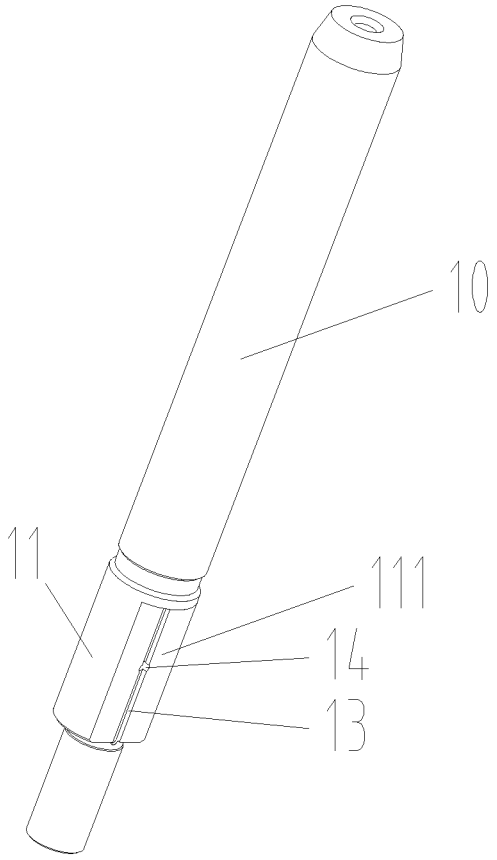
FIG. 44 shows a structure diagram of a rotating shaft in FIG. 40.
Figure 45:
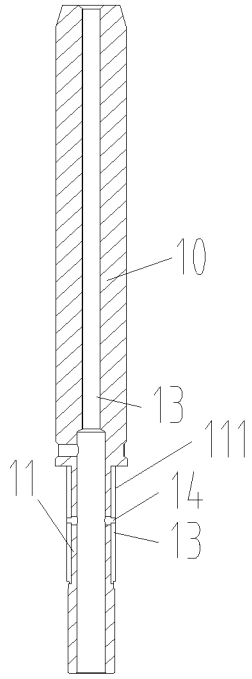
FIG. 45 shows an internal structure diagram of a rotating shaft in FIG. 44.
Figure 46:
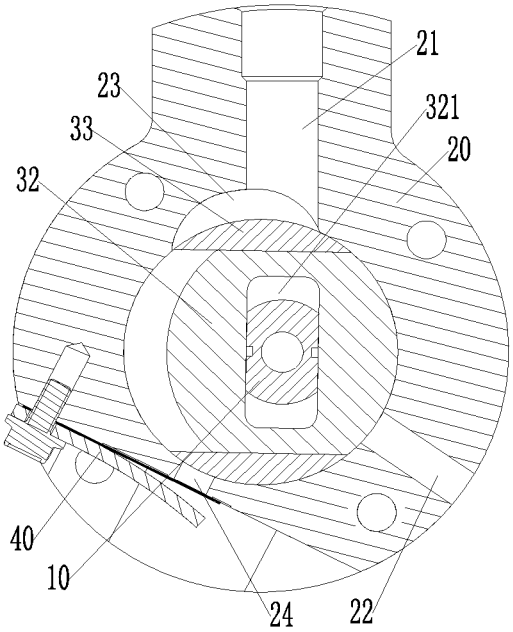
FIG. 46 shows a working state diagram of a piston prepared for suction in FIG. 40.
Figure 47:
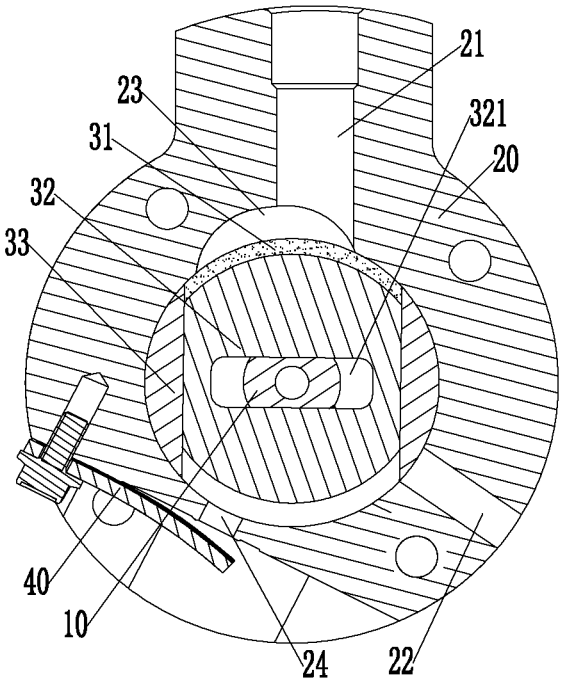
FIG. 47 shows a working state diagram of a piston during suction in FIG. 40.
Figure 48:
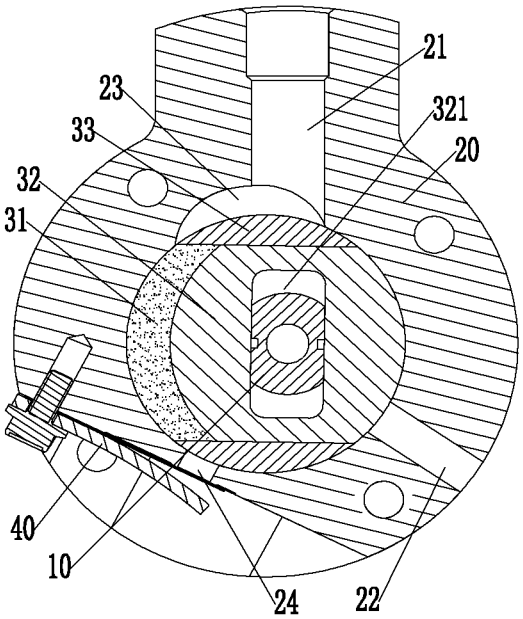
FIG. 48 shows a working state diagram of a piston completing suction in FIG. 40.
Figure 49:
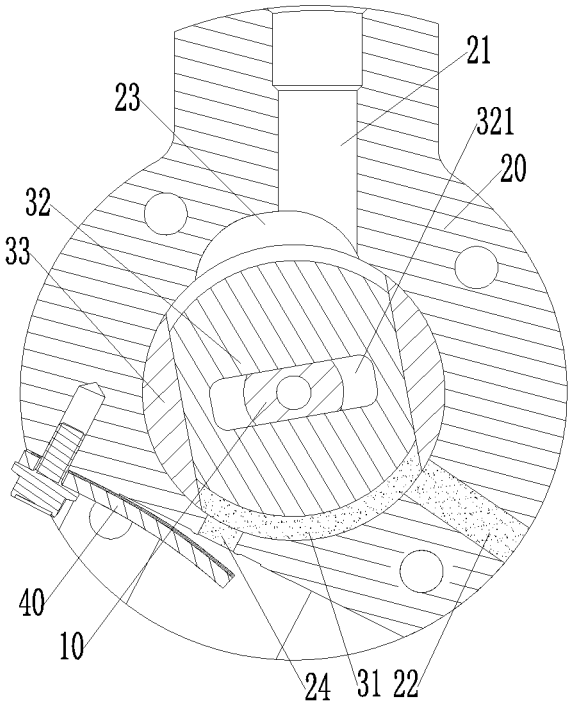
FIG. 49 shows a working state diagram of a piston during gas compression and exhaust in FIG. 40.
Figure 50:
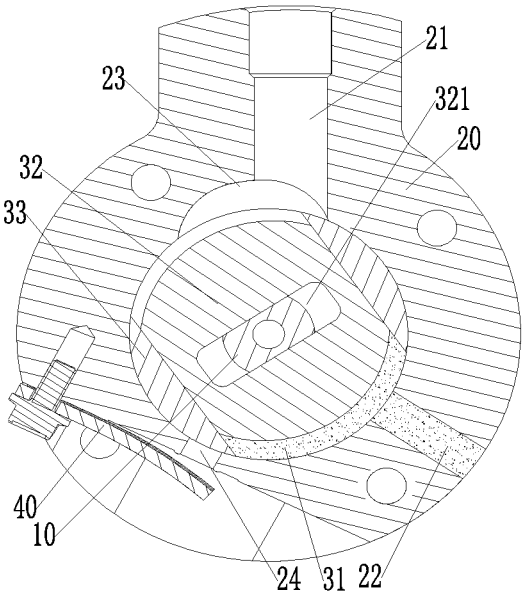
FIG. 50 shows a working state diagram of a piston during exhaust in FIG. 40.
Figure 51:
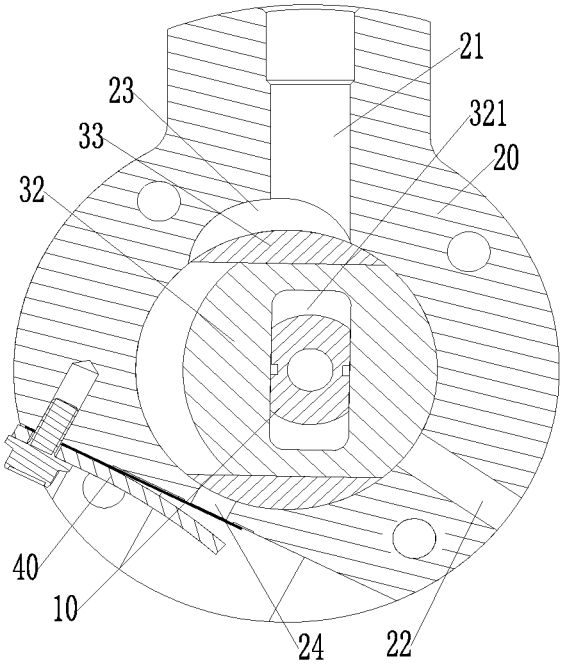
FIG. 51 shows a working state diagram of a piston which will complete exhaust in FIG. 40.

As shown in FIG. 44, the rotating shaft 10 is provided with a sliding segment 11 in sliding fit with the piston component 30, the sliding segment 11 is located between two ends of the rotating shaft 10, and the sliding segment 11 is provided with sliding fit surfaces 111. Because the rotating shaft 10 is in sliding fit with the piston 32 via the sliding fit surfaces 111, the motion reliability therebetween is ensured, and jam therebetween is effectively avoided.

Alternatively, the sliding segment 11 is provided with two sliding fit surfaces 111 arranged symmetrically. Because the sliding fit surfaces 111 are arranged symmetrically, the two sliding fit surfaces 111 are stressed more uniformly, thereby ensuring the motion reliability of the rotating shaft 10 and the piston 32.

As shown in FIG. 46 to FIG. 52, the sliding fit surfaces 111 are parallel with an axial plane of the rotating shaft 10, and the sliding fit surfaces 111 are in sliding fit with an inner wall surface of the sliding hole 321 of the piston 32 in a direction vertical to the axial direction of the rotating shaft 10.

The rotating shaft 10 in the present disclosure is provided with a oil passage 13, the oil passage 13 including an internal oil channel provided inside the rotating shaft 10, an external oil channel arranged outside the rotating shaft 10 and an oil-through hole 14 communicating the internal oil channel and the external oil channel. Because at least part of the oil passage 13 is the internal oil channel, great leakage of lubricating oil is effectively avoided, and the flowing reliability of the lubricating oil is increased. In the presence of the oil-through hole 14, the internal oil channel and the external oil channel can be smoothly communicated, and oil can be injected to the oil passage 13 via the oil-through hole 14, thereby ensuring the oil injection convenience of the oil passage 13.

In a preferable implementation manner as shown in FIG. 44, the external oil channel extending along the axial direction of the rotating shaft 10 is provided at the sliding fit surfaces 111. Because the oil passage 13 at the sliding fit surfaces 111 is the external oil channel, lubricating oil can be directly supplied to the sliding fit surfaces 111 and the piston 32, and abrasion caused by over-large friction there between is effectively avoided, thereby increasing the motion smoothness there between.

The compressor in the present disclosure further includes a supporting plate 61, the supporting plate 61 is provided on an end face, away from one side of the cylinder 20, of the lower flange 60, the supporting plate 61 is coaxial with the lower flange 60, the rotating shaft 10 penetrates through a through hole in the lower flange 60 and is supported on the supporting plate 61, and the supporting plate 61 is provided with a second thrust surface 611 for supporting the rotating shaft 10. Because the supporting plate 61 is used for supporting the rotating shaft 10, the connection reliability between all parts is increased.

Figure 41:
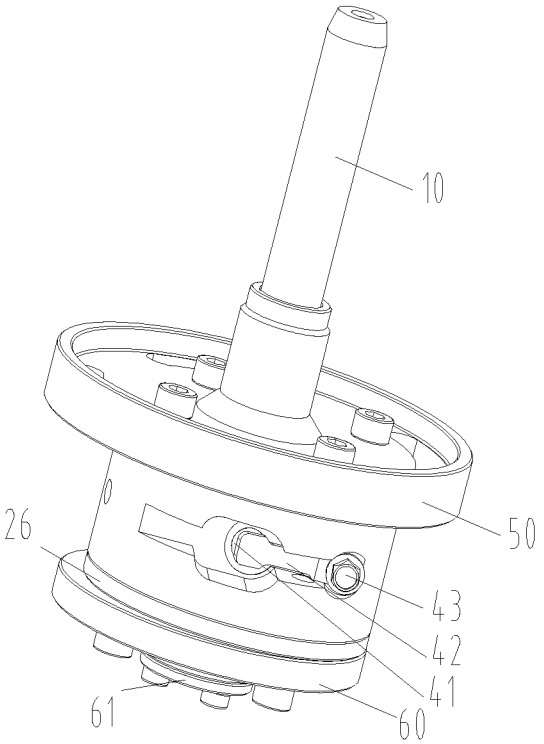
FIG. 41 shows a schematic diagram of a mounting relationship among a rotating shaft, an upper flange, a cylinder and a lower flange in FIG. 40.

As shown in FIG. 40 and FIG. 41, a limiting plate 26 is connected to the cylinder 20 via a fifth fastener 82.

Alternatively, the fifth fastener 82 is a bolt or screw.

As shown in FIG. 40 and FIG. 41, the compressor in the present disclosure further includes a limiting plate 26, the limiting plate 26 being provided with an avoidance hole for avoiding the rotating shaft 10, and the limiting plate 26 being sandwiched between the lower flange 60 and the piston sleeve 33 and coaxial with the piston sleeve 33. Due to the arrangement of the limiting plate 26, the limiting reliability of each part is ensured.

As shown in FIG. 40 and FIG. 41, the limiting plate 26 is connected to the cylinder 20 via a fourth fastener 81.

Alternatively, the fourth fastener 81 is a bolt or screw.

Specifically speaking, the piston sleeve 33 is provided with a connecting convex ring 334 protruding towards one side of the lower flange 60, the connecting convex ring 334 being embedded into the avoidance hole. Due to fit between the piston sleeve 33 and the limiting plate 26, the motion reliability of the piston sleeve 33 is ensured.

Specifically speaking, the piston sleeve 33 in the present disclosure includes two coaxial cylinders with different diameters, the outer diameter of an upper half part is equal to the inner diameter of the cylinder 20, and the axis of the guide hole 311 is vertical to the axis of the cylinder 20 and fits the piston 32, wherein the shape of the guide hole 311 remains consistent with that of the piston 32. In a reciprocating motion process, gas compression is achieved. A lower end face of the upper half part is provided with concentric connecting convex rings 334, is a first thrust surface, and fits the end face of the lower flange 60, thereby reducing the structure friction area. A lower half part is a hollow column, namely a short shaft, the axis of the short shaft is coaxial with that of the lower flange 60, and in a motion process, they rotate coaxially.

Figure 39:
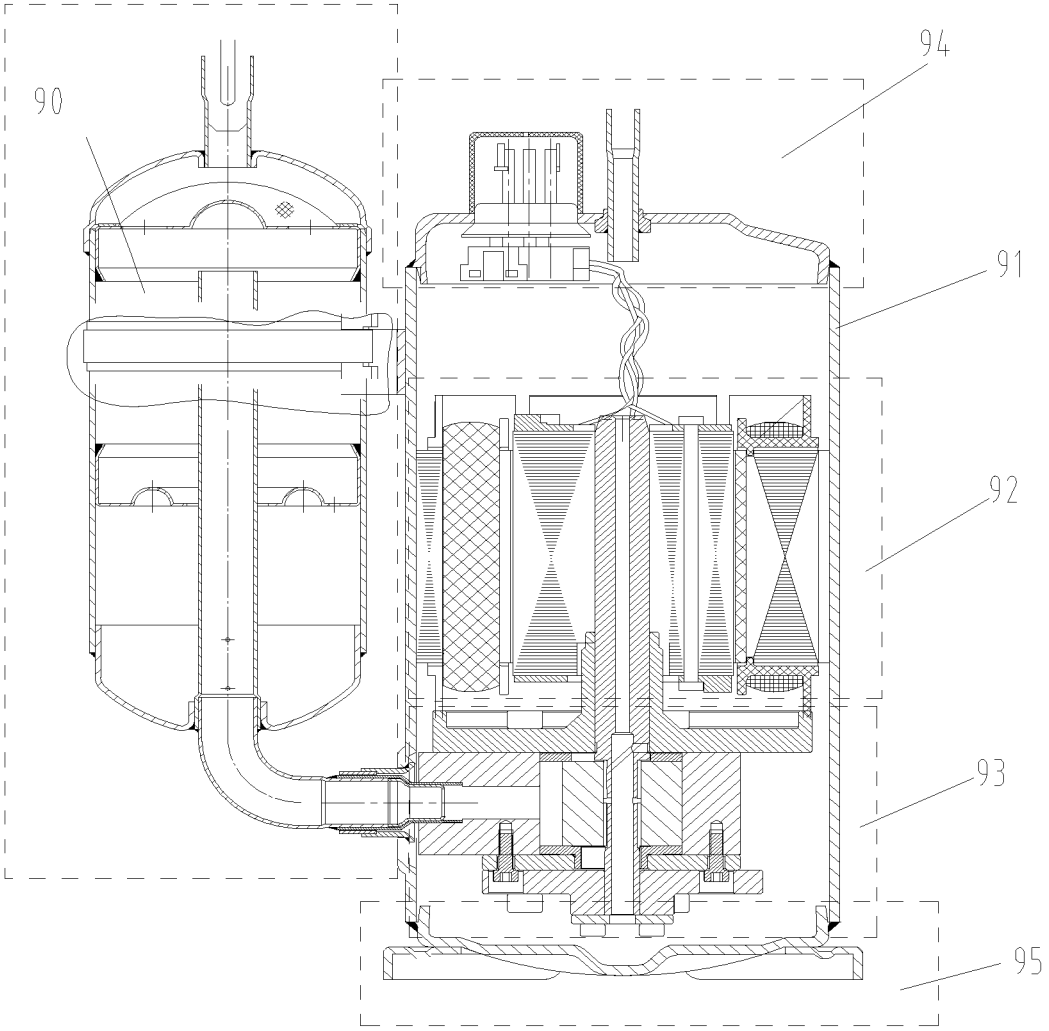
FIG. 39 shows a structure diagram of a compressor in a third preferable implementation manner.

The fluid machinery 100 as shown in FIG. 39 is a compressor. The compressor includes a dispenser part 90, a housing component 91, a motor component 92, a pump body component 93, an upper cover component 94, and a lower cover and mounting plate 95, wherein the dispenser part 90 is arranged outside the housing component 91; the upper cover component 94 is assembled at the upper end of the housing component 91; the lower cover and mounting plate 95 is assembled at the lower end of the housing component 91; both the motor component 92 and the pump body component 93 are located inside the housing component 91; and the motor component 92 is arranged above the pump body component 93. The pump body component 93 of the compressor includes the above-mentioned upper flange 50, lower flange 60, cylinder 20, rotating shaft 10 and piston component 30.

Alternatively, all the parts are connected in a welding, shrinkage fit or cold pressing manner.

Figure 42:
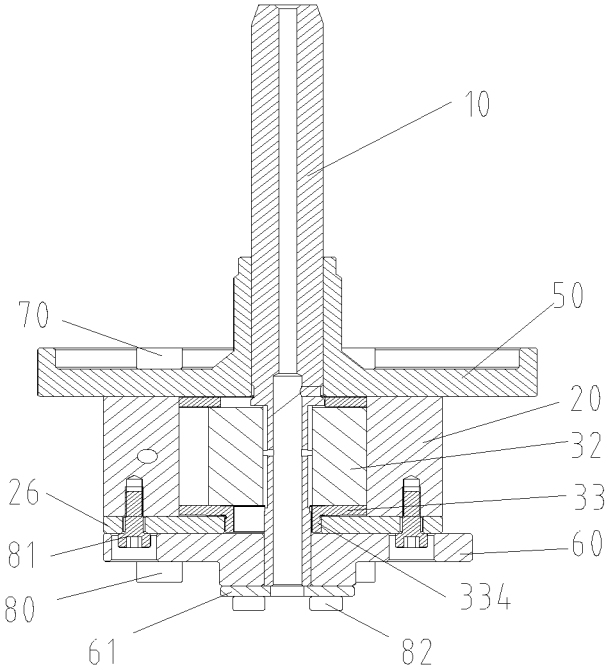
FIG. 42 shows an internal structure diagram of a part in FIG. 41.

The assembly process of the whole pump body component 93 is as follows: the piston 32 is mounted in the guide hole 311, the connecting convex ring 334 is mounted on the limiting plate 26, the limiting plate 26 is fixedly connected to the lower flange 60, the cylinder 20 and the piston sleeve 33 are coaxially mounted, the lower flange 60 is fixed to the cylinder 20, the sliding fit surfaces 111 of the rotating shaft 10 and a pair of parallel surfaces of the sliding hole 321 of the piston 32 are mounted in fit, the upper flange 50 is fixed to the upper half section of the rotating shaft 10, and the upper flange 50 is fixed to the cylinder 20 via a screw. Thus, assembly of the pump body component 93 is completed, as shown in FIG. 42.

Alternatively, there are at least two guide holes 311, the two guide holes 311 being spaced in the axial direction of the rotating shaft 10; and there are at least two pistons 32, each guide hole 311 being provided with the corresponding piston 32. At this time, the compressor is a single-cylinder multi-compression cavity compressor, and compared with a same-displacement single-cylinder roller compressor, the compressor is relatively small in torque fluctuation.

Alternatively, the compressor in the present disclosure is not provided with a suction valve, so that the suction resistance can be effectively reduced, and the compression efficiency of the compressor is increased.

It is important to note that in the detailed description of the embodiments, when the piston 32 completes motion for a circle, suction and exhaust will be performed twice, so that the compressor has the characteristic of high compression efficiency. Compared with the same-displacement single-cylinder roller compressor, the compressor in the present disclosure is relatively small in torque fluctuation due to division of a compression into two compressions, has small exhaust resistance during operation, and effectively eliminates an exhaust noise.

Specifically speaking, as shown in FIG. 46 to FIG. 52, a cylinder wall of the cylinder 20 is provided with a compression intake port 21 and a first compression exhaust port 22, when the piston component 30 is located at an intake position, the compression intake port 21 is communicated with the variable volume cavity 31, and when the piston component 30 is located at an exhaust position, the variable volume cavity 31 is communicated with the first compression exhaust port 22.

Alternatively, an inner wall surface of the cylinder wall is provided with a compression intake buffer tank 23, the compression intake buffer tank 23 being communicated with the compression intake port 21 (see FIG. 46 to FIG. 52). In the presence of the compression intake buffer tank 23, a great amount of gas will be stored at this part, so that the variable volume cavity 31 can be full of gas to supply sufficient gas to the compressor, and in case of insufficient suction, the stored gas can be timely supplied to the variable volume cavity 31 so as to ensure the compression efficiency of the compressor.

Specifically speaking, the compression intake buffer tank 23 is provided with an arc-shaped segment in a radial plane of the cylinder 20, and the compression intake buffer tank 23 extends from the compression intake port 21 to one side where the first compression exhaust port 22 is located. An extending direction of the compression intake buffer tank 23 is consistent with a rotating direction of the piston component 30.

The cylinder wall of the cylinder 20 in the present disclosure is provided with a second compression exhaust port 24, the second compression exhaust port 24 is located between the compression intake port 21 and the first compression exhaust port 22, and during rotation of the piston component 30, a part of gas in the piston component 30 is depressurized by the second compression exhaust port 24 and then completely exhausted from the first compression exhaust port 22. Because only two exhaust paths are provided, namely a path of exhaust via the first compression exhaust port 22 and a path of exhaust via the second compression exhaust port 24, gas leakage is reduced, and the sealing area of the cylinder 20 is increased.

Alternatively, the compressor (namely the fluid machinery 100) further includes an exhaust valve component 40, the exhaust valve component 40 being arranged at the second compression exhaust port 24. Because the exhaust valve component 40 is arranged at the second compression exhaust port 24, great leakage of gas in the variable volume cavity 31 is effectively avoided, and the compression efficiency of the variable volume cavity 31 is ensured.

Figure 43:
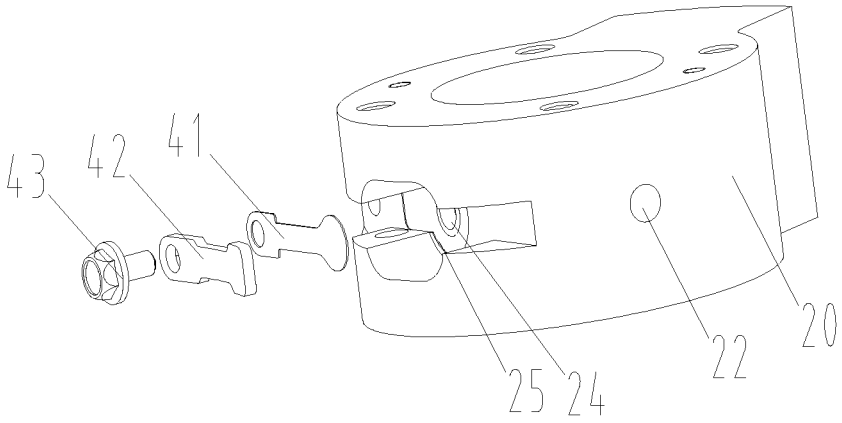
FIG. 43 shows a schematic diagram of a mounting relationship between an exhaust valve component and a cylinder in FIG. 40.

In a preferable implementation manner as shown in FIG. 43, a receiving groove 25 is provided on an outer wall of the cylinder wall, the second compression exhaust port 24 runs through the groove bottom of the receiving groove 25, and the exhaust valve component 40 is provided in the receiving groove 25. Due to the arrangement of the receiving groove 25 for receiving the exhaust valve component 40, the occupied space of the exhaust valve component 40 is reduced, and parts are arranged reasonably, thereby increasing the space utilization rate of the cylinder 20.

Specifically speaking, the exhaust valve component 40 includes an exhaust valve 41 and a valve baffle 42, the exhaust valve 41 being provided in the receiving groove 25 and shielding the second compression exhaust port 24, and the valve baffle 42 being overlaid on the exhaust valve 41. Due to the arrangement of the valve baffle 42, excessive opening of the exhaust valve 41 is effectively avoided, and the exhaust performance of the cylinder 20 is ensured.

Alternatively, the exhaust valve 41 and the valve baffle 42 are connected via a first fastener 43. Further, the first fastener 43 is a screw.

It is important to note that the exhaust valve component 40 in the present disclosure can separate the variable volume cavity 31 from an external space of the pump body component 93, referred to as backpressure exhaust, that is, when the pressure of the variable volume cavity 31 is greater than the pressure of the external space (exhaust pressure) after the variable volume cavity 31 and the second compression exhaust port 24 are communicated, the exhaust valve 41 is opened to start exhausting; and if the pressure of the variable volume cavity 31 is still lower than the exhaust pressure after communication, the exhaust valve 41 does not work. At this time, the compressor continuously operates for compression until the variable volume cavity 31 is communicated with the first compression exhaust port 22, and gas in the variable volume cavity 31 is pressed into the external space to complete an exhaust process. The exhaust manner of the first compression exhaust port 22 is a forced exhaust manner.

The operation of the compressor will be specifically introduced below.

As shown in FIG. 1, the compressor in the present disclosure adopts a principle of cross slider mechanism, wherein the piston 32 serves as a slider in the cross slider mechanism, the piston 32 and the sliding fit surface 111 of the rotating shaft 10 serve as a connecting rod $I_1$ in the cross slider mechanism, and the piston 32 and the guide hole 311 of the piston sleeve 33 serve as a connecting rod $I_2$ in the cross slider mechanism. Thus, a main structure of the principle of cross slider is formed. Moreover, the axis $O_1$ of the rotating shaft 10 is eccentric to the axis $O_2$ of the cylinder 20, and the rotating shaft and the cylinder rotate around the respective axes. When the rotating shaft 10 rotates, the piston 32 straightly slides relative to the rotating shaft 10 and the piston sleeve 33, so as to achieve gas compression. Moreover, the whole piston component 30 synchronously rotates along with the rotating shaft 10, and the piston 32 operates within a range of an eccentric distance e relative to the axis of the cylinder 20. The stroke of the piston 32 is 2e, the cross section area of the piston 32 is S, and the displacement of the compressor (namely maximum suction volume) is $V=2*(2e*S)$.

Figure 52:
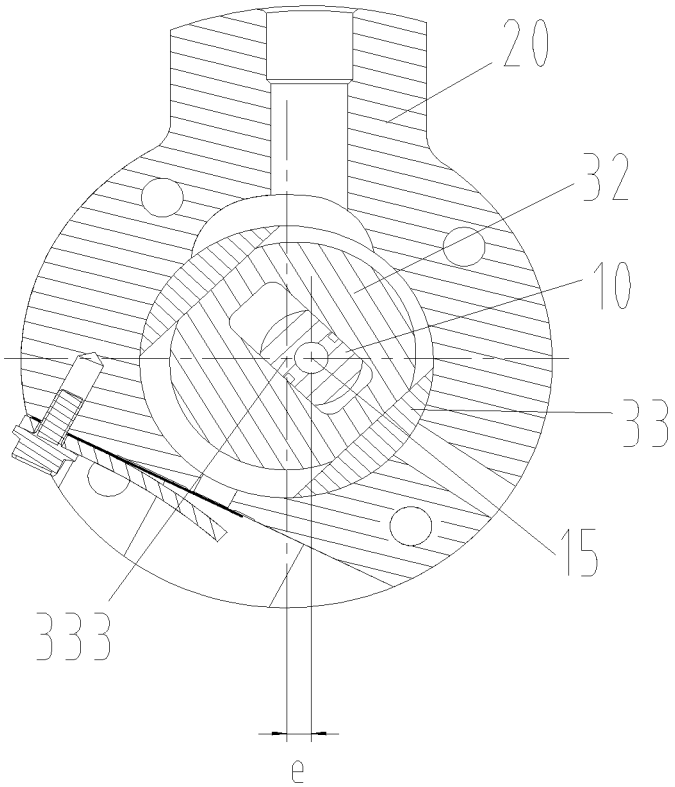
FIG. 52 shows a schematic diagram of an eccentric relationship between a piston sleeve and a rotating shaft in FIG. 40.
Figure 53:
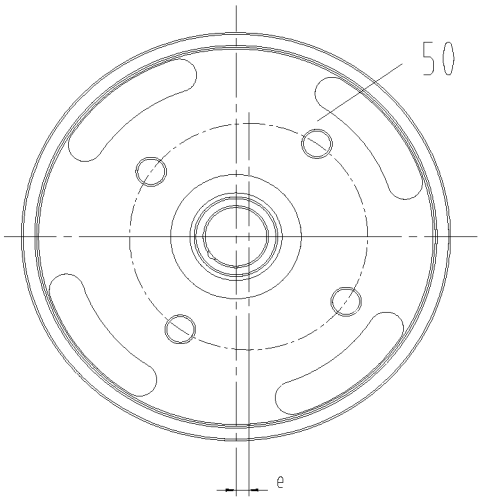
FIG. 53 shows a structure diagram of an upper flange in FIG. 40.

As shown in FIG. 52, an eccentric distance e exists between a rotating shaft axis 15 and a piston sleeve axis 333, and a piston center-of-mass trajectory 322 is circular.

Specifically speaking, the motor component 92 drives the rotating shaft 10 to rotate, the sliding fit surface 111 of the rotating shaft 10 drives the piston 32 to move, and the piston 32 drives the piston sleeve 33 to rotate. In the whole motion part, the piston sleeve 33 only makes a circular motion, the piston 32 makes a reciprocating motion relative to both the rotating shaft 10 and the guide hole 311 of the piston sleeve 33, and the two reciprocating motions are vertical to each other and carried out simultaneously, so that the reciprocating motions in two directions form a motion mode of cross slider mechanism. A composite motion similar to the cross slider mechanism allows the piston 32 to make a reciprocating motion relative to the piston sleeve 33, the reciprocating motion periodically enlarging and reducing a cavity formed by the piston sleeve 33, the cylinder 20 and the piston 32. The piston 32 makes a circular motion relative to the cylinder 20, the circular motion allowing the variable volume cavity 31 formed by the piston sleeve 33, the cylinder 20 and the piston 32 to be communicated with the compression intake port 21 and the exhaust port periodically. Under the combined action of the above two relative motions, the compressor may complete the process of suction, compression and exhaust.

In addition, the compressor in the present disclosure also has the advantages of zero clearance volume and high volume efficiency.

The compressor in the present disclosure is a variable pressure ratio compressor, and the exhaust pressure ratio of the compressor may be changed by adjusting the positions of the first compression exhaust port 22 and the second compression exhaust port 24 according to the operational conditions of the compressor, so as to optimize the exhaust performance of the compressor. When the second compression exhaust port 24 is closer to the compression intake port 21 (clockwise), the exhaust pressure ratio of the compressor is small; and when the second compression exhaust port 24 is closer to the compression intake port 21 (anticlockwise), the exhaust pressure ratio of the compressor is large.

In addition, the compressor in the present disclosure also has the advantages of zero clearance volume and high volume efficiency.

Under other using occasions, the compressor may be used as an expander by changing the positions of a suction port and an exhaust port. That is, the exhaust port of the compressor serves as an expander suction port, high-pressure gas is charged, other pushing mechanisms rotate, and gas is exhausted from the suction port of the compressor (expander exhaust port) after expansion.

When the fluid machinery 100 is the expander, the cylinder wall of the cylinder 20 is provided with an expansion exhaust port and a first expansion intake port, when the piston component 30 is located at an intake position, the expansion exhaust port is communicated with the variable volume cavity 31, and when the piston component 30 is located at an exhaust position, the variable volume cavity 31 is communicated with the first expansion intake port. When high-pressure gas enters the variable volume cavity 31 through the first expansion intake port, the high-pressure gas pushes the piston component 30 to rotate, the piston sleeve 33 rotates to drive the piston 32 to rotate, the piston 32 is allowed to slide straightly relative to the piston sleeve 33, and the piston 32 further drives the rotating shaft 10 to rotationally move. By connecting the rotating shaft 10 to other power consumption equipment, the rotating shaft 10 may apply an output work.

Alternatively, the inner wall surface of the cylinder wall is provided with an expansion exhaust buffer tank, the expansion exhaust buffer tank being communicated with the expansion exhaust port.

Further, the expansion exhaust buffer tank is provided with an arc-shaped segment in a radial plane of the cylinder 20, and the expansion exhaust buffer tank extends from the expansion exhaust port to one side where the first expansion intake port is located. An extending direction of the expansion exhaust buffer tank is consistent with a rotating direction of the piston component 30.

The fourth implementation manner is as follows.

Compared with the first implementation manner, this implementation manner replaces a piston 32 having a sliding groove 323 with a piston 32 having a sliding hole 321. In addition, parts such as an exhaust valve component 40, a second compression exhaust port 24 and a supporting plate 61 are also added.

As shown in FIG. 60 to FIG. 80, the fluid machinery 100 includes an upper flange 50, a lower flange 60, a cylinder 20, a rotating shaft 10, a piston sleeve 33, a position sleeve shaft 34 and a piston 32, wherein the piston sleeve 33 is pivotally provided in the cylinder; the piston sleeve shaft 34 penetrates through the upper flange 50 and is fixedly connected to the piston sleeve 33; the piston 32 is slidably provided in the piston sleeve 33 to form a variable volume cavity 31, and the variable volume cavity 31 is located in a sliding direction of the piston 32; the axis of the rotating shaft 10 and the axis of the cylinder 20 are eccentric to each other and at a fixed eccentric distance; the rotating shaft 10 sequentially penetrates through the lower flange 60 and the cylinder 20 and is in sliding fit with the piston 32; under the driving action of the piston sleeve shaft 34, the piston sleeve 33 synchronously rotates along with the piston sleeve shaft 34 to drive the piston 32 to slide in the piston sleeve 33 so as to change the volume of the variable volume cavity 31; and meanwhile, the rotating shaft 10 rotates under the driving action of the piston 32. Herein, the upper flange 50 is fixed to the cylinder 20 via a second fastener 70, and the lower flange 60 is fixed to the cylinder 20 via a third fastener 80.

Alternatively, the second fastener 70 and/or the third fastener 80 are/is screws or bolts.

Because the eccentric distance between the rotating shaft 10 and the cylinder 20 is fixed, the rotating shaft 10 and the cylinder 20 rotate around the respective axes thereof during motion, and the position of the center of mass remains unchanged, so that the piston 32 and the piston sleeve 33 are allowed to rotate stably and continuously when moving in the cylinder 20; and vibration of the fluid machinery 100 is effectively mitigated, a regular pattern for changes in the volume of the variable volume cavity is ensured, and clearance volume is reduced, thereby increasing the operational stability of the fluid machinery 100, and increasing the working reliability of heat exchange equipment 200.

According to the fluid machinery 100 in the present disclosure, the piston sleeve shaft 34 drives the piston sleeve 33 to rotate and drives the piston 32 to rotate, such that the piston 32 slides in the piston sleeve 33 to change the volume of the variable volume cavity 31; meanwhile, the rotating shaft 10 rotates under the driving action of the piston 32, such that the piston sleeve 33 and the rotating shaft 10 bear bending deformation and torsion deformation respectively, thereby reducing the overall deformation of a single part, and reducing requirements for the structural strength of the rotating shaft 10; and leakage between the end face of the piston sleeve 33 and the end face of the upper flange 50 can be effectively reduced.

It is important to note that the upper flange 50 is coaxial with the cylinder 20 and the axis of the lower flange 60 is eccentric to the axis of the cylinder 20. A fixed eccentric distance between the cylinder 20 mounted in the above manner and the rotating shaft 10 or the upper flange 50 can be ensured, so that the piston sleeve 33 has the characteristic of good motion stability.

In a preferable implementation manner as shown in FIG. 74 to FIG. 80, the piston 32 is in sliding fit with the rotating shaft 10, and under the driving action of the piston sleeve 33, the piston 32 makes the rotating shaft 10 rotate, so the piston 32 has a tendency of straight motion relative to the rotating shaft 10. Because the piston 32 and the piston sleeve 33 are slidably connected, motion stop of the piston 32 is effectively avoided, so as to ensure the motion reliability of the piston 32, the rotating shaft 10 and the piston sleeve 33, thereby increasing the operational stability of the fluid machinery 100.

Because a cross slider mechanism is formed among the piston 32, the piston sleeve 33, the cylinder 20 and the rotating shaft 10, the motion of the piston 32, the piston sleeve 33 and the cylinder 20 is stable and continuous, and a regular pattern for changes in the volume of the variable volume cavity 31 is ensured, thereby ensuring the operational stability of the fluid machinery 100, and increasing the working reliability of heat exchange equipment 200.

The piston 32 in the present disclosure is provided with a sliding hole 321 running through an axial direction of the rotating shaft 10, the rotating shaft 10 penetrates through the sliding hole 321, the rotating shaft 10 rotates along with the piston sleeve 33 and the piston 32 under the driving of the piston 32, and meanwhile, the piston 32 slides in the piston sleeve 33 along a direction vertical to the axial direction of the rotating shaft 10 in a reciprocating manner (see FIG. 74 to FIG. 80). Because the piston 32 is allowed to make a straight motion instead of a rotational reciprocating motion relative to the rotating shaft 10, the eccentric quality is effectively reduced, and lateral forces exerted on the rotating shaft 10 and the piston 32 are reduced, thereby reducing the abrasion of the piston 32, and increasing the sealing property of the piston 32. Meanwhile, the operational stability and reliability of a pump body component 93 are ensured, the vibration risk of the fluid machinery 100 is reduced, and the structure of the fluid machinery 100 is simplified.

Alternatively, the sliding hole 321 is an slotted hole or a waist-shaped hole.

The piston 32 in the present disclosure is columnar. Alternatively, the piston 32 is cylindrical or non-cylindrical.

As shown in FIG. 74 to FIG. 80, the piston 32 is provided with a pair of arc-shaped surfaces arranged symmetrically about a middle vertical plane of the piston 32, the arc-shaped surfaces adaptively fit an inner surface of the cylinder 20, and the double arc curvature radius of the arc-shaped surfaces is equal to the inner diameter of the cylinder 20. Thus, zero-clearance volume can be implemented in an exhaust process. It is important to note that when the piston 32 is placed in the piston sleeve 33, the middle vertical plane of the piston 32 is an axial plane of the piston sleeve 33.

Figure 67:
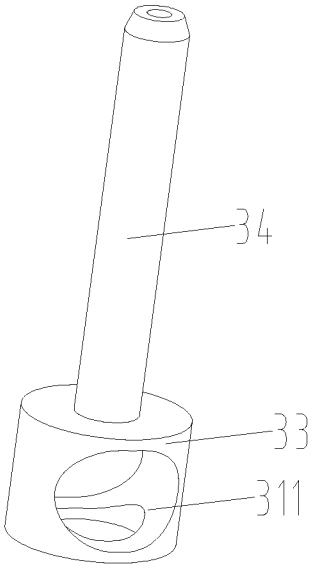
FIG. 67 shows a schematic diagram of a connecting relationship between a piston sleeve and a piston sleeve shaft in FIG. 60.
Figure 68:
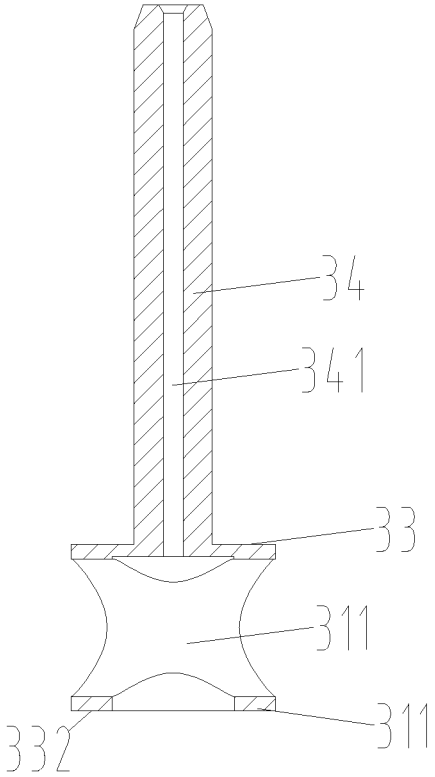
FIG. 68 shows an internal structure diagram of FIG. 67.
Figure 69:
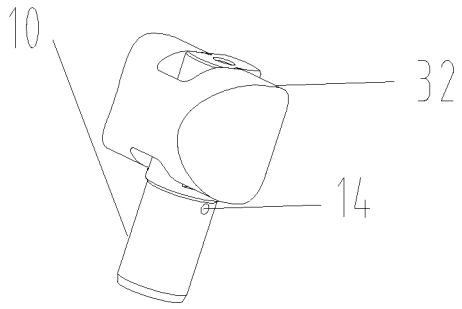
FIG. 69 shows a schematic diagram of an assembly relationship between a rotating shaft and a piston in FIG. 60.
Figure 70:
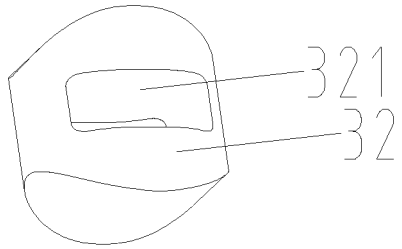
FIG. 70 shows a structure diagram of a piston in FIG. 60.
Figure 71:
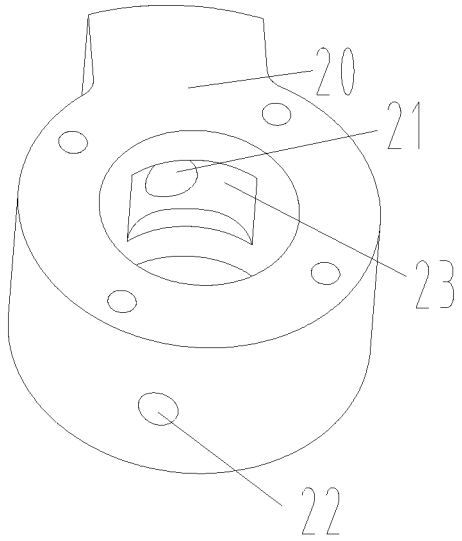
FIG. 71 shows a structure diagram of a cylinder in FIG. 60.
Figure 72:
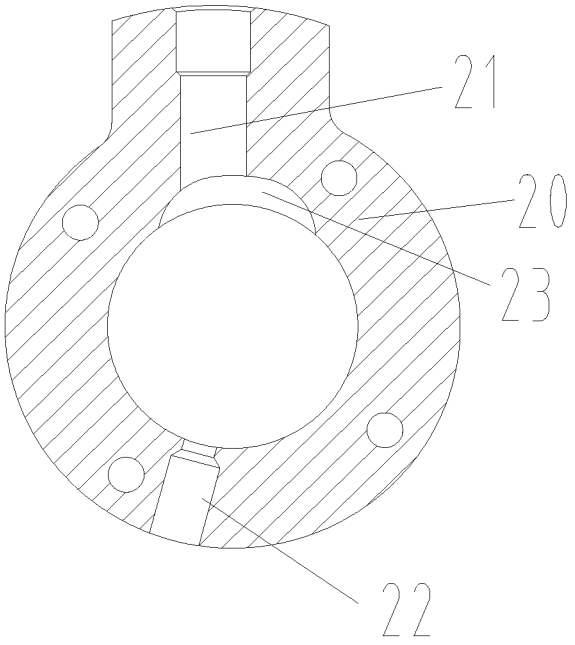
FIG. 72 shows a top view of FIG. 71.
Figure 73:
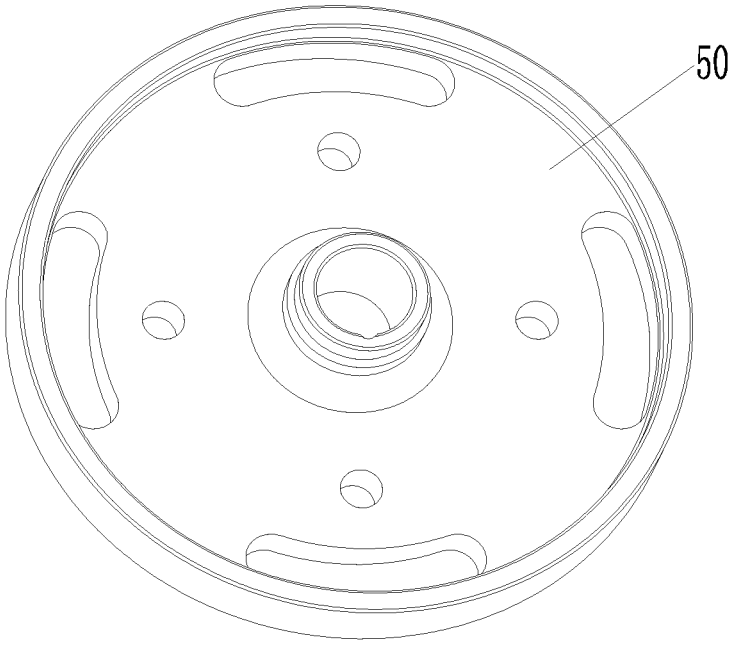
FIG. 73 shows a structure diagram of an upper flange in FIG. 60.

As shown in FIG. 67 and FIG. 68, a guide hole 311 running through a radial direction of the piston sleeve 33 is provided in the piston sleeve 33, and the piston 32 is slidably provided in the guide hole 311 to make a straight reciprocating motion. Because the piston 32 is slidably provided in the guide hole 311, when the piston 32 moves leftwards and rightwards in the guide hole 311, the volume of the variable volume cavity 31 can be continuously changed, thereby ensuring the suction and exhaust stability of the fluid machinery 100.

In order to prevent the piston 32 from rotating in the piston sleeve 33, an orthographic projection of the guide hole 311 at the lower flange 60 is provided with a pair of parallel straight line segments, the pair of parallel straight line segments is formed by projecting a pair of parallel inner wall surfaces of the piston sleeve 33, and the piston 32 is provided with outer profiles which are in shape adaptation to and in sliding fit with a pair of parallel inner wall surfaces of the guide hole 311. If the piston 32 and the piston sleeve 33 fit by adopting the above structure, the piston 32 can be allowed to smoothly slide in the piston sleeve 33, and a sealing effect is maintained.

Alternatively, an orthographic projection of the guide hole 311 at the lower flange 60 is provided with a pair of arc-shaped line segments, the pair of arc-shaped line segments being connected to the pair of straight line segments to form an irregular section shape.

The peripheral surface of the piston sleeve 33 is adaptive to the inner wall surface of the cylinder 20 in shape. Thus, large-area sealing is performed between the piston sleeve 33 and the cylinder 20 and between the guide hole 311 and the piston 32, and overall sealing is large-area sealing, thereby facilitating rechannelion of leakage.

As shown in FIG. 68, a first thrust surface 332 of a side, facing the lower flange 60, of the piston sleeve 33 is in contact with the surface of the lower flange 60. Thus, the piston sleeve 33 and the lower flange 60 are reliably positioned.

Figure 61:
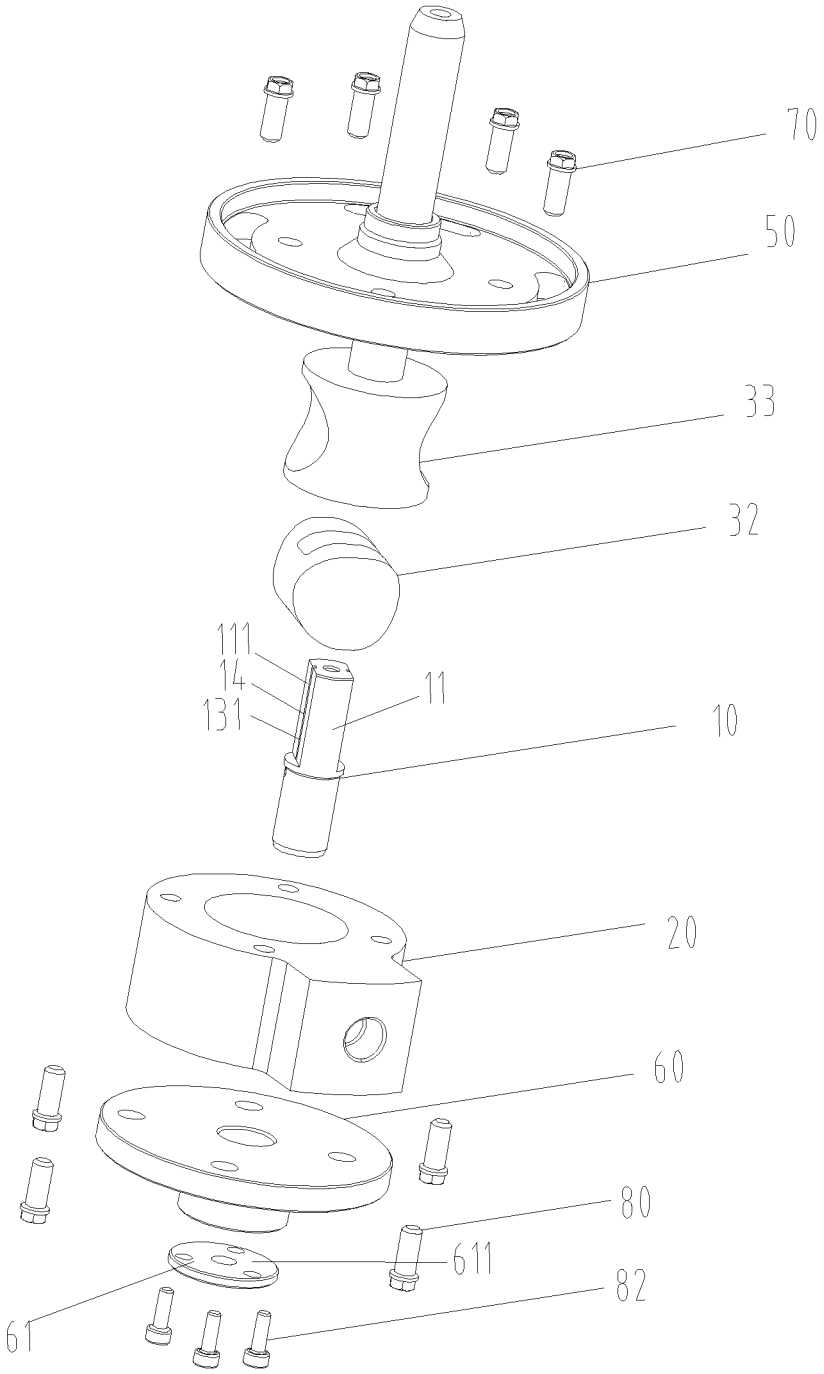
FIG. 61 shows an exploded view of a pump body component in FIG. 60.

As shown in FIG. 61, the rotating shaft 10 is provided with a sliding segment 11 in sliding fit with the piston 32, the sliding segment 11 is located at an end, away from the lower flange 60, of the rotating shaft 10, and the sliding segment 11 is provided with sliding fit surfaces 111. Because the rotating shaft 10 is in sliding fit with the piston 32 via the sliding fit surfaces 111, the motion reliability therebetween is ensured, and jam therebetween is effectively avoided.

Alternatively, the sliding segment 11 is provided with two sliding fit surfaces 111 arranged symmetrically. Because the sliding fit surfaces 111 are arranged symmetrically, the two sliding fit surfaces 111 are stressed more uniformly, thereby ensuring the motion reliability of the rotating shaft 10 and the piston 32.

As shown in FIG. 61, the sliding fit surfaces 111 are parallel with an axial plane of the rotating shaft 10, and the sliding fit surfaces 111 are in sliding fit with an inner wall surface of the sliding hole 321 of the piston 32 in a direction vertical to the axial direction of the rotating shaft 10.

The piston sleeve shaft 34 in the present disclosure is provided with a first oil passage 341 running through an axial direction of the piston sleeve shaft 34, the rotating shaft 10 is provided with a second oil passage 131 communicated with the first oil passage 341, and at least part of the second oil passage 131 is an internal oil channel of the rotating shaft 10. Because at least part of the second oil passage 131 is the internal oil channel, great leakage of lubricating oil is effectively avoided, and the flowing reliability of the lubricating oil is increased.

Figure 63:
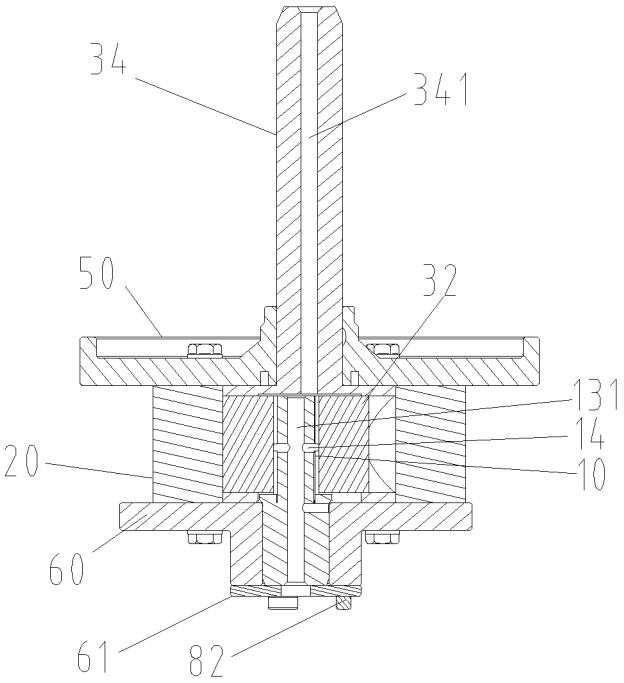
FIG. 63 shows an internal structure diagram of a part in FIG. 62.
Figure 64:
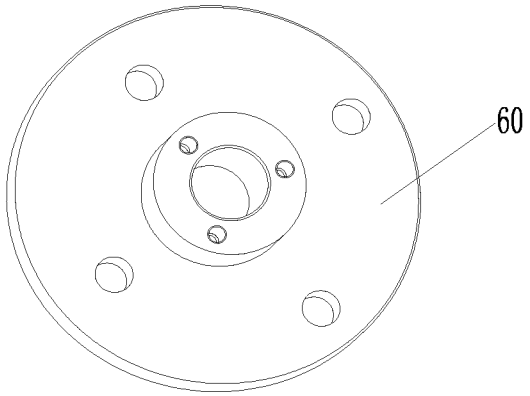
FIG. 64 shows a structure diagram of a lower flange in FIG. 60.

As shown in FIG. 61 and FIG. 63, the second oil passage 131 at the sliding fit surfaces 111 is an external oil channel. Because the second oil passage 131 at the sliding fit surfaces 111 is the external oil channel, lubricating oil can be directly supplied to the sliding fit surfaces 111 and the piston 32, and abrasion caused by over-large friction there between is effectively avoided, thereby increasing the motion smoothness there between.

As shown in FIG. 61 and FIG. 63, the rotating shaft 10 is provided with an oil-through hole 14, the internal oil channel being communicated with the external oil channel via the oil-through hole 14. Because the oil-through hole 14 is provided, the internal oil channel and the external oil channel can be smoothly communicated, and oil can be injected to the second oil passage 131 via the oil-through hole 14, thereby ensuring the oil injection convenience of the second oil passage 131.

Figure 62:
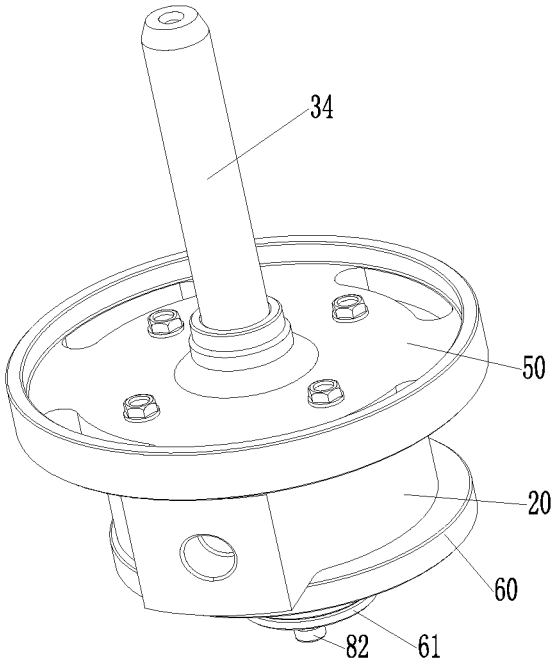
FIG. 62 shows a schematic diagram of a mounting relationship among a rotating shaft, an upper flange, a cylinder and a lower flange in FIG. 61.

As shown in FIG. 61 to FIG. 63, the fluid machinery 100 in the present disclosure further includes a supporting plate 61, the supporting plate 61 is provided on an end face, away from one side of the cylinder 20, of the lower flange 60, the supporting plate 61 and the lower flange 60 are coaxially arranged and used for supporting the rotating shaft 10, the rotating shaft 10 penetrates through a through hole in the lower flange 60 and is supported on the supporting plate 61, and the supporting plate 61 is provided with a second thrust surface 611 for supporting the rotating shaft 10. Because the supporting plate 61 is used for supporting the rotating shaft 10, the connection reliability between all parts is increased.

As shown in FIG. 61, the supporting plate 61 is connected to the lower flange 60 via a fifth fastener 82.

Alternatively, the fifth fastener 82 is a bolt or screw.

As shown in FIG. 61, four pump body screw holes allowing passage of third fasteners 80 and three supporting disc thread holes allowing passage of fifth fasteners 82 are distributed on the lower flange 60, a circle formed by the centers of the four pump body screw holes is eccentric to the center of a bearing, where the eccentricity is e and determines the eccentricity of pump body assembly. After the piston sleeve 33 rotates for a circle, gas volume $V=2*2e*S$, where S is a cross section area of a main structure of the piston 32; and the centers of the supporting disc thread holes are coincided with the axis of the lower flange 60, and fit the fifth fasteners 82 to fix the supporting plate 61.

As shown in FIG. 61, the supporting plate 61 is of a cylindrical structure, three screw holes allowing passage of the fifth fasteners 82 are uniformly distributed, and the surface of a side, facing the rotating shaft 10, of the supporting plate 61 has a certain roughness so as to fit the bottom surface of the rotating shaft 10.

Figure 60:
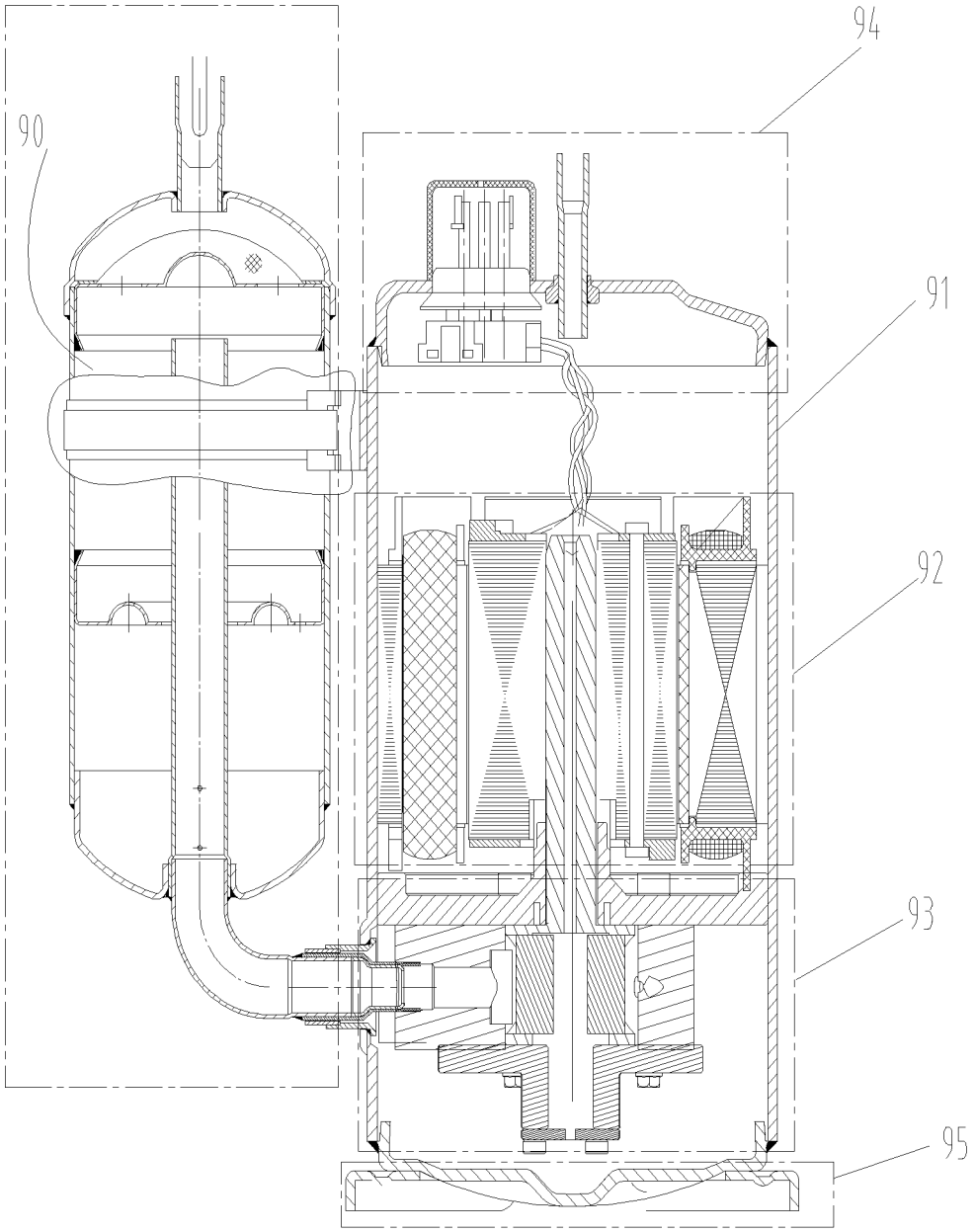
FIG. 60 shows a structure diagram of a compressor in a fourth preferable implementation manner.

The fluid machinery 100 as shown in FIG. 60 is a compressor. The compressor includes a dispenser part 90, a housing component 91, a motor component 92, a pump body component 93, an upper cover component 94, and a lower cover and mounting plate 95, wherein the dispenser part 90 is arranged outside the housing component 91; the upper cover component 94 is assembled at the upper end of the housing component 91; the lower cover and mounting plate 95 is assembled at the lower end of the housing component 91; both the motor component 92 and the pump body component 93 are located inside the housing component 91; and the motor component 92 is arranged above the pump body component 93. The pump body component 93 of the compressor includes the above-mentioned upper flange 50, lower flange 60, cylinder 20, rotating shaft 10, piston 32, piston sleeve 33 and piston sleeve shaft 34.

Alternatively, all the parts are connected in a welding, shrinkage fit or cold pressing manner.

The assembly process of the whole pump body component 93 is as follows: the piston 32 is mounted in the guide hole 311, the cylinder 20 and the piston sleeve 33 are coaxially mounted, the lower flange 60 is fixed to the cylinder 20, the sliding fit surfaces 111 of the rotating shaft 10 and a pair of parallel surfaces of the sliding hole 321 of the piston 32 are mounted in fit, the upper flange 50 is fixed to the piston sleeve shaft 34, and the upper flange 50 is fixed to the cylinder 20 via a screw. Thus, assembly of the pump body component 93 is completed, as shown in FIG. 63.

Alternatively, there are at least two guide holes 311, the two guide holes 311 being spaced in the axial direction of the rotating shaft 10; and there are at least two pistons 32, each guide hole 311 being provided with the corresponding piston 32. At this time, the compressor is a single-cylinder multi-compression cavity compressor, and compared with a same-displacement single-cylinder roller compressor, the compressor is relatively small in torque fluctuation.

Alternatively, the compressor in the present disclosure is not provided with a suction valve, so that the suction resistance can be effectively reduced, and the compression efficiency of the compressor is increased.

It is important to note that in the detailed description of the embodiments, when the piston 32 completes motion for a circle, suction and exhaust will be performed twice, so that the compressor has the characteristic of high compression efficiency. Compared with the same-displacement single-cylinder roller compressor, the compressor in the present disclosure is relatively small in torque fluctuation due to division of a compression into two compressions, has small exhaust resistance during operation, and effectively eliminates an exhaust noise.

Specifically speaking, as shown in FIG. 74 to FIG. 80, a cylinder wall of the cylinder 20 in the present disclosure is provided with a compression intake port 21 and a first compression exhaust port 22, when the piston sleeve 33 is located at an intake position, the compression intake port 21 is communicated with the variable volume cavity 31, and when the piston sleeve 33 is located at an exhaust position, the variable volume cavity 31 is communicated with the first compression exhaust port 22.

Alternatively, an inner wall surface of the cylinder wall is provided with a compression intake buffer tank 23, the compression intake buffer tank 23 being communicated with the compression intake port 21 (see FIG. 74 to FIG. 80). In the presence of the compression intake buffer tank 23, a great amount of gas will be stored at this part, so that the variable volume cavity 31 can be full of gas to supply sufficient gas to the compressor, and in case of insufficient suction, the stored gas can be timely supplied to the variable volume cavity 31 so as to ensure the compression efficiency of the compressor.

Specifically speaking, the compression intake buffer tank 23 is provided with an arc-shaped segment in a radial plane of the cylinder 20, and two ends of the compression intake buffer tank 23 extend from the compression intake port 21 to one side where the first compression exhaust port 22 is located.

Alternatively, compared with the compression intake port 21, the arc length of an extending segment of the compression intake buffer tank 23 in a direction consistent with a rotating direction of the piston sleeve 33 is greater than the arc length of an extending segment in an opposite direction.

The operation of the compressor will be specifically introduced below.

As shown in FIG. 1, the compressor in the present disclosure adopts a principle of cross slider mechanism, wherein the axis $O_1$ of the rotating shaft 10 and the axis $O_2$ of the cylinder 20 are eccentric to each other and at a fixed eccentric distance, and the rotating shaft and the cylinder rotate around the respective axes. When the rotating shaft 10 rotates, the piston 32 straightly slides relative to the rotating shaft 10 and the piston sleeve 33, so as to achieve gas compression. Moreover, the piston sleeve 33 synchronously rotates along with the rotating shaft 10, and the piston 32 operates within a range of an eccentric distance e relative to the axis of the cylinder 20. The stroke of the piston 32 is 2e, the cross section area of the piston 32 is S, and the displacement of the compressor (namely maximum suction volume) is V=2*(2e*S). The piston 32 is equivalent to a slider in the cross slider mechanism, the piston and the guide hole 311 serve as a connecting rod $I_1$ in the cross slider mechanism, and the piston 32 and the sliding fit surface 111 of the rotating shaft 10 serve as a connecting rod $I_2$ in the cross slider mechanism. Thus, a main structure of the principle of cross slider is formed.

Figure 65:
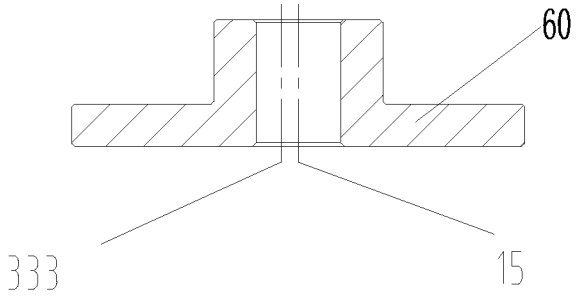
FIG. 65 shows a schematic diagram of a position relationship between the axis of a rotating shaft and the axis of a piston sleeve in the present disclosure at a lower flange in FIG. 64.
Figure 66:
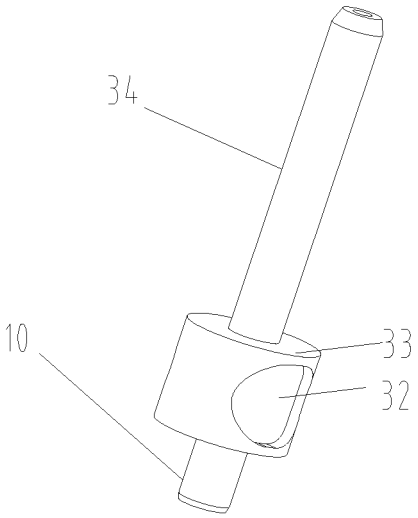
FIG. 66 shows a schematic diagram of a mounting relationship among a rotating shaft, a piston, a piston sleeve and a piston sleeve shaft in FIG. 60.
Figure 74:
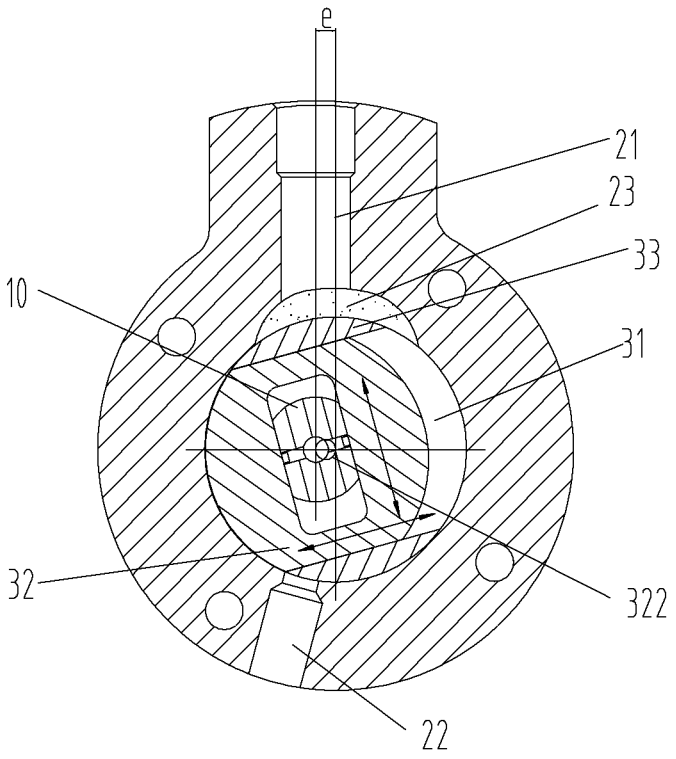
FIG. 74 shows a schematic diagram of a motion relationship among a cylinder, a piston sleeve, a piston and a rotating shaft in FIG. 60.
Figure 75:
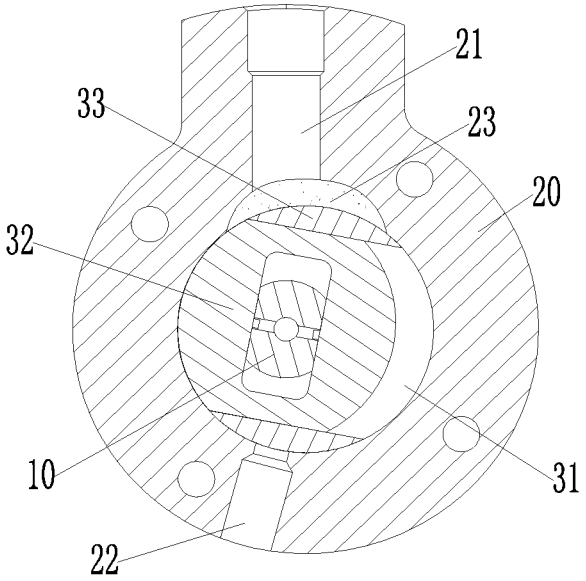
FIG. 75 shows a working state diagram of a piston prepared for suction in FIG. 60.
Figure 76:
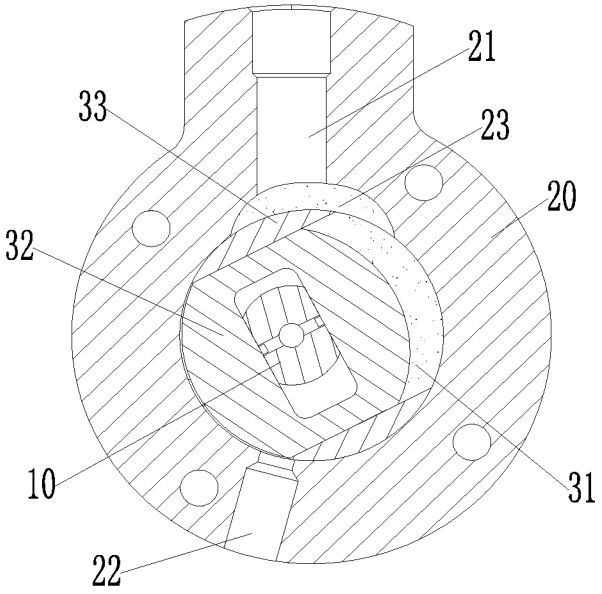
FIG. 76 shows a working state diagram of a piston during suction in FIG. 60.
Figure 77:
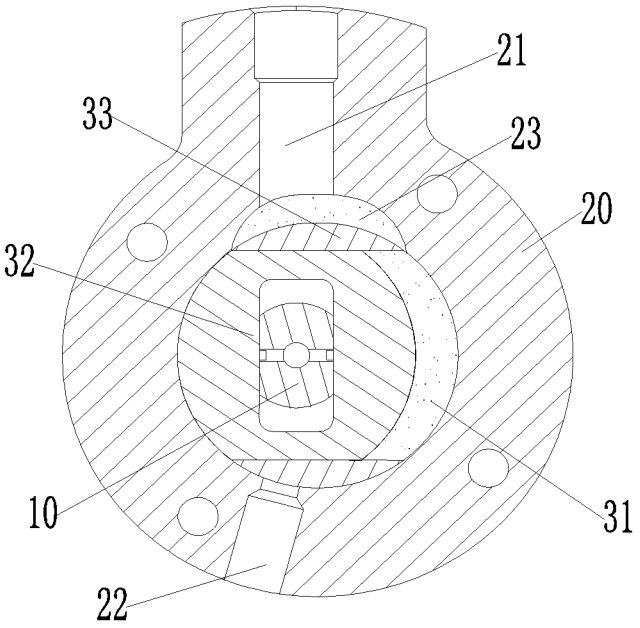
FIG. 77 shows a working state diagram of a piston during gas compression in FIG. 60.
Figure 78:
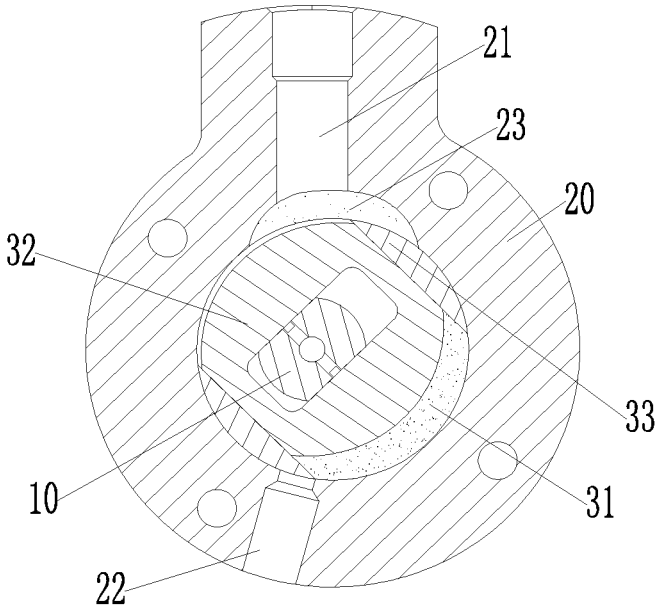
FIG. 78 shows a working state diagram of a piston before exhaust in FIG. 60.
Figure 79:
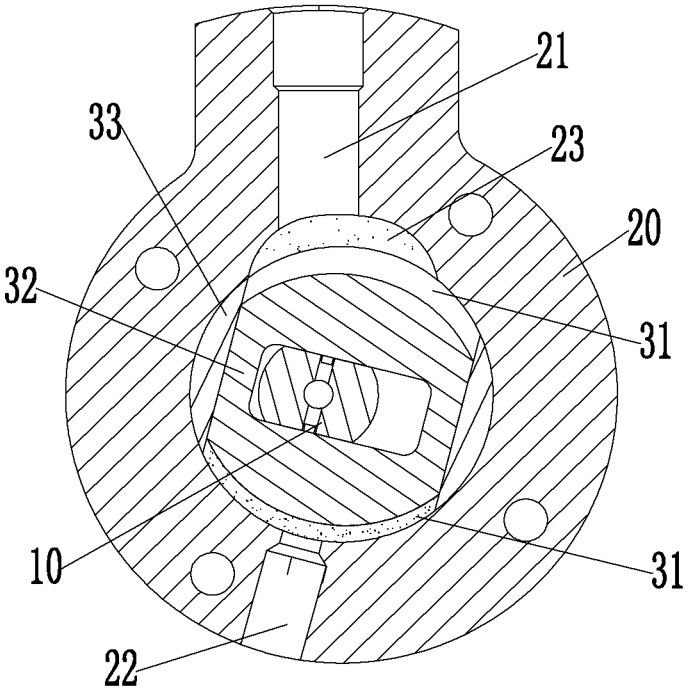
FIG. 79 shows a working state diagram of a piston during exhaust in FIG. 60.
Figure 80:
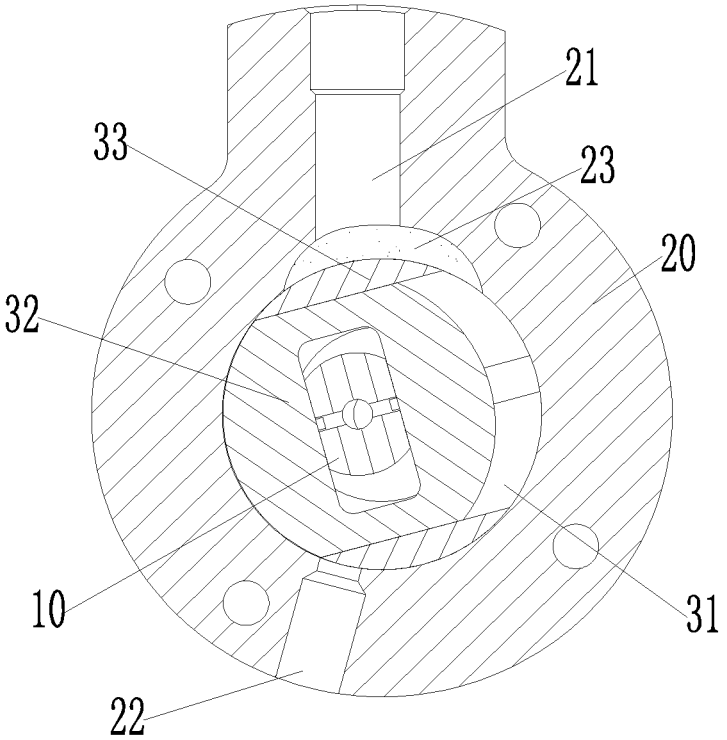
FIG. 80 shows a working state diagram of a piston completing exhaust in FIG. 60.
Figure 81:
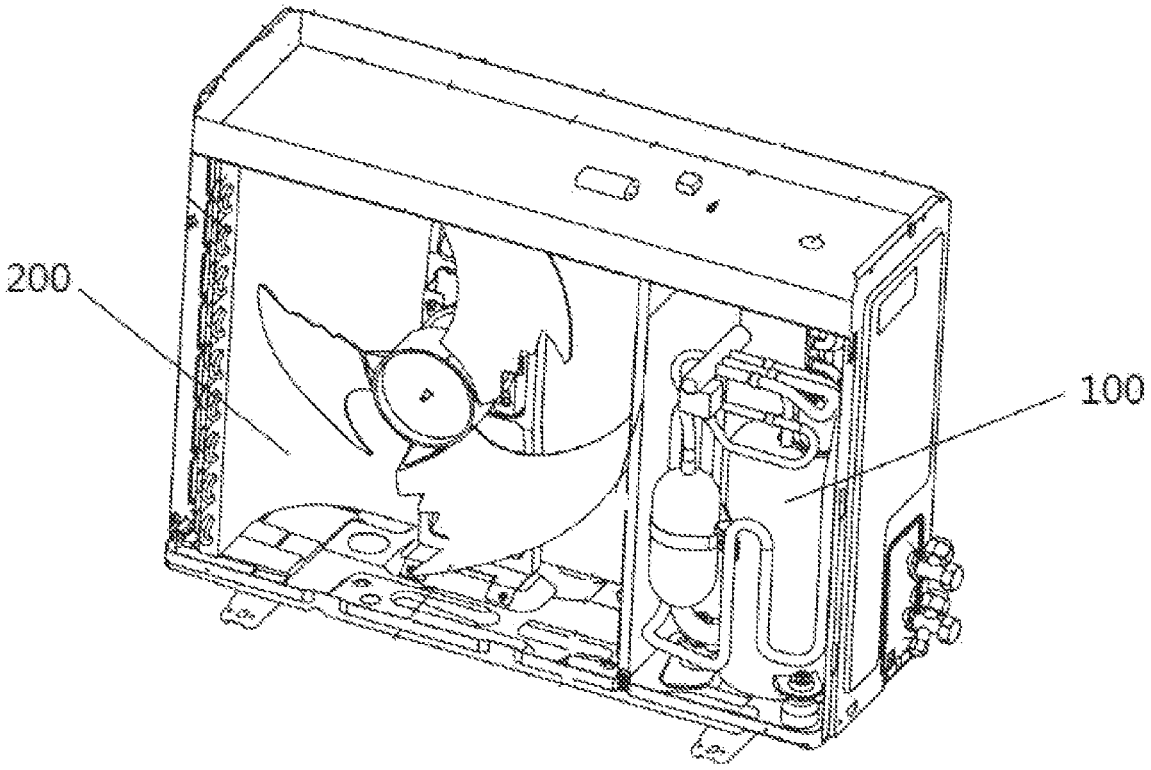
FIG. 81 shows a relation diagram of a heat exchange equipment and a fluid machinery.
Figure 82:
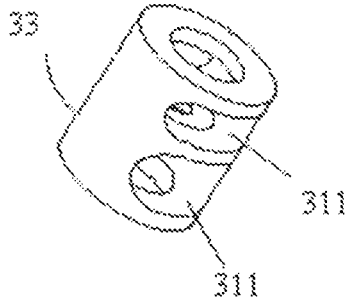
FIG. 82 shows a structure diagram of a piston with two guide hole.

As shown in FIG. 65 and FIG. 74, an eccentric distance e exists between a rotating shaft axis 15 and a piston sleeve axis 333, and a piston center-of-mass trajectory 322 is circular.

The piston sleeve 33 and the rotating shaft 10 are eccentrically mounted, the piston sleeve shaft 34 is connected to the motor component 92, and the motor component 92 directly drives the piston sleeve 33 to rotate, forming a piston sleeve driving structure. The piston sleeve 33 rotates to drive the piston 32 to rotate, the piston 32 drives the rotating shaft 10 to rotate through a rotating shaft supporting surface, and during rotation, the piston 32, the piston sleeve 33 and the rotating shaft 10 fit other pump body parts to complete the process of suction, compression and exhaust, where a cycle is 2 π. The rotating shaft 10 rotates clockwise.

Specifically speaking, the motor component 92 drives the piston sleeve shaft 34 to rotationally move, the guide hole 311 drives the piston 32 to rotationally move, but the piston 32 only makes a reciprocating motion relative to the piston sleeve 33; and the piston 32 further drives the rotating shaft 10 to rotationally move, but the piston 32 only makes a reciprocating motion relative to the rotating shaft 10, this reciprocating motion being vertical to the reciprocating motion between the piston sleeve 33 and the piston 32. In the reciprocating motion process, the whole pump body component completes the process of suction, compression and exhaust. In the piston motion process, due to the two vertical reciprocating motions between the piston 32 and the piston sleeve 33 and between the piston 32 and the rotating shaft 10, the center-of-mass trajectory of the piston 32 is circular, the diameter of the circle is equal to eccentricity e, the center of the circle is located at a midpoint of a connecting line between the center of the rotating shaft 10 and the center of the piston sleeve 33, and a rotating period is π.

The piston forms two cavities in the guide hole 311 of the piston sleeve 33 and the inner circle surface of the cylinder 20, the piston sleeve 33 rotates for a circle, and the two cavities complete the process of suction, compression and exhaust respectively. Differently, there is a phase difference of 180° in suction, exhaust and compression of the two cavities. The process of suction, exhaust and compression of the pump body component 93 is illustrated with one of the cavities as follows. When the cavity is communicated with the compression intake port 21, suction is started (see FIG. 75 and FIG. 76); the piston sleeve 33 continuously drives the piston 32 and the rotating shaft 10 to rotate clockwise, when the variable volume cavity 31 is disengaged from the compression intake port 21, the whole suction is ended, and at this time, the cavity is completely sealed and starts compression (see FIG. 77); rotation is continued, gas is continuously compressed, and when the variable volume cavity 31 is communicated with the first compression exhaust port 22, exhaust is started (see FIG. 78); whilst rotation is continued and gas is continuously compressed, gas is continuously exhausted until the variable volume cavity 31 is completely disengaged from the first compression exhaust port 22, the whole process of suction, compression and exhaust is completed (see FIG. 79 and FIG. 80); and then, the variable volume cavity 31 rotates for a certain angle and then is connected to the compression intake port 21 again, to enter a next cycle.

The pump body component 93 in the present disclosure is of a fixed-pressure ratio pump body structure, two variable volume cavities are V=2*e*S, and S is the cross section area of the piston.

In addition, the compressor in the present disclosure also has the advantages of zero clearance volume and high volume efficiency.

It is important to note that compared with the solution in which the rotating shaft sequentially penetrates through the upper flange 50, the cylinder 20 and the lower flange 60, the compressor in the present disclosure is characterized in that the piston sleeve 33 drives the piston 32 to rotate, the piston 32 drives the rotating shaft 10 to rotate, the piston sleeve 33 and the rotating shaft 10 bear bending deformation and torsion deformation respectively, and the deformation abrasion can be effectively reduced; and leakage between the end face of the piston sleeve 33 and the end face of the upper flange 50 can be effectively reduced. The key point of this solution is that: the piston sleeve shaft 34 and the piston sleeve 33 are integrally molded. Moreover, the upper flange and the lower flange are eccentrically arranged, such that the rotating shaft 10 is eccentric to the piston sleeve shaft 34.

Under other using occasions, the compressor may be used as an expander by changing the positions of a suction port and an exhaust port. That is, the exhaust port of the compressor serves as an expander suction port, high-pressure gas is charged, other pushing mechanisms rotate, and gas is exhausted from the suction port of the compressor (expander exhaust port) after expansion.

When the fluid machinery 100 is the expander, the cylinder wall of the cylinder 20 is provided with an expansion exhaust port and a first expansion intake port, when the piston sleeve 33 is located at an intake position, the expansion exhaust port is communicated with the variable volume cavity 31, and when the piston sleeve 33 is located at an exhaust position, the variable volume cavity 31 is communicated with the first expansion intake port. When high-pressure gas enters the variable volume cavity 31 through the first expansion intake port, the high-pressure gas pushes the piston component 30 to rotate, the piston sleeve 33 rotates to drive the piston 32 to rotate, the piston 32 is allowed to slide straightly relative to the piston sleeve 33, and the piston 32 further drives the rotating shaft 10 to rotationally move. By connecting the rotating shaft 10 to other power consumption equipment, the rotating shaft 10 may apply an output work.

Alternatively, the inner wall surface of the cylinder wall is provided with an expansion exhaust buffer tank, the expansion exhaust buffer tank being communicated with the expansion exhaust port.

Further, the expansion exhaust buffer tank is provided with an arc-shaped segment in a radial plane of the cylinder 20, and two ends of the expansion exhaust buffer tank extend from the expansion exhaust port to a position where the first expansion intake port is located.

Alternatively, the arc length of an extending segment of the expansion exhaust buffer tank in a direction consistent with a rotating direction of the piston sleeve 33 is smaller than the arc length of an extending segment in an opposite direction.

It is important to note that terms used herein are only intended to describe the detailed description of the embodiments, and not intended to limit exemplar implementations of the present application. For example, unless otherwise directed by the context, singular forms of terms used herein are intended to include plural forms. Besides, it will be also appreciated that when terms "contain" and/or "include" are used in the description, it is pointed out that features, steps, operations, devices, components and/or a combination thereof exist.

It is important to note that the description and claims of the present application and terms "first", "second" and the like in the drawings are used to distinguish similar objects, and do not need to describe a specific sequence or a precedence order. It should be understood that objects used in such a way can be exchanged under appropriate conditions, in order that the embodiments of the present disclosure described here can be implemented in a sequence except sequences graphically shown or described here.

The above is only the preferable embodiments of the present disclosure, and not intended to limit the present disclosure. As will occur to a person skilled in the art, the present disclosure is susceptible to various modifications and changes. Any modifications, equivalent replacements, improvements and the like made within the spirit and principle of the present disclosure shall fall within the scope of protection of the present disclosure.

What is claimed is:

1. Fluid machinery (100), comprising:

a rotating shaft (10);

a cylinder (20), the axis of the rotating shaft (10) and the axis of the cylinder (20) being eccentric to each other and at a fixed eccentric distance; and a piston component (30), the piston component (30) being provided with a variable volume cavity (31), the piston component (30) being pivotally provided in the cylinder (20), and the rotating shaft (10) being drivingly connected with the piston component (30) to change the volume of the variable volume cavity (31);

an upper flange (50) and a lower flange (60), the cylinder (20) being sandwiched between the upper flange (50) and the lower flange (60), wherein the piston component (30) comprises:

a piston sleeve (33), the piston sleeve (33) being pivotally provided in the cylinder (20); and a piston (32), the piston (32) being slidably provided in the piston sleeve (33) to form the variable volume cavity (31), and the variable volume cavity (31) being located in a sliding direction of the piston (32), wherein the piston (32) is provided with a sliding hole (321) running through the axial direction of the rotating shaft (10), the rotating shaft (10) penetrates through the sliding hole (321), and the piston (32) rotates along with the rotating shaft (10) under the driving of the rotating shaft (10) and slides in the piston sleeve (33) along a direction vertical to the axial direction of the rotating shaft (10) in a reciprocating manner, the sliding hole (321) is an slotted hole or a waist-shaped hole, the rotating shaft (10) is provided with a sliding segment (11) in sliding fit with the piston component (30), the sliding segment (11) is located between two ends of the rotating shaft (10), and the sliding segment (11) is provided with sliding fit surfaces (111), the sliding fit surfaces (111) are symmetrically provided on two sides of the sliding segment (11), the sliding fit surfaces (111) are parallel with an axial plane of the rotating shaft (10), and the sliding fit surfaces (111) are in sliding fit with an inner wall surface of the sliding hole (321) of the piston (32), a slip direction of the piston (32) is vertical to the axial direction of the rotating shaft (10), the rotating shaft (10) is a one-piece structure that is penetrating through the upper flange and the lower flange.

2. The fluid machinery (100) as claimed in claim 1, wherein a guide hole (311) running through a radial direction of the piston sleeve (33) is provided in the piston sleeve (33), and the piston (32) is slidably provided in the guide hole (311) to make a straight reciprocating motion.

3. The fluid machinery (100) as claimed in claim 2, wherein an orthographic projection of the guide hole (311) at the lower flange (60) is provided with a pair of parallel straight line segments, the pair of parallel straight line segments is formed by projecting a pair of parallel inner wall surfaces of the piston sleeve (33), and the piston (32) is provided with outer profiles which are in shape adaptation to and in sliding fit with a pair of parallel inner wall surfaces of the guide hole (311).

4. The fluid machinery (100) as claimed in claim 2, wherein there are at least two guide holes (311), the two guide holes (311) being spaced in the axial direction of the rotating shaft (10); and there are at least two pistons (32), each guide hole (311) being provided with the corresponding piston (32).

5. The fluid machinery (100) as claimed in claim 1, wherein the piston (32) is provided with a pair of arc-shaped surfaces arranged symmetrically about a middle vertical plane of the piston (32), the arc-shaped surfaces adaptively fit an inner surface of the cylinder (20), and the double arc curvature radius of the arc-shaped surfaces is equal to the inner diameter of the cylinder (20).

6. The fluid machinery (100) as claimed in claim 1, wherein the piston (32) is columnar.

7. The fluid machinery (100) as claimed in claim 1, further comprising a supporting plate (61), wherein the supporting plate (61) is provided on an end face, away from one side of the cylinder (20), of the lower flange (60), the supporting plate (61) is coaxial with the lower flange (60), the rotating shaft (10) penetrates through a through hole in the lower flange (60) and is supported on the supporting plate (61), and the supporting plate (61) is provided with a second thrust surface (611) for supporting the rotating shaft (10).

8. The fluid machinery (100) as claimed in claim 7, wherein the upper flange (50) and the lower flange (60) are coaxial with the rotating shaft (10), and the axis of the upper flange (50) and the axis of the lower flange (60) are eccentric to the axis of the cylinder (20).

9. The fluid machinery (100) as claimed in claim 1, further comprising a limiting plate (26), the limiting plate (26) being provided with an avoidance hole for avoiding the rotating shaft (10), and the limiting plate (26) being sandwiched between the lower flange (60) and the piston sleeve (33) and coaxial with the piston sleeve (33).

10. The fluid machinery (100) as claimed in claim 1, wherein the rotating shaft (10) is provided with a oil passage (13), the oil passage (13) comprising an internal oil channel provided inside the rotating shaft (10), an external oil channel arranged outside the rotating shaft (10) and an oil-through hole (14) communicating the internal oil channel and the external oil channel.

11. The fluid machinery (100) as claimed in claim 10, wherein the external oil channel extending along the axial direction of the rotating shaft (10) is provided at the sliding fit surfaces (111).

12. The fluid machinery (100) as claimed in claim 1, wherein a cylinder wall of the cylinder (20) is provided with a compression intake port (21) and a first compression exhaust port (22), when the piston component (30) is located at an intake position, the compression intake port (21) is communicated with the variable volume cavity (31), and when the piston component (30) is located at an exhaust position, the variable volume cavity (31) is communicated with the first compression exhaust port (22).

13. The fluid machinery (100) as claimed in claim 12, wherein an inner wall surface of the cylinder wall is provided with a compression intake buffer tank (23), the compression intake buffer tank (23) being communicated with the compression intake port (21).

14. The fluid machinery (100) as claimed in claim 13, wherein the compression intake buffer tank (23) is provided with an arc-shaped segment in a radial plane of the cylinder (20), and the compression intake buffer tank (23) extends from the compression intake port (21) to one side where the first compression exhaust port (22) is located.

15. The fluid machinery (100) as claimed in claim 14, wherein the cylinder wall of the cylinder (20) is provided with a second compression exhaust port (24), the second compression exhaust port (24) is located between the compression intake port (21) and the first compression exhaust port (22), and during rotation of the piston component (30), a part of gas in the piston component (30) is depressurized by the second compression exhaust port (24) and then completely exhausted from the first compression exhaust port (22).

16. The fluid machinery (100) as claimed in claim 15, wherein further comprising an exhaust valve component (40), the exhaust valve component (40) being arranged at the second compression exhaust port (24).

17. The fluid machinery (100) as claimed in claim 16, wherein a receiving groove (25) is provided on an outer wall of the cylinder wall, the second compression exhaust port (24) runs through the groove bottom of the receiving groove (25), and the exhaust valve component (40) is provided in the receiving groove (25).

18. The fluid machinery (100) as claimed in claim 17, wherein the exhaust valve component (40) comprises:

an exhaust valve (41), the exhaust valve (41) being provided in the receiving groove (25) and shielding the second compression exhaust port (24); and a valve baffle (42), the valve baffle (42) being overlaid on the exhaust valve (41).

19. The fluid machinery (100) as claimed in claim 12, wherein the fluid machinery being a compressor.

20. The fluid machinery (100) as claimed in claim 1, wherein the cylinder wall of the cylinder (20) is provided with an expansion exhaust port and a first expansion intake port, when the piston component (30) is located at an intake position, the expansion exhaust port is communicated with the variable volume cavity (31), and when the piston component (30) is located at an exhaust position, the variable volume cavity (31) is communicated with the first expansion intake port.

21. The fluid machinery (100) as claimed in claim 20, wherein the inner wall surface of the cylinder wall is provided with an expansion exhaust buffer tank, the expansion exhaust buffer tank being communicated with the expansion exhaust port.

22. The fluid machinery (100) as claimed in claim 21, wherein the expansion exhaust buffer tank is provided with an arc-shaped segment in a radial plane of the cylinder (20), the expansion exhaust buffer tank extends from the expansion exhaust port to one side where the first expansion intake port is located, and an extending direction of the expansion exhaust buffer tank is consistent with a rotating direction of the piston component (30).

23. The fluid machinery (100) as claimed in claim 20, wherein the fluid machinery (100) being an expander.

24. Heat exchange equipment (200), comprising fluid machinery (100), wherein the fluid machinery (100) being the fluid machinery (100) as claimed in claim 1.

25. An operating method for fluid machinery (100), wherein the fluid machinery (100) being the fluid machinery (100) as claimed in claim 1, the operating method comprises:

allowing the rotating shaft (10) to rotate around the axis Oi of the rotating shaft (10);

allowing the piston sleeve (33) of the piston component (30) to rotate around the axis O2 of the cylinder (20), wherein the axis of the rotating shaft (10) and the axis of the cylinder (20) are eccentric to each other and at a fixed eccentric distance; and driving, by the rotating shaft (10), the piston (32) of the piston component (30) to rotate along with the rotating shaft (10) and to slide in the piston sleeve (33) of the piston component (30) along a direction vertical to the axial direction of the rotating shaft (10) in the reciprocating manner.

26. The operating method as claimed in claim 25, adopting a principle of cross slider mechanism, wherein the piston (32) serves as a slider, the sliding fit surface (111) of the rotating shaft (10) serves as a first connecting rod ($l_1$), and a guide hole (311) of the piston sleeve (33) serves as a second connecting rod ($l_2$).

* * * * *